US006395463B1

(12) United States Patent
Edwards

(10) Patent No.: US 6,395,463 B1
(45) Date of Patent: May 28, 2002

(54) MULTILAYER COLOR PHOTOGRAPHIC ELEMENT HAVING AN INTEGRAL LENTICULAR SUPPORT

(75) Inventor: James L. Edwards, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/320,615

(22) Filed: May 26, 1999

(51) Int. Cl.[7] ..... G03C 1/46

(52) U.S. Cl. ..... 430/512; 430/507; 430/510; 430/511

(58) Field of Search ..... 430/507, 510, 430/511, 512

(56) References Cited

U.S. PATENT DOCUMENTS

| | | | | |
|---|---|---|---|---|
| 3,751,258 A | | 8/1973 | Howe et al. | |
| 4,863,836 A | * | 9/1989 | Ishikawa et al. | 430/372 |
| 5,013,621 A | | 5/1991 | Kistner | |
| 5,437,972 A | * | 8/1995 | Ikegawa et al. | 430/574 |
| 5,464,733 A | * | 11/1995 | Friday | 430/507 |
| 5,539,487 A | * | 7/1996 | Taguchi et al. | 354/115 |
| 5,633,719 A | | 5/1997 | Oehlbeck et al. | |
| 5,699,190 A | | 12/1997 | Young et al. | |
| 5,724,758 A | | 3/1998 | Gulick, Jr. | |
| 5,729,332 A | | 3/1998 | Fogel et al. | |
| 5,822,038 A | | 10/1998 | Slater et al. | |
| 5,850,580 A | | 12/1998 | Taguchi et al. | |
| 5,962,210 A | * | 10/1999 | Hahm et al. | 430/567 |
| 6,004,739 A | * | 12/1999 | Ikesu et al. | 430/557 |

FOREIGN PATENT DOCUMENTS

| | | |
|---|---|---|
| JP | 4-097345 | 3/1992 |

* cited by examiner

*Primary Examiner*—Janet Baxter
*Assistant Examiner*—Amanda C. Walke
(74) *Attorney, Agent, or Firm*—Paul A. Leipold

(57) ABSTRACT

The invention relates to a method of recording multiple images by providing an integral, lenticular, multilayer, color photographic element comprising a red light sensitive layer comprising a cyan dye forming coupler, a green light sensitive layer comprising a magenta dye forming coupler, a blue light sensitive layer comprising a yellow dye forming coupler, and an antihalation layer.

60 Claims, No Drawings

MULTILAYER COLOR PHOTOGRAPHIC ELEMENT HAVING AN INTEGRAL LENTICULAR SUPPORT

FIELD OF THE INVENTION

The invention relates to a method for improving the image quality of integral, lenticular, multilayer, color photographic elements and more particularly, for an improved method for reproducing three-dimensional (depth or stereoscopic) or images which contain motion or a combination thereof and methods for manufacturing such elements.

BACKGROUND OF THE INVENTION

Fogel et al, in U.S. Pat. No. 5,729,332, describes a method and apparatus for printing lenticular images which includes imposing lines of information in the form of segmented images of a scene onto a light sensitive material. However, he does not disclose the characteristics of the light sensitive material, or its composition or method of manufacture.

Young et al, in U.S. Pat. No. 5,699,190, describes a lenticular media having spatially encoded portions within the media used for precisely determining the location of the lenticules within the media.

Oehlbeck et al, in U.S. Pat. No. 5,633,719, describe a lenticular print having image bundles and an apparatus for aligning and centering the image bundles under the lenticules in a composite overlay assembly process by encoding angular alignment elements into the photographic material during exposure of the element.

Slater et al, in U.S. Pat. No. 5,822,038, describes a method and apparatus for stretching, aligning and printing a plurality of images onto lenticular media having spatially encoded portions to a silver halide negative material as an alignment process prior to exposure of the negative and the lenticular media in order to correct for pitch errors between the negative and the lenticular media, but does not describe the nature, composition, nor method of preparation of the integral lenticular imaging element.

Taguchi et al, in U.S. Pat. No. 5,539,487, and a divisional U.S. Pat. No. 5,850,580 describes a method and apparatus for recording stereoscopic images onto an integral lenticular media using a scanning exposing device, but does not describe the nature, composition, nor method of preparation of the integral lenticular imaging element.

Howe et al, in U.S. Pat. No. 3,751,258, describe an 'auto-stereographic' print in which the integral, multilayer color photographic lenticular image also contains an integral reflective backlayer. Since the reflective backlayer is applied on the side opposite the lenticular surface as part of the preparation of the element, the element must then be exposed through the lenticular support. Additionally, the element does not contain an anti-halation layer.

Telfer et al, in U.S. Pat. No. 5,279,912, describes an integral, thermal lenticular imaging media in which the image is developed after heating via exposure with an infra-red light emitting laser.

Morton, in U.S. Pat. No. 5,689,372, describes an integral lenticular imaging element having an anti-halation layer positioned on the surface of the lenticules of the media, but does not describe the composition nor method of application of the anti-halation layer.

Morton, in European Patent Application EP 0 780 728 A1, describes an integral lenticular imaging element having an anti-halation layer positioned on the surface of the media opposed to the lenticules of the media but does not describe the composition nor method of application of the anti-halation layer.

Morton, in U.S. Pat. No. 5,639,580, describes an integral lenticular imaging element having a non-specular reflective backlayer positioned behind the integral image which reflects more than 80% of the light reaching the reflective layer.

Kistner, in U.S. Pat. No. 5,013,621, describes a one part coating composition for providing a white reflective backlayer to lenticular images wherein the backlayer is applied after exposure, chemical development and drying.

Shiba in Japanese Pat. No. 4,097,345 describes a method for applying an anti-reflection overcoat to the lenticular surface of an integral color photographic element having a lenticular support.

Current color silver halide color print materials utilize three color forming layers comprised of a red light sensitive, cyan dye forming layer; a green light sensitive, magenta dye forming layer and a blue light sensitive, yellow dye forming layer. These color print or display materials -reproduce images which are 2-dimensional representations of the original 3-dimensional scene. Attempts to manufacture images in which the viewer perceives a sense of depth (or 3-dimensionality) or, images in which the viewer perceives a sense of motion have been demonstrated by several manufactures using different manufacturing processes.

Existing lenticular imaging methods and materials typically use non-integral or integral silver halide photographic elements. Other methods of lenticular imaging have also been commercialized which use various printing techniques such as lithography, ink-jet, thermal dye transfer or dye sublimation. The characteristics of these processes are such, however, that the quality of the final lenticular image is restrained by the methods and the resolution of the art which subsequently limit the number of images capable of being uniquely resolvable under each lenticule by the viewer.

Non-integral silver halide based elements are those in which the multiplexed depth or motion images or combination of images are first exposed onto a positive producing 2-dimensional print material such as Kodak Duraclear™, Kodak Duraflex™, Kodak Duratrans™ or Kodak Ektachrome™ Sheet Films. For those negative working materials, a negative must first be prepared using a film such as Kodak Vericolor Sheet Film™. The multiplicity of images are first segmented into the desired number of views (more than 2, but typically less than 50) and then interlaced (i.e.: view 1, view 2, . . . view n; view 1, view 2, . . . view n) in a computer to provide the desired sequence of images in the final lenticular image print. The digitized print information is then exposed (written) onto the negative using a drum writer, such as that manufactured by Dice America. Digital film writers such as this use light valve technology (LVT) or, more recently, light emitting diode (LED) technology to expose the digital image information onto the negative material or the 'chrome' (positive) material if a positive is desired.

Drum writers such as these create image pixels of red, green and blue exposure information by modulating the light output of the LED's in accordance with the position of the write head in concert with the composition of the original scene. The write head is positioned over the sensitized material which is clamped onto a spinning drum. As the drum spins, the digitized information from the original scene is converted to a series of pulses of red, green and blue light and tightly focused into a narrow beam which exposes the material in a series of lines. This direction of exposure is known as the 'fast scan' direction. After each rotation of the drum, the position of the write head is moved in a direction perpendicular to the direction of the spinning drum and the exposure process repeated. This is known as the 'slow scan' direction.

After the entire image has been exposed onto the material it is removed from the drum and processed to develop the latent image. If the material is a color negative type material, then the Kodak Flexicolor C41™ process would be used to develop the lines of image information. This master negative can now be used in a conventional 'contact printer' to expose the final negative print material, such as Kodak Duraclear™. After exposure of the master negative onto the print material, the print is processed. A preferred process for the Kodak Duraclear™ material is the Kodak Ektacolor RA4™ process. The image in this material can be unrecognizable as it is designed to be viewed using a lenticular lens screen.

To make the final lenticular image, the print is first coated with an adhesive material, then laminated to a lenticular screen having the same pitch as the images in the print. After lamination, the image must be aligned before the adhesive takes hold and prevents the print material from sliding easily across the lenticular screen. The process of aligning requires an operator to move the lenticular screen in such a way that the lines of image in the print are correlated to the pitch of the lenticular screen in the x-direction and that the lines of image information in the print remain correlated under the lenticules of the screen in the y-direction. This manual alignment process reduces the angular alignment error, and if the pitch of the images in the print matches the pitch of the lenticules in the lenticular screen, a lenticular image will result which is free of alignment error, resulting in a high quality image. However, as the complexity of the images increase, as in the case where more than 2 images are placed under each lenticule, the manual alignment process becomes increasingly difficult and tedious. Because of this difficult alignment process and the difficulty in manufacturing lenticular screens having perfect pitch and writing the lines of image information with drum writers in perfectly straight lines at the same pitch as the lenticular screen, the overall process yield is low and the quality of the image suffers as the size of the image and its complexity increase. This process can be used to manufacture images which are viewed by transmitted light (display conditions) or by reflected light (print viewing). An example of such a construction is shown in Table 1 (for display viewing) and in Table 2 for reflection print viewing. A modification of this process which is also available commercially is illustrated in Table 3 where 'double sided' adhesive tape is used to combine the lenticular screen to the print material.

Because of the large number of steps in these processes, precise matching of pitch between the lenticular screen and the final print material as well as control of the uniformity of thickness of the adhesive between the print and the screen, limit the final quality of the viewer perceived image since any variation in thickness of any of the components will cause the image to be moved away from the focal point of the lenticular lens. In addition, since the loss of sharpness of each of the steps of the process and the inherent sharpness of each of the photographic materials is critical in determining the number of images which can be uniquely resolved under each lenticule of the screen their combined effect is to limit the viewer perceived quality by making the fmal image appear 'fuzzy', or out-of-focus.

This alignment process is somewhat mitigated by using the method of Fogel et al, in U.S. Pat. No. 5,729,332 to pre-align the images with the lenticules, or by including reference grids or marks into the lenticular materials as disclosed by Young et al, in U.S. Pat. No. 5,699,190 and then using a printer such as that described by Slater et al, in U.S. Pat. No. 5,822,038 which detects the reference marks in both the lenticular screen and the print material, and then mechanically and automatically first stretches, then aligns the materials to compensate for pitch variations in the materials before making the exposure. This device can be used for integral lenticular imaging materials as well.

An integral silver halide element was disclosed by Howe et al, in U.S. Pat. No. 3,751,258. This element included a permeable reflective backlayer so that after exposure, the element could be processed. The color developers diffusing through the layer and the by-products of development washing out. Due to the orientation of the element, image-wise exposure necessarily was made through the lenticules. This approach limits the resolution of the final images under the lenticules due to the poor optical characteristics of the single lenticular lens due primarily to the spherical aberration and coma associated with single lens elements. As such, the preferred pitch of the element is between 100 and 300 lines per inch. Additionally, Howe did not provide an antihalation layer to prevent halation exposure from back reflection of the reflective back-layer, further limiting the resolution of the imaging system.

Other silver halide, integral, lenticular imaging systems have been manufactured by the Eastman Kodak Co., whose system design constructs, such as high lenticular pitch (approximately 200 lenticules per inch), have limited them to being exposed from the front (lenticular) side of the element. These materials are shown schematically in Tables 4 and 5. The element shown in Table 4 also contains an integral reflective backlayer, like that describe by Howe, while the element shown in Table 5 is a transparency and is designed for backlit display viewing. Since these materials are both designed to be exposed from the front (lenticular side), alignment of the images with the lenticules is diffcult and compensation for changes in pitch is impossible, and there is no mechanism to compensate for angular alignment differences between the photographic element and the negative image. For images of this type to be of good quality, they must have be composed of a small number of individual images (typically 2 to 4) and the printing process must be precisely designed, manufactured and pre-aligned to maintain registration of the images with the pitch of the integral lenticular material as there is not an alignment process during the printing. In addition, the image resolution is also limited by the quality of the single element lenticular lens due to the spherical aberration and coma associated with single element lenses.

Taguchi et al, in U.S. Pat. No. 5,539,487 and a divisional U.S. Pat. No. 5,850,580, describes a method and apparatus for recording stereoscopic images onto an integral lenticular media using a scanning exposing device to expose the light sensitive element from the side away from the lenticules. With this design he recognizes the need for an antihalation layer to prevent light from entering into the lenticules during exposure; however, he does not describe the nature, composition, nor method of preparation of the integral lenticular imaging element. He does, however, deal with the difficult problem of keeping the scanning exposing beam on pitch, by using a beam alignment system to monitor and adjust for the angular alignment of the lenticules and the pitch of the lenticular sheet. Nor does he recognize the requirements of the integral photographic element to have good high intensity reciprocity characteristics to permit exposure of the element at extremely short exposure times such as those associated with scanning, exposing devices such as light emitting diodes (LED's), scanning cathode ray tubes (CRT's) or other devices such as a multi-wavelength laser exposing device.

Shiba, in Japanese Pat. No. 4,097,345, also discloses an integral, lenticular, silver halide based element of high pitch, preferably 180 to 500 lenticules per inch, but which contains an anti-halation layer on the surface furthest from the lenticular support. This design construct also limits the system to being exposed through the lenticular side of the support, which also inherently limits the final resolution of the photographic system due primarily to the spherical aberration and coma associated with single lens elements.

PROBLEM TO BE SOLVED BY THE INVENTION

There is a need for a motion imaging material that does not require alignment of a lenticular member with a developed image.

SUMMARY OF THE INVENTION

It is an object of this invention to provide improved images which contain motion in either a transmissive or reflection print or display mode of viewing.

It is an object of this invention to overcome the disadvantages of prior photographic elements when digitally exposed using lasers, CRT's or light emitting diodes (LED's) where the exposing times are exceptionally short.

It is another object of this invention to provide a novel, integral, lenticular, multilayer, color photographic element having more uniform response sensitivity to allow printing in both conventional, analog and digital exposing devices.

It is a further object to provide integral, lenticular, multilayer, color photographic element with has high density in the shoulder and Dmax regions when exposed using a digital exposing device such as a laser, light emitting diode (LED) or scanning cathode ray tube (CRT).

It is a further object to provide an integral, lenticular, multilayer, color photographic element with has improved sharpness, in the mid and upper scale density regions when exposed using a digital exposing device such as a laser or light emitting diode.

These and other objects of the invention are generally accomplished by a method of recording multiple images by providing a color photographic element comprising a transparent lenticular support; an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant and exposing said element from the non-lenticular side of the support using a scanning beam device, or an optical exposing device, and subsequently developing said image then applying a reflective backlayer to the non-lenticular side of the element to produce an integral, lenticular, multilayer color reflection print if desired.

ADVANTAGEOUS EFFECT OF THE INVENTION

The invention provides bright, clean images and does not require alignment of a lenticular member and developed images.

DETAILED DESCRIPTION OF EMBODIMENTS OF THE INVENTION

The invention provides numerous advantages over prior photographic elements and practices. The elements of the invention may be digitally exposed at time of between $1\times10^{-5}$ and $1\times10^{-9}$ seconds by digital exposing devices, or exposed in conventional optical printing systems whose exposure times are more typically $1\times10^{-2}$ to $1\times10^{3}$ seconds. When digitally or conventionally exposed they have well saturated colors in high density areas and exhibit minimal fringing at the borders of low density areas.

The use of pyrazoloazole magenta dye forming couplers allows silver coverage reduction in the green light sensitive magenta dye forming layer without any reduction in magenta gamma. This reduction in magenta silver coverage allows an increase in silver coverage in the blue light sensitive yellow dye forming layer without increasing total silver coverage, which increases yellow gamma and improves performance in a digital exposing device. In this way, total silver coverage is kept constant, while providing an advantage in yellow gamma. It is important to keep total silver coverage low, in order to keep cost low and maintain acceptable developability and bleachability.

The terms "above", "upper" and "top" as used herein mean the side or toward the side from which exposure of the photosensitive photographic material on a substrate takes place or has taken place. "Lower", "bottom" or "back" means the side or toward the side of the element away from which exposure of the silver halide material takes place or has taken place. Integral means not readily separated by mechanical means and comprising one unitary whole.

The invention provides in a preferred form a color photographic element comprising a red light sensitive layer comprising a cyan dye forming coupler, a green light sensitive layer comprising a magenta dye forming coupler, a blue light sensitive layer comprising a yellow dye forming coupler in combination with an anti-halation layer, wherein said magenta dye forming coupler preferably comprises Magenta-1

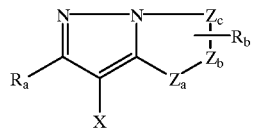

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$, and wherein said blue light sensitive layer is the light sensitive layer nearest the top of the photographic element and contains an emulsion comprising greater than 90 percent silver chloride.

In order to increase performance of color silver halide materials in digital printers, there is a desire to have higher gamma at sub-microsecond exposure times in all three color records. Due to the large grain size of the blue light sensitive emulsion, the location of conventionally designed blue light sensitive yellow dye forming layers, and the high intensity reciprocity performance of conventionally sensitized blue light sensitive emulsions, the gamma of the blue light sensitive color record can be a limiting factor. These effects are especially evident in areas of high dye density, that is in the shoulder and Dmax (area of maximum density) regions. For instance, in the case of the blue light sensitive layer, a low shoulder would lead to black areas turning blue and yellow colors becoming desaturated.

One common way to increase gamma is increase the silver coverage of the emulsion. However, increased silver causes a number of problems. In particular, higher silver coverage leads to reduction in developability. This results in a lowering of neutral gamma for a given silver coverage and for a given time of development, or increased process sensitivity. Increased silver coverage also increases the thickness of the element. This increase in thickness is a primary cause of reduced sharpness in the element and is frequently manifested as fringing around numbers or text or by the loss of resolution in motion images due to increased bandwidth of the image.

A further effect of using high coverage of emulsion is a deleterious loss of color purity. Typically, color photographic elements contain oxidized developer (Dox) scavenging interlayers (otherwise known as anti-color-mixing layers) to prevent interlayer color contamination. In the case of large grained emulsions, the scavenging layer may be increased in thickness or in concentration of the scavenging component in order to prevent formation of unwanted dye in adjacent layers. This also results in materials being wasted, since no dye is formed as a result of this process. In some instances, the very large grained emulsions produce a local concentration of Dox (oxidized developer) that is too high to be completely used by the appropriate coupler and/or scavenged by an anti-color mixing agent. For instance, in the case of large grained emulsions used in the blue layer, this can result in the formation of magenta colored spots in the photographic print from reaction of Dox formed in the blue layer with magenta coupler situated in the green layer.

When exposing conventional photographic materials by digital imaging there is a tendency for the images to have a defect commonly referred to as fringing which is a loss of image sharpness. This defect is most apparent at the edges of white areas of the prints bordering areas of higher density. Therefore there is a need to minimize fringing by silver halide materials exposed by digital means.

While increasing the silver coverage in the blue light sensitive layer increases yellow layer gamma, the yellow shoulder density is further improved by utilizing the yellow coupler Y-5. At the same time, yellow coupler Y-5 improves the color purity of the yellow dye.

A typical multicolor photographic element utilized in the invention comprises a support bearing a cyan dye image forming layer comprised of at least one red light sensitive silver halide emulsion having associated therewith at least one cyan dye-forming coupler, a magenta dye image forming layer comprising at least one green light sensitive silver halide emulsion having associated therewith at least one magenta dye-forming coupler, and a yellow dye image forming layer comprising at least one blue-sensitive silver halide emulsion having associated therewith at least one yellow dye-forming coupler. The element also contains an antihalation layer adjacent to the lenticular support. The element can contain additional layers, such as filter layers, interlayers, overcoat layers, subbing layers, and the like.

To prevent halation during exposure, an antihalation layer needs to be provided between the blue light sensitive layer and the lenticular support. The antihalation layer in the element of this invention also contains UV-light absorbers to protect the yellow image dye from dye fade due to exposure to light. The antihalation layer acts as a photon trap, absorbing photons of light which were not part of the latent image formation process after exposure. This layer prevents light from being scattered throughout the photographic element, where it could potentially expose silver halide grains not inline with the exposing beam of incident exposure light. Eliminating the light which is not part of the latent image forming process eliminates halation and increases image sharpness. This is especially important when a scanning exposing device is employed on integral lenticular materials, since the lines of image information are very narrow, typically $5\mu$ to $10\mu$ in diameter. If the consecutive adjacent lines of image information differ significantly in intensity and which subsequently result in significantly different amount of image density, if the element is un-sharp, the lines will broaden unnecessarily and merge in such a way that the distinct separate images will appear undistinguished from each other. Thus an image scene which is predominantly "dark" which is arranged adjacent to an image scene which is predominately "light" will visually blur together in the eyes of the observer and reduce the apparent quality of the image.

Antihalation layers are common in most color negative films such as Kodak Advantix™ film and also are found in some color print films such as Kodak Vision Color Print Film™ or Kodak Duraclear RA Display Material™. Antihalation materials are incorporated to absorb light not absorbed as part of the imaging process. This material is typically 'grey' in color and absorbs light of all color. A variety of materials have been suggested to fill this requirement. Finely dispersed carbon black is used in some products and is known in the trade as 'rem-jet'. It must be removed prior to the chemical development step via a pre-bath and as such must be coated on the side of the support opposite the imaging layers as it cannot be solubilized during the processing cycles. Finely divided elemental silver is also widely used in many color negative films. This material is known as 'grey gel' and is easily removed in the chemical development process during the bleaching and fixing steps. In some products, mixtures of water soluble cyan, magenta and yellow dyes are coated in a separate layer (usually on the side of the support opposite the emulsion layers). If these water soluble dyes are coated on the same side of the support as the emulsions, they diffuse into the emulsion layers after the coating operation and retard the photographic speed of the photographic element. Since these dye are aqueous soluble, they are conveniently removed during processing via diffusion or reaction with alkali or sulfite in the color developer.

To overcome this tendency, solid particle dispersions of these dyes have been developed. The dyes in these formulations are insoluble under all but alkaline conditions so that they remain in the layer in which they are coated, but can be removed by hydrolysis or ionization during the chemical development step of the photographic process.

The support utilized in the photographic element of the invention is unique in that it is not symmetrical, having a planar side and a lenticular side. The planar side is typically treated with a corona discharge and/or additional subbing materials such as gelatin or mixtures of polymers and gelatin in a thin layer in order to promote adhesion between the emulsion layers and the support. The lenticular side of the support is comprised of half-cylindrical lenses which are used to focus the image into the emulsion layers on the planar side of the support. For this reason, there is a specific relationship between the curvature of the lens, the thickness of the support and the refractive index of the support material. This relationship defines the focal length of the lens. The lenticular side of the support may also be treated with corona discharge in order to promote adhesion of additional layers of material to control static buildup during conveyance of the web through a coating machine at high speed, an anti-reflection layer to reduce light scatter while viewing the image, a protective overcoat to prevent scratching of the lenses, and other functional layers.

Suitable materials include transparent plastic materials which can be readily formed or extruded such as cellulose nitrate, cellulose acetate, cellulose acetate butyrate, polyacrylate, polystyrene, polyvinyl chloride, polyethylene terephthlate, polycarbonate, etc. A preferred material is transparent polyester sheets or webs, particularly extruded using polyethylene terephthalate-glycolate. The preferred material is between 4 and 50 mils in thickness and most preferably about 16 to 30 mils in thickness.

The lenticular pitch of the material is proportional to the thickness of the support and the refractive index of the support material. Generally, the thinner the support, the higher the pitch. However, as the pitch is increased, the number of images which can be written beneath the lens element diminishes with the diameter of the cylindrical lenticular lens. For this reason, the number of lines of unique image information to be written under each lens must be known as the limitations of the systems capability to resolve each line of image information determines the ultimate pitch of the system. For the preferred thickness of support, and the characteristics of the best line writing systems and photographic characteristics, the pitch of the material is preferred to be between 50 and 150 lenticules per inch and more preferably between 60 and 120 lenticules per inch and most preferably between 65 and 100 lenticules per inch.

The lenticular support may also include embedded, encoded portions such as those described by Young et al in U.S. Pat. No. 5,699,190 in order to provide precise alignment and registration of the lines of image information, such as required in the printing and alignment apparatus described by Slater et al in U.S. Pat. No. 5,822,038. Laser or LED printing devices such as the one described by Taguchi et al in U.S. Pat. No. 5,539,487 may also require embedded registration lines or lenticules in the support to maintain the alignment of the exposing beam with the lenticule during exposure of the image onto the element.

In the following discussion of suitable materials for use in the emulsions and elements that can be used in conjunction with this invention, reference will be made to *Research Disclosure*, September 1994, Item 36544, published by Kenneth Mason Publications, Ltd., Dudley House, 12 North Street, Emsworth, Hampshire PO10 7DQ, England, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (bl) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering*, Vol. 24, No. 6 November/December 1980, pp. 265–267 (pm, Ir, a, b and d); Hochstetter U.S. Pat. No. 1,951,933 (Cu); De Witt U.S. Pat. No. 2,628,167 (T1, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Ti, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, c1, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,4,828,962 (Ru+Ir, b1); Janusonis U.S. Pat. No. 4,835,093 (Re, a1); Leubner et al U.S. Pat. No. 4,902,611 (Ir+4); Inoue et al U.S. Pat. No. 4,981,780 (Mn, Cu, Zn, Cd, Pb, Bi, In, Ti, Zr, La, Cr, Re, VIII, c1, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. Nos. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EP 0 244 184 (Ir, Cd, Pb, Cu, Zn, Rh, Pd, Pt, TI, Fe, d); Miyoshi et al EP 0 488 737 and 0 488 601 (Ir+VIII/Sc/Ti/V/Cr/Mn/Y/Zr/Nb/Mo/La/Ta/W/Re, a2, b, g); Ihama et al EPO 0 368 304 (Pd, a2, g); Tashiro EP 0 405 938 (Ir, a2, b); Murakami et al EP 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, ol); Yamasue et al U.S. Pat. No. 3,901,713 (Ir +Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EP 0 509 674, Ohya et al EP 0 513 738, Janusonis WO 91/10166, Beavers WO 92116876, Pietsch et al German DD 298,320, and Olm et al U.S. Pat. No. 5,360,712.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EP 0 273 430 (Ir, Rh, Pt); Ohshima et al EP 0 312 999 (Ir, f); and Ogawa U.S. Statutory Invention Registration H760 (Ir, Au, Hg, Ti, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopantsi which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

In a specific, preferred form of the invention it is contemplated to employ a class (i) hexacoordination complex dopant satisfying the formula:

$$[ML_6]^n \quad \text{(I)}$$

where n is zero, −1, −2, −3 or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and Research Disclosure Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In3CS)_6]^{-3}$
(i-11) $[FeCO(CN)_5]^{-3}$
(i-12) $[RUF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)C_5]^{-4}$
(i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys., Vol.* 69, pp. 4580–7 (1978) and *Physica Status Solidi A*, Vol. 57, 429–37 (1980) and R. S. Eachus and M. T. OlmAnnu. *Rep. Prog. Chem. Sect. C. Phys. Chem.*, Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712, Olm et al U.S. Pat. No. 5,457,021 and Kuromoto et al U.S. Pat. No. 5,462,849.

In a preferred form it is contemplated to employ as a class (ii) dopant a hexacoordination complex satisfying the formula:

$$[IrL^1_6]^{n'} \quad \text{(II)}$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(thiazole)]^{-2}$
(ii-2) $[IrCl_4(thiazole)_2]^{-1}$
(ii-3) $[IrBr_5(thiazole)]^{-2}$
(ii-4) $[RrBr_4(thiazole)_2]^{-1}$
(ii-5) $[UrCl_5(5\text{-methylthiazole})]^{-2}$
(ii-6) $[IrCl_4(5\text{-methylthiazole})_2]^{-1}$
(ii-7) $[IrBr_5(5\text{-methylthiazole})]^{-2}$
(ii-8) $[RrBr_4(5\text{-methylthiazole})_2]^{-1}$ In one preferred aspect of the invention in a layer using a magenta dye forming coupler, a class (ii) dopant in combination with an OsCl5(NO) dopant has been found to produce a preferred result.

Emulsions demonstrating the advantages of the invention can be realized by modifying the precipitation of conventional high chloride silver halide grains having predominantly (>50%) {100} crystal faces by employing a combination of class (i) and (ii) dopants as described above.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EP 0 392 092.

Further, it would be advantageous to practice elements of the invention in conjunction with the materials disclosed in an article entitled "Typical and Preferred Color Paper, Color Negative, and Color Reversal Photographic Elements and Processing" which was published in *Research Disclosure*, February 1995, Volume 370. In particular, Sections I–XIII, XV–XVIII, and XXIIIA are especially relevant, and are hereby incorporated by reference.

Any photographic coupler known to the art can be used in conjunction with elements of the invention. Suitable couplers are described in *Research Disclosure*, Item 36544, Section X. In addition, the structures of particularly preferred couplers can be found in an article entitled "Typical and Preferred Color Paper, Color Negative, and Color Reversal Photographic Elements and Processing" which was published in *Research Disclosure*, February 1995, Volume 370, Section II.

The magenta coupler utilized in the invention may be any magenta coupler of the following structure:

MAGENTA-1

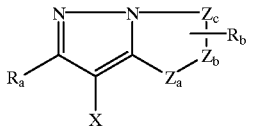

wherein $R_a$ and $R_a$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Preferred magenta couplers are 1 H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. No. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

In particular, pyrazoloazole magenta couplers of general structures PZ-1 and PZ-2 are especially preferred:

PZ-1

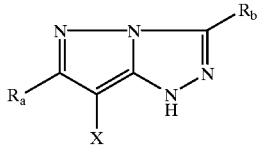

PZ-2

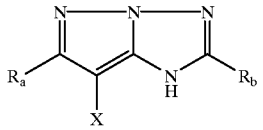

wherein $R_a$, $R_b$, and X are as defined for MAGENTA-1.

Particularly preferred are the two-equivalent versions of magenta couplers PZ-1 and PZ-2 wherein X is not equal to a hydrogen. This is the case because of the advantageous drop in silver required to reach the desired density in the print element.

Typical magenta couplers that may be used in the inventive photographic element are shown below.

M-1

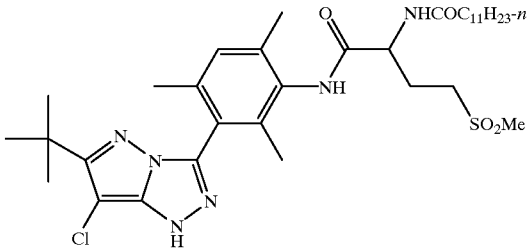

M-2

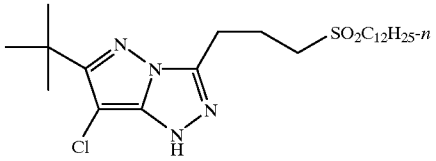

M-3

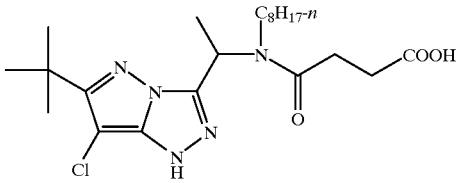

-continued
M-4
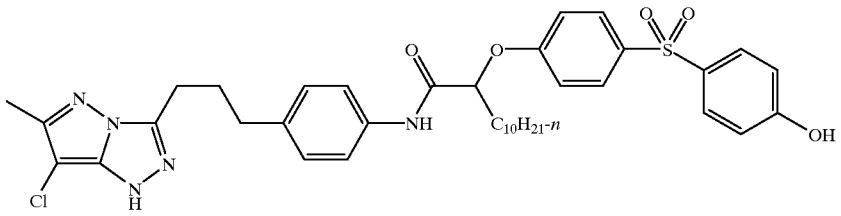
M-5
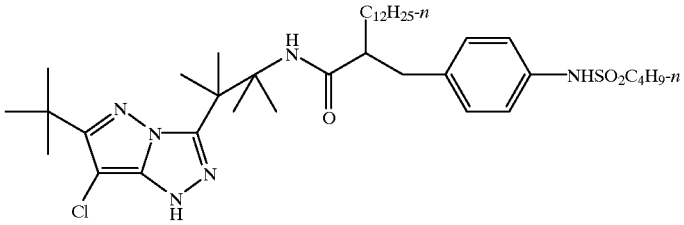
M-6
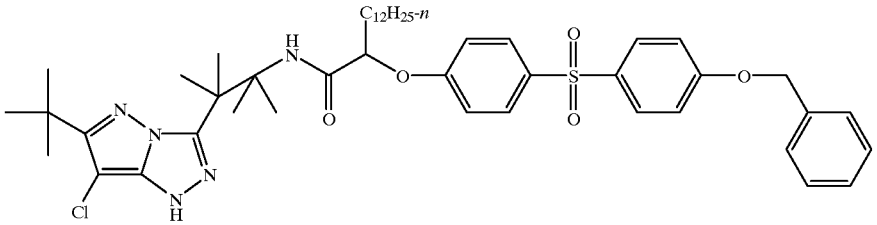
M-7
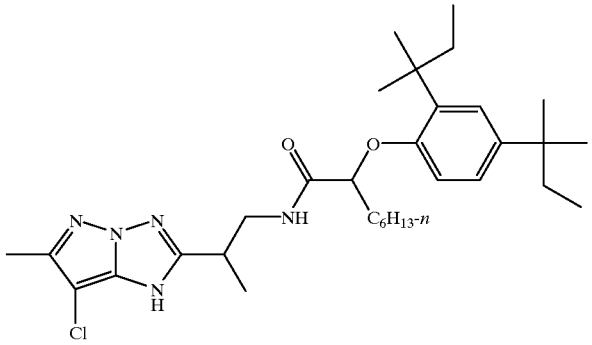
M-8
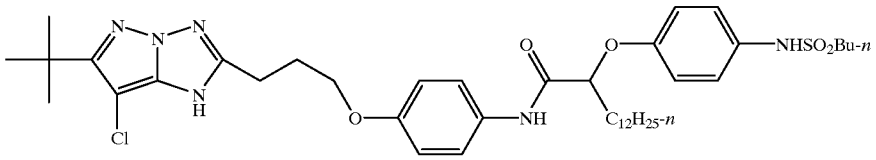
M-9
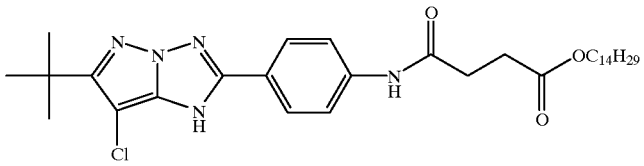

A preferred magenta coupler is

M-2

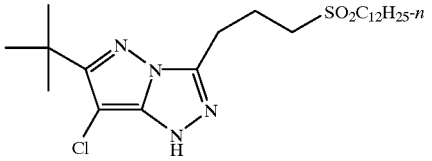

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

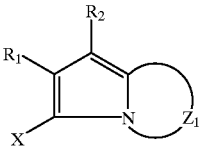

CYAN-2

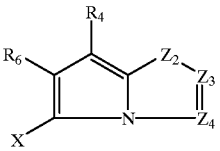

CYAN-3

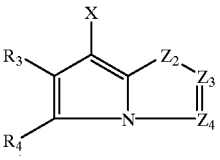

CYAN-4

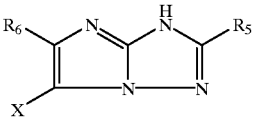

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents $C(R_7)$═ and —N═; and $Z_3$ and $Z_4$ each represents —$C(R_8)$═ and —N═.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

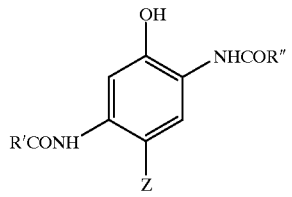

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

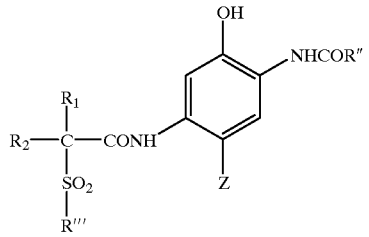

wherein

R' and R'" are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R'" is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R' is suitably an unsubstituted or substituted amino, alkyl or aryl group or a 5–10 membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, RX is a 4-chlorophenyl, 3,4-dichlorophenyl, 3,4-difluorophenyl, 4-cyanophenyl, 3-chloro-4-cyanophenyl, pentafluorophenyl, or a 3- or 4-sulfonamidophenyl group.

In formula (I), when R'" is alkyl it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (1) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

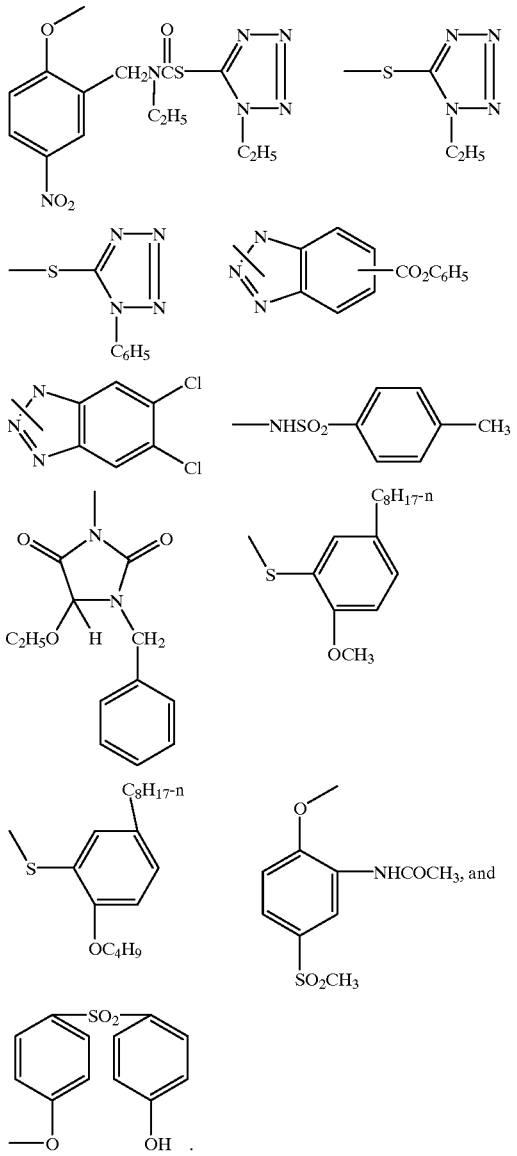

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffuisible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling; thus, the ballast is most advantageously provided as part of groups other than Z.

The following examples further illustrate preferred coupler of the invention. It is not to be construed that the present invention is limited to these examples.

IC-1

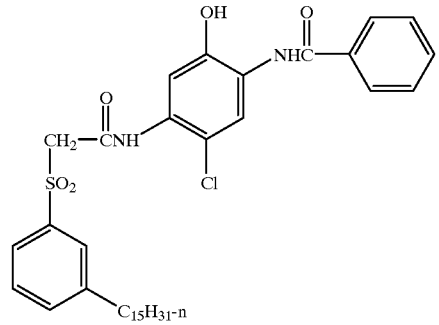

IC-2

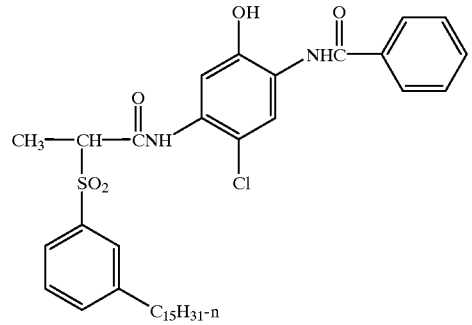

IC-3

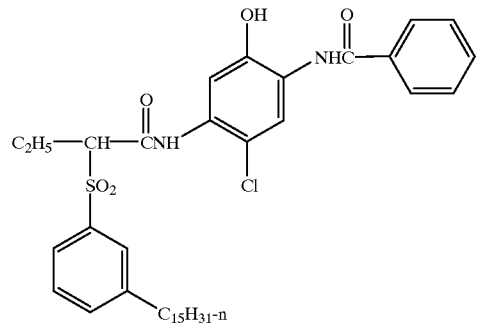

IC-4

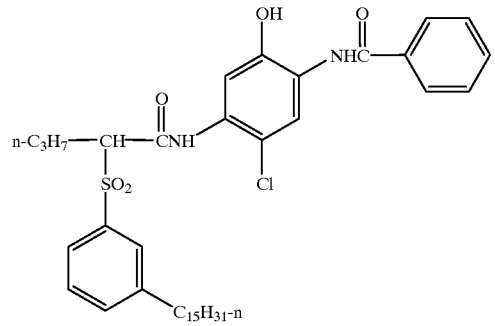

-continued
IC-5
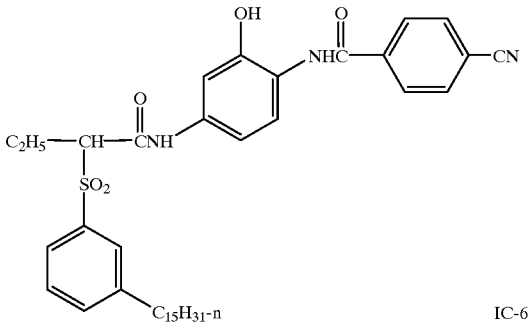
IC-6
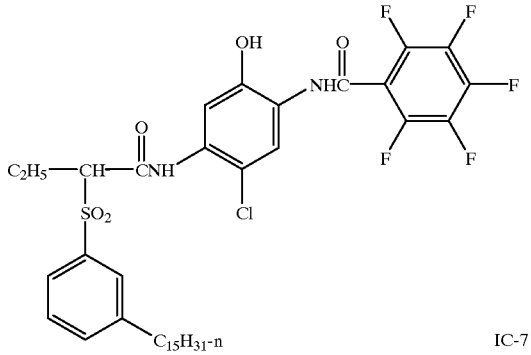
IC-7
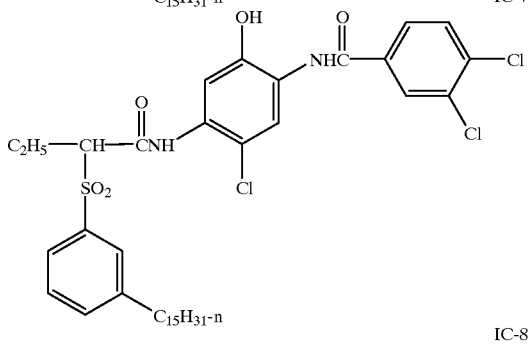
IC-8
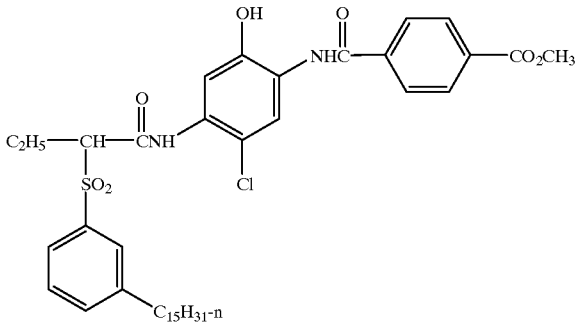
IC-9
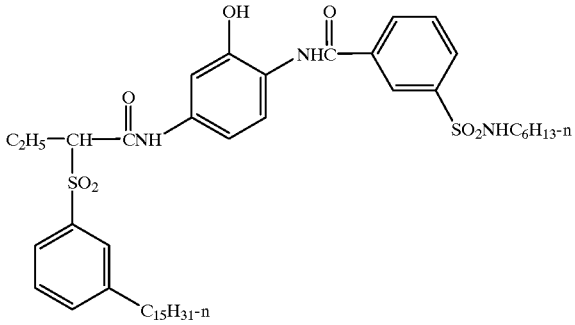
-continued
IC-10
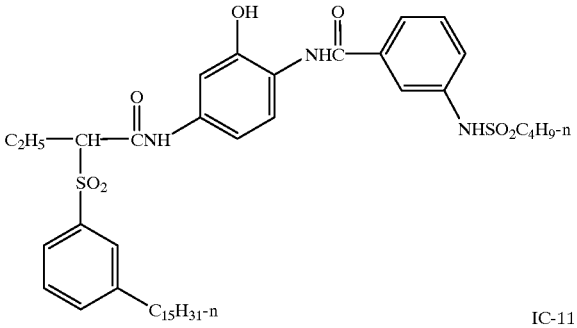
IC-11
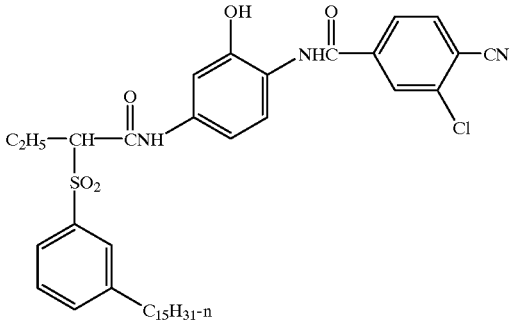
IC-12
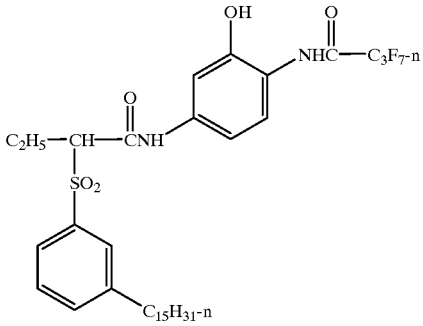
IC-13
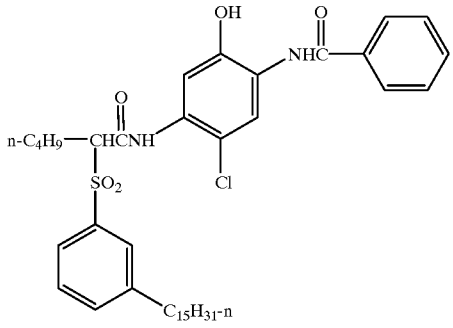
IC-14
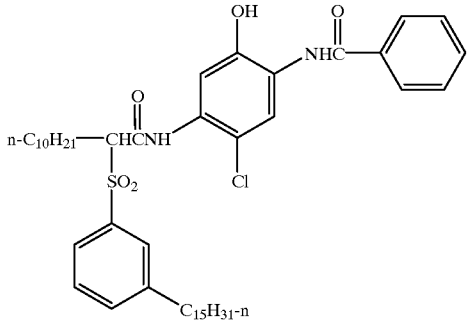

-continued
IC-15
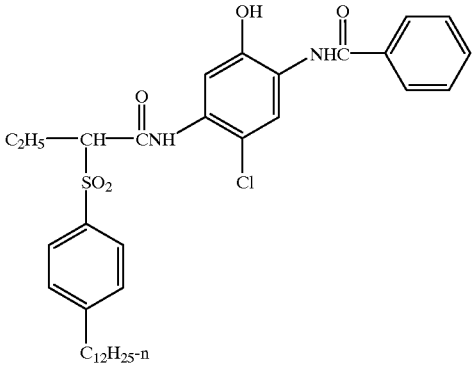
IC-16
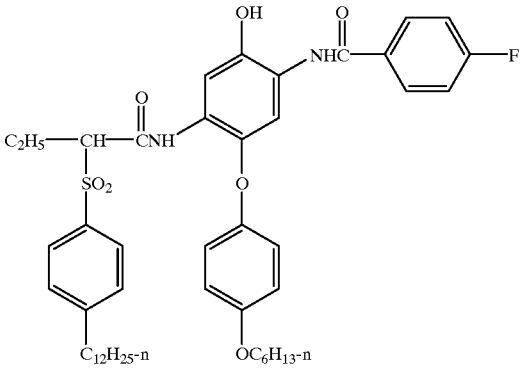
IC-17
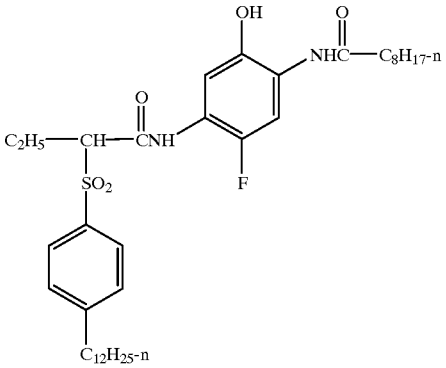
IC-18
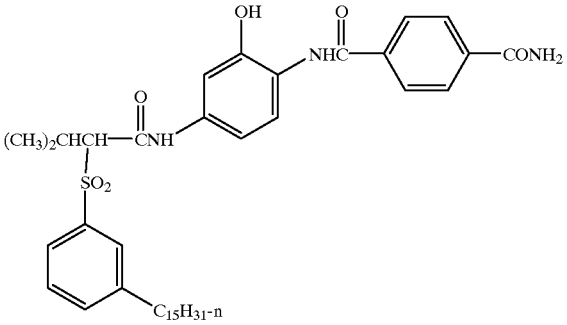
-continued
IC-19
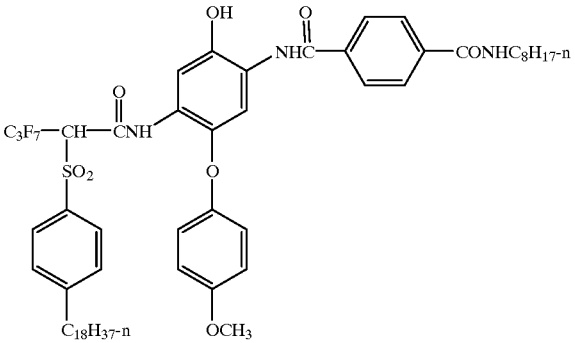
IC-20
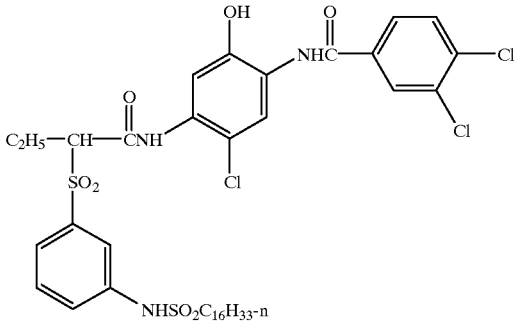
IC-21
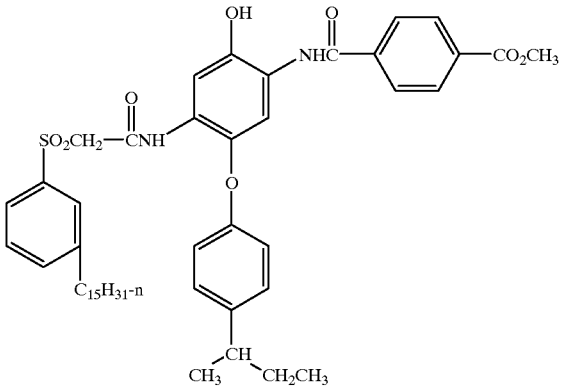
IC-22
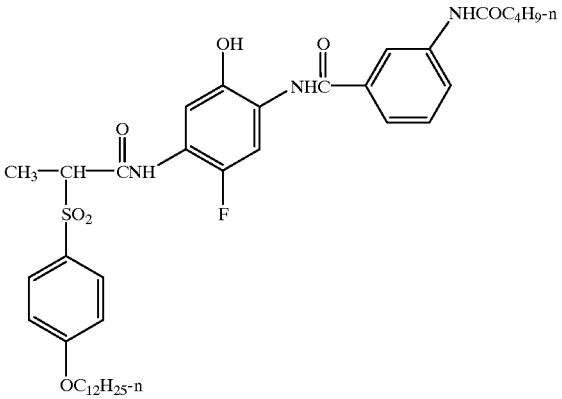

-continued
IC-23
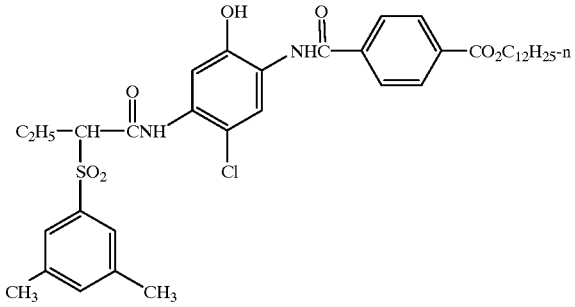
IC-24
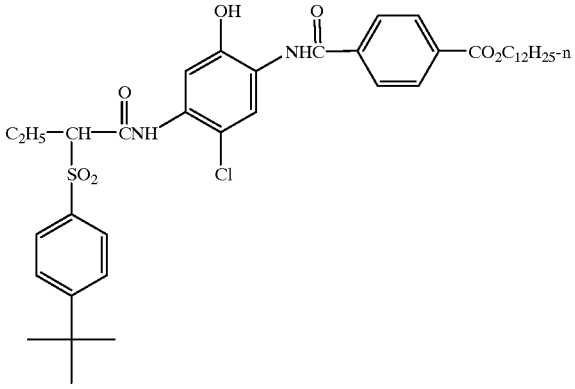
IC-25
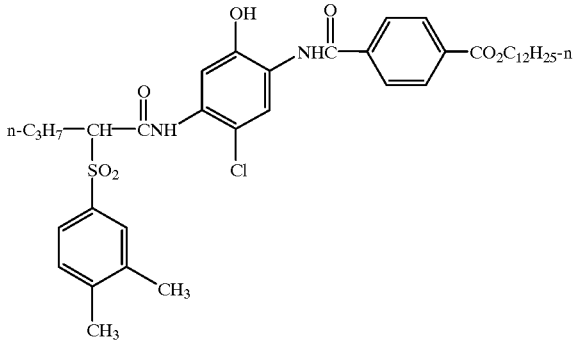
IC-26
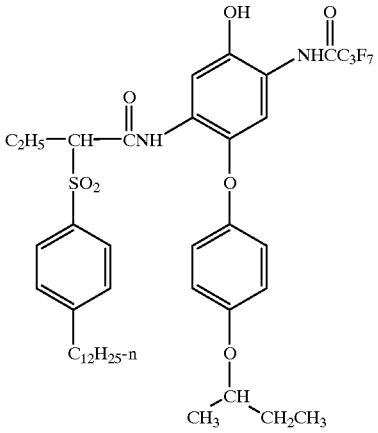
-continued
IC-27
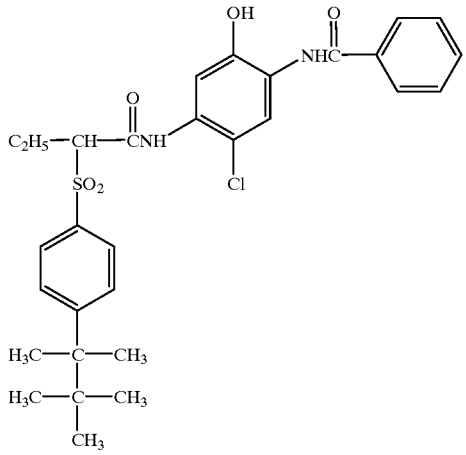
IC-28
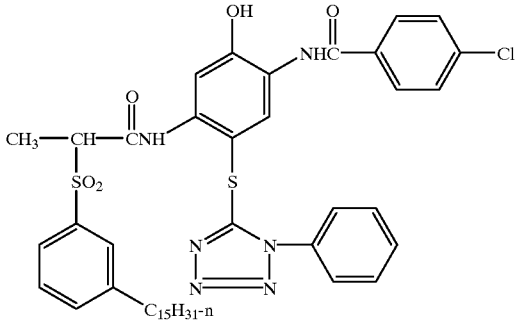
IC-29
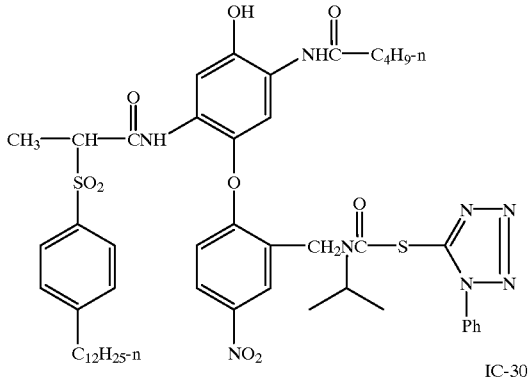
IC-30
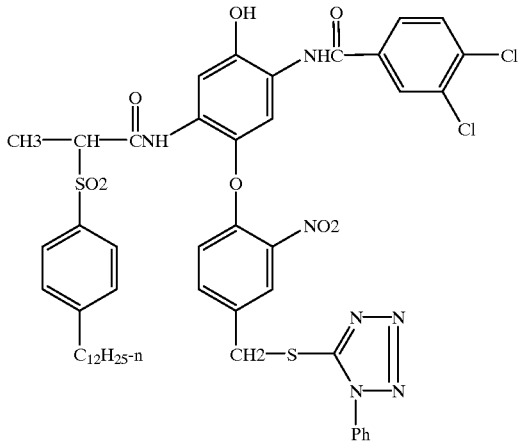

-continued
IC-31
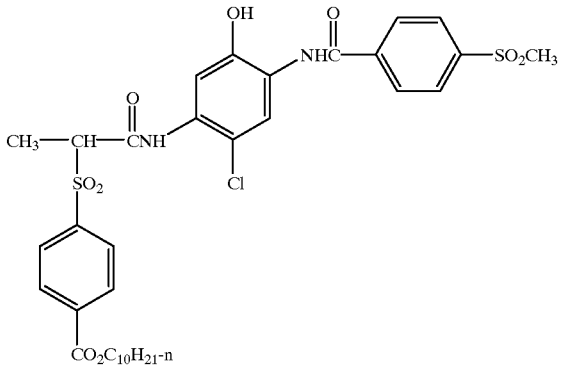
IC-32
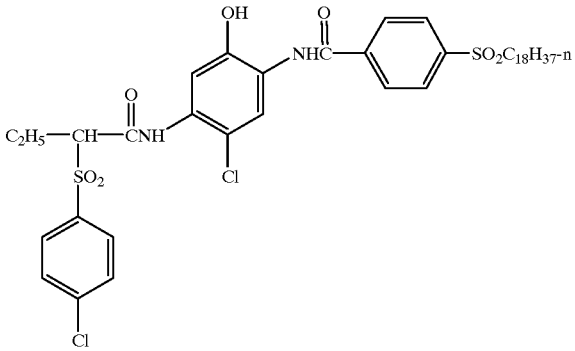
IC-33
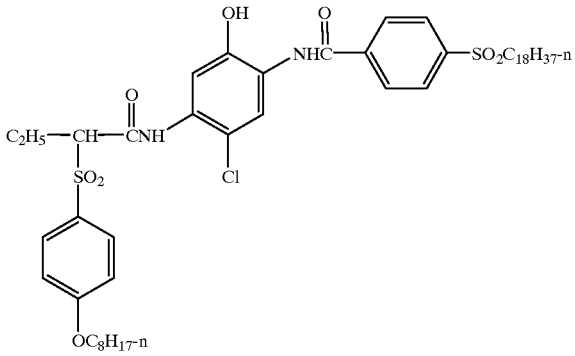
IC-34
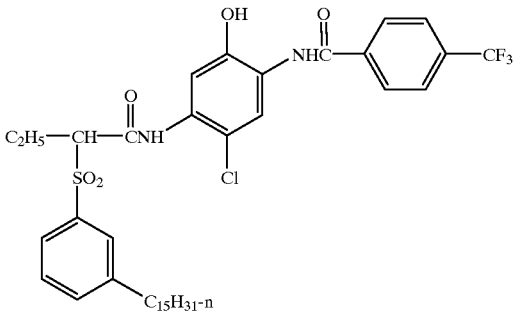
-continued
IC-35
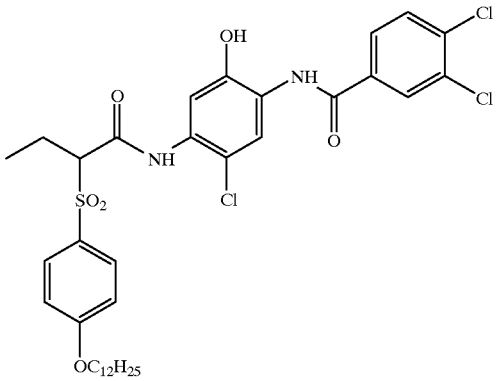
IC-36
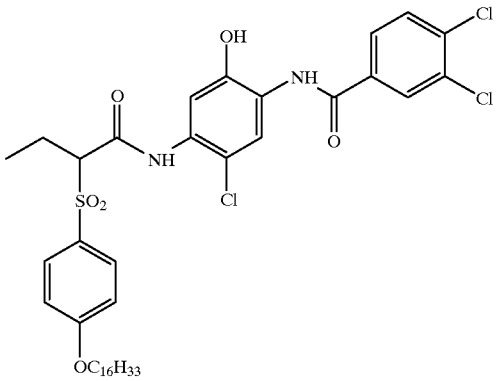
IC-37
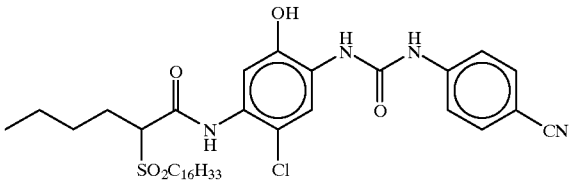
IC-38
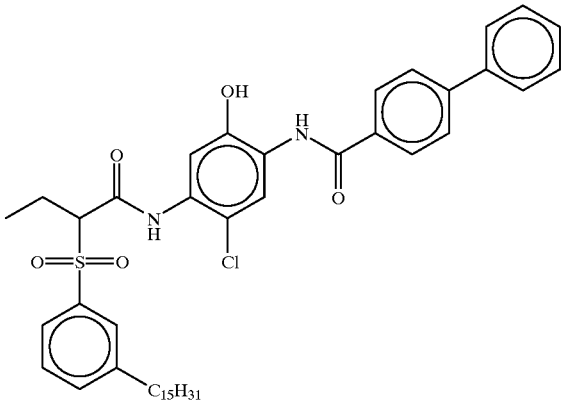

-continued

IC-39

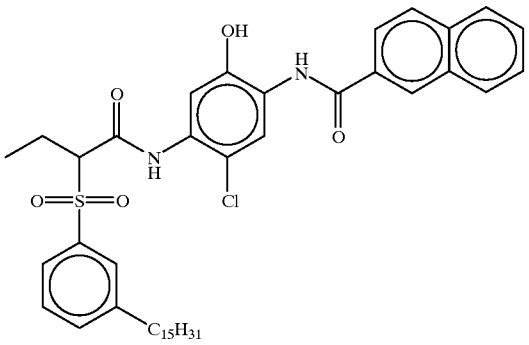

IC-40

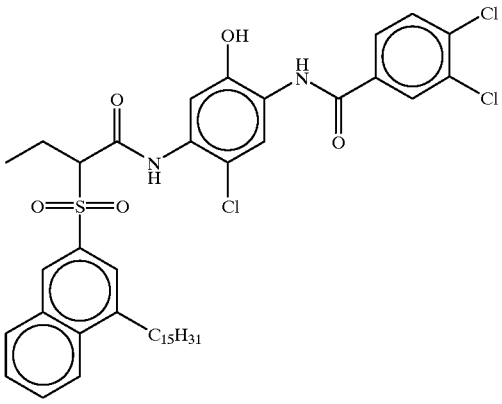

Preferred couplers are IC-3, IC-7, IC-35, and IC-36 because of their suitably narrow left bandwidths.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. Nos. 4,404,274 and 5,238,803.

Typical preferred yellow couplers are represented by the following formulas:

YELLOW-1

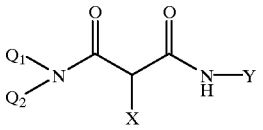

YELLOW-2

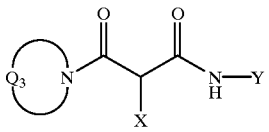

-continued

YELLOW-3

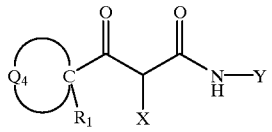

YELLOW-4

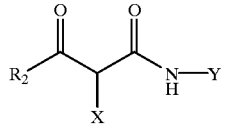

YELLOW-5

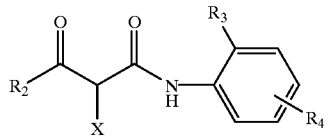

wherein $R_1$, $R_2$, $R_3$, $R_4$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

The most preferred yellow couplers are represented by YELLOW-5, wherein $R_2$ represents a tertiary alkyl group, $R_3$ represents a halogen or an alkoxy substituent, $R_4$ represents a substituent, and X represents a N-heterocyclic coupling-off group because of their good development and desirable color.

Even more preferred are yellow couplers are represented by YELLOW-5, wherein $R_2$, $R_3$ and $R_4$ are as defined above, and X is represented by the following formula:

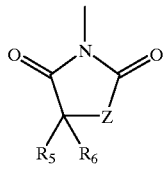

wherein Z is oxygen of nitrogen and $R_5$ and $R_6$ are substituents. Most preferred are yellow couplers wherein Z is oxygen and $R_5$ and $R_6$ are alkyl groups.

Typical yellow couplers that may be used in the inventive photographic element are shown below.

Y-1
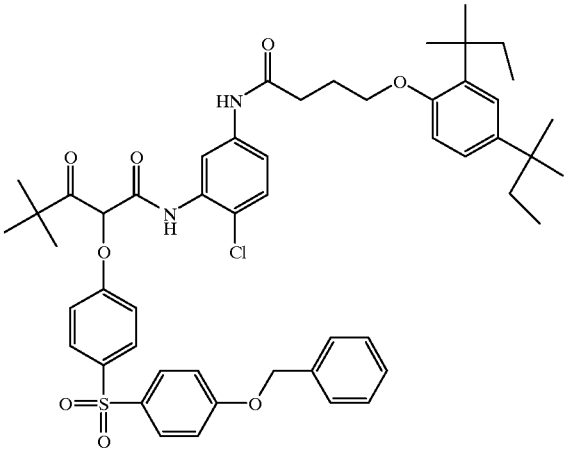
Y-2
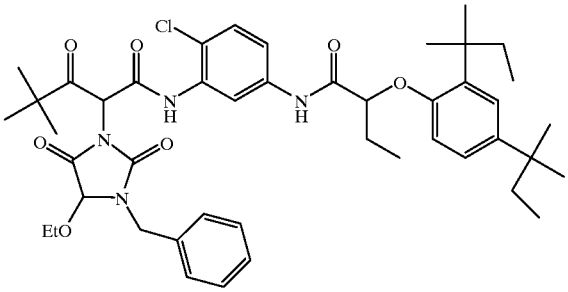
Y-3
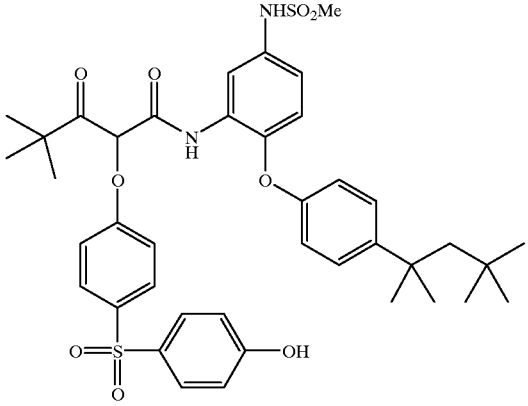
Y-4
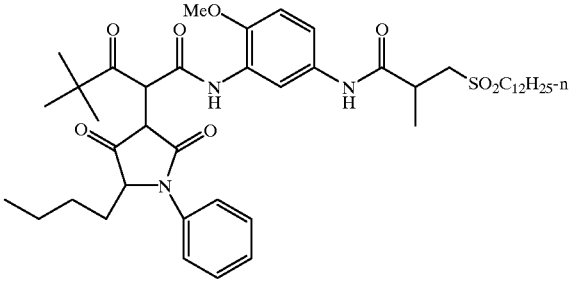
-continued
Y-5
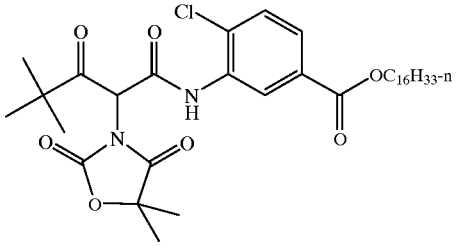
Y-6
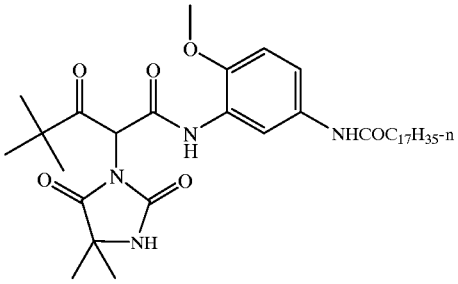
Y-7
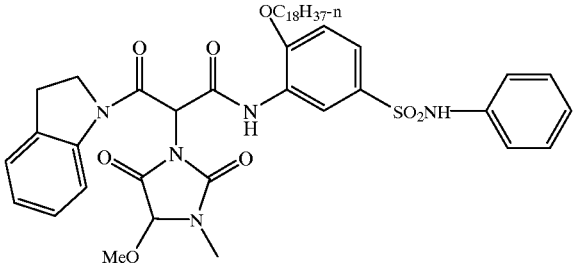
Y-8
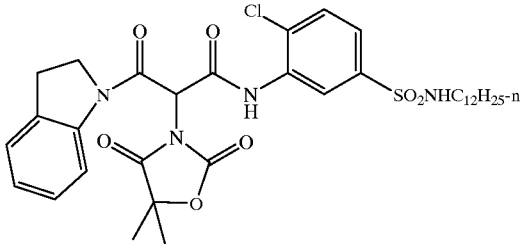
Y-9
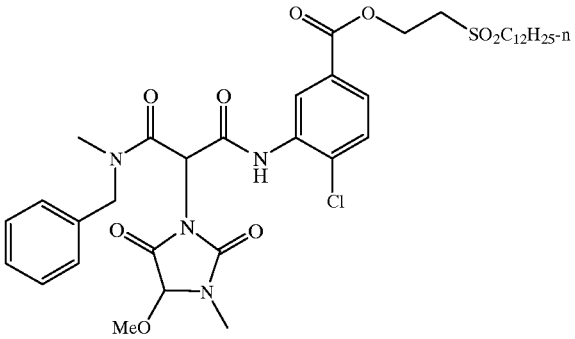

-continued

Y-10

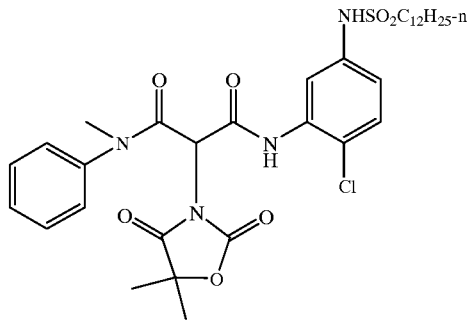

Y-11

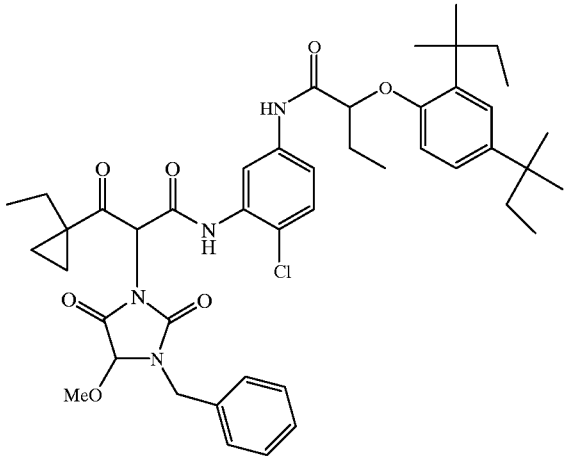

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Polymer containing dispersions of yellow photographic couplers have been employed in color print materials, as described in U.S. Pat. No. 4,857,449. Other methods for preparing polymer-containing dispersions of dye-forming couplers are described in U.S. Pat. Nos. 4,939,077; 4,203,716; and 4,840,885. Commonly, these dispersions are prepared from a solution of a coupler, an optional high-boiling solvent, an oil-soluble but water-insoluble polymer, and a volatile organic solvent, which solution is then emulsified and dispersed in an aqueous solution, often comprising water, a hydrophilic colloid such as gelatin, and a surfactant. Other methods describe the formation of loaded latex polymer dispersions using water-miscible or volatile organic solvent. It is also possible to prepare these materials by forming an loaded polymer latex dispersion, prepared either by high-shear mixing of a liquid oil phase with a latex-containing aqueous solution, or in some cases by combining a dispersion of a photographic coupler that is free of volatile organic solvent with a latex polymer, with sufficient surfactant and sufficient time to cause formation of a loaded latex dispersion. One of the main advantages of polymer-containing dispersions described in the prior art have included image preservation to heat and light, although other advantages in manufacturing processes, physical performance of the photographic element, and sensitometric performance have been reported.

Polymer containing dispersions used in the elements of the invention may be prepared by emulsifying a mixed oil solution comprising polymer and the photographically useful compounds desired in the dispersion, as described in U.S. Pat. Nos. 3,619,195 and 4,857,449.

Polymer-containing dispersions used in the elements of the invention may also be prepared as loaded latex dispersions. These may be prepared according to at least three types of process. The first process, described in, for example, U.S. Pat. No. 4,203,716, involves dissolving the hydrophobic photographically useful compounds to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with sufficient shear to cause loading as described in U.S. Pat. No. 5,594,047, the disclosure of which is hereby incorporated by reference. A third possible way to prepare some loaded latex formulations is to simply combine a polymer latex with a dispersed oil solution, such that the oil solution and latex are miscible, in the presence of surfactant, for a sufficient time before the dispersion is coated for loading to occur as described in U.S. Pat. No. 5,558,980.

Polymers used in the invention are preferably water-insoluble, and sufficiently hydrophobic to be incorporated as components of the hydrophobic dispersed phase of the dispersions used in the elements of the invention. The polymers may be prepared by bulk polymerization or solution polymerization processes. Especially preferred among possible polymerization processes is the free-radical polymerization of vinyl monomers in solution.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydroI yl vinyl ether, etc.);

vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzene, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy)styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc ); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2-aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl) methacrylamide hydrochloride, N-(3-dimethylaminopropyl) methacrylamide hydrochloride, N,N-dipropylacrylamide, N-(1,1-dimethyl-3-oxobutyl)acrylamide, N-(1,1,2-trimethylpropyl)acrylamide, N-(1,1,3,3-tetramethylbutyl) acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl) acrylamide, N-(2-carboxyethyl)acrylamide, 3-acrylamido-3-methylbutanoic acid, methylene bisacrylamide, etc.).

Specific examples of useful polymers and polymer latex materials are given below:

P-1 Poly(N-tert-butylacrylamide)
P-2 Poly(N-cyclohexylamide)
P-3 Poly(N-sec-butylacrylamide)
P-4 Poly(N-(1,1,3,3-tetramethylbutyl)acrylamide)
P-5 Poly(N-(1,1,2-trimethylpropyl)acrylamide)
P-6 Poly(N-(1,1-dimethyl-3-oxobutyl)acrylamide)
P-7 Poly(N-(1-phthalimidomethyl)acrylamide)
P-8 Poly(N,N-di-n-propylacrylamide)
P-9 N-tert-butylacrylamide/2-hydroxyethylmethacrylate copolymer (80/20) (by weight, hereinafter the same)
P-10 N-tert-butylacrylamide/methylene bisacrylamide copolymer (98/2)
P-11 N-cyclohexylacrylamide/methylene bisacrylamide copolymer (98/2)
P-12 1,1-dimethyl-3-oxobutyl)acrylamide/methylene bisacrylamide copolymer (98/2)
P-13 Methyl acrylate/2-acrylamido-2-methylpropane sulfonic acid copolymer (96/4)
P-14 Methyl acrylate/2-acrylamido-2-methylpropane sulfonic acid copolymer (98/2)
P-15 Methyl acrylate/2-acrylamido-2-methylpropane sulfonic acid/2-acetoacetoxyethyl methacrylate copolymer (91/5/4)
P-16 Methyl acrylate/2-acrylamido-2-methylpropane sulfonic acid/ethylene glycol dimethacrylate copolymer (96/2/2)
P-17 Butyl acrylate/2-acrylamido-2-methylpropane sulfonic acid sodium salt/2-acetoacetoxyethyl methacrylate copolymer (90/6/4)
P-18 Butyl acrylate/2-acrylamido-2-methylpropane sulfonic acid/ethylene glycol dimethacrylate copolymer (90/6/4)
P-19 Butyl acrylate/styrene/methacrylamide/2-acrylamido-2-methylpropane sulfonic acid sodium salt copolymer (55/29/11/5)
P-20 Butyl acrylate/styrene/2-acrylamido-2-methylpropane sulfonic acid sodium salt copolymer (85/10/5)
P-31 Poly(methylmethacrylate)
P-32 Glycidyl methacrylate/ethylene glycol dimethacrylate copolymer (95/5)
P-33 Poly(acrylonitrile)
P-34 Acrylonitrile/vinylidene chloride/acrylic acid copolymer (15/79/6)
P-35 Styrene/butyl methacrylate/2-sulfoethyl methacrylate sodium salt copolymer (30/60/10)
P-36 Polystyrene
P-37 Poly(4-acetoxystyrene)
P-38 Poly(4-vinylphenol)
P-39 Poly(4-t-butoxycarbonyloxystyrene)
P-40 2-(2'-Hydroxy-5'-methacrylyloxyethylphenyl)-2H-benzotriazole/ethyl acrylateJ2-acrylamido-2-methylpropane sulfonic acid sodium salt copolymer (74/23/3)
P-41 N-tert-butylacrylamide13-acrylamido-3-methylbutanoic acid copolymer (99.5/0.5)
P-42 N-tert-butylacrylamide/3-acrylamido-3-methylbutanoic acid copolymer (99.0/1.0)
P-43 N-tert-butylacrylamide/3-acrylamido-3-methylbutanoic acid copolymer (98/2)
P-44 N-tert-butylacrylamide/3-acrylamido-3-methylbutanoic acid copolymer (96/4)
P-45 N-tert-butylacrylamide/3-acrylamido-3-methylbutanoic acid copolymer (92/8)
P-46 N-tert-butylacrylamide/methyl acrylate copolymer (25/75)
P-47 N-tert-butylacrylamide/methyl acrylate copolymer (50/50)
P-48 N-tert-butylacrylamide/methyl acrylate copolymer (75/25)
P-49 Poly(methyl acrylate)
P-50 Methyl methacrylate/methyl acrylate copolymer (75/25)
P-51 Methyl methacrylate/methyl acrylate copolymer (50/50)
P-52 Methyl methacrylate/methyl acrylate copolymer (25/75)
P-53 N-tert-butylacrylamide/2-acrylamido-2-methylpropane sulfonic acid sodium salt copolymer (98/2)
P-54 N-tert-butylacrylamide/2-acrylamido-2-methylpropane sulfonic acid sodium salt copolymer (99/1)
P-55 Methyl methacrylate/2-acrylamido-2-methylpropane sulfonic acid sodium salt copolymer (98/2)

P-56 N-tert-butylacrylamide/n-butyl acrylate copolymer (50/50)

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis-(isobutyronitrile), 2,2'-azobis(2-amidinopropane) dihydrochloride, etc.

It is understood throughout this disclosure that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues.

In this invention, the presence of an interlayer containing an anticolor-mixing agent (antistain or oxidized developer scavenger) is preferred. Typically, these scavengers are ballasted to keep them in the layer in which they were coated. The scavengers work by reducing any excess oxidized developer back to the developer form. Anticolor-mixing agents include compounds such as derivatives of hydroquinones (e.g. see U.S. Pat. Nos. 2,336,327; 2,360,290; 2,403,721; 2,701,197; 2,728,659; and 3,700,453) aminophenols, amines, gallic acid, catechol, ascorbic acid, hydrazides (e.g. U.S. Pat. No. 4,923,787), sulfonamidophenols (e.g. U.S. Pat. No. 4,447,523), and non color-forming couplers.

It is also contemplated that the concepts of the discussion may be employed to obtain reflection color prints as described in Research Disclosure, November 1979, Item 18716. The photographic element may contain epoxy solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171, 5,096,805, and 5,126,234. If desired, false sensitization, as described in Hahm in U.S. Pat. No. 4,902,609, can be used to provide added detail in color embodiments.

Due to a desire for rapid development and reduced impact on the environment, preferred emulsions for color display or color print materials having a transparent or paper base of the invention are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum. It is specifically contemplated to use [100] tabular grain silver chloride emulsions, as disclosed in U.S. Pat. No. 5,320,938, in conjunction with elements of the current invention.

Color display elements typically contain less than 2.0 $g/m^2$ of total silver. Due to the need to decrease the environmental impact of color display processing, it is desired to decrease the amount of total silver used in the element as much as possible. Therefore, total silver levels of less than 1.3 $g/m^2$ are preferable, and levels of 1.1 $g/m^2$ are even more preferable. It is possible to reduce further the total silver used in the color photographic element to less than 0.20 $g/m^2$ by use of a so-called development amplification process whereby the incorporated silver is used only to form the latent image, while another oxidant, such as hydrogen peroxide, serves as the primary oxidant to react with the color developer. Such processes are well-known to the art, and are described in, for example, U.S. Pat. No. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. Elements of the invention can be processed by a method such as the RA-4 process of Eastman Kodak Company as is described in the British Journal of photography Annual of 1988, pages 198–199.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. In fact, placing the blue light sensitive layer above the red and green light sensitive layers results in reduced blue light sensitivity in the red light and green light sensitive layers. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development and 2) de-silvering. The de-silvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;

2) color developing→bleaching→fixing→washing/stabilizing;

3) color developing→bleaching→bleach-fixing→washing/stabilizing;

4) color developing→stopping→washing→bleaching→washing→fixing→washing/stabilizing;

5) color developing→bleach-fixing→fixing→washing/stabilizing;

6) color developing→bleaching→bleach-fixing→fixing→washing/stabilizing.

Among the processing steps indicated above, the steps 1), 2) and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(P-hydroxyethyl)aniline sulfate, 4-amino-3-methyl-N-ethyl-N-(O-(methanesulfonamidoethyl)aniline sesquisulfate hydrate, 4-amino-N,N-diethylaniline hydrochloride, 4-amino-3-methyl-N,N-diethylaniline hydrochloride, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, 4-amino-3-methyl-N-ethyl-N-(β-(methanesulfonamidoethyl)aniline sesquisulfate hydrate preferably is used. There may be some instances where the above mentioned color developing agents may be used in combination so that they meet the purposes of the application.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

Table 1 is a diagram of the concept of a conventional, non-integral multilayer color lenticular photographic display product such as *Kodak Duraclear RA Display Film*™ laminated to a lenticular screen.

Table 2 is a diagram of the concept of a conventional, non-integral multilayer color lenticular photographic print product such as *Kodak Durflex RA Print Film*™ laminated to a lenticular screen.

Table 3 is a diagram of an alternate concept of a manufacturing a conventional, non-integral multilayer color lenticular photographic display product such as *Kodak Duraclear RA Display Film*™ laminated to a lenticular screen using 'double-sided adhesive tape'.

Table 4 is a diagram of the concept of a conventional, integral multilayer color lenticular photographic print product such as that previously manufactured by the Eastman Kodak Co.

Table 5 is a diagram of the concept of a conventional, integral multilayer color lenticular photographic display product such as that previously manufactured by the Eastman Kodak Co.

Table 6 is a diagram of the concept of an integral, multilayer color lenticular photographic print product such as that proposed by Howe, in U.S. Pat. No. 3,751,258.

Table 7 is a diagram of the concept of an integral, multilayer color lenticular photographic print product such as that proposed by Shiba in Japanese No. 4,097,345.

Table 8 is a diagram of the concept of an integral, multilayer color lenticular photographic print product such as that proposed by Taguchi in U.S. Pat. Nos. 5,539,487 and 5,850,580.

Table 9 is a diagram of the concept of the inventive integral, multilayer color lenticular photographic print product of this invention.

Table 10 is a diagram of the concept of the inventive integral, multilayer color lenticular photographic display product of this invention.

TABLE 1

| Conventional Non-Integral Lenticular Structure[1] |
|---|
| Overcoat |
| UV absorbing layer |
| Red light sensitive layer |
| UV absorbing layer |
| Green light sensitive layer |
| Interlayer |
| Blue light sensitive layer |
| Clear Planar Support |
| UV absorbing layer |
| With Antihalation Dyes |
| Overcoat |
| Adhesive Layer |
| Lenticular support |

[1]Manufactured by Eastman Kodak Co.

TABLE 2

| Conventional Non-Integral Lenticular Structure[2] |
|---|
| Reflective Support |
| Blue light sensitive layer |
| Interlayer |
| Green light sensitive layer |
| UV absorbing layer |
| Red light sensitive layer |
| UV absorbing layer |
| Overcoat |
| Adhesive Layer |
| Lenticular support |

[2]Manufactured by Eastman Kodak Co

TABLE 3

| Conventional Non-Integral Lenticular Structure[3] |
|---|
| Overcoat |
| Imaging layer support |
| Blue light sensitive layer |
| Interlayer |
| Green light sensitive layer |
| Interlayer |
| Red light sensitive layer |
| Overcoat |
| Adhesive layer |
| Adhesive layer support |
| Adhesive layer |
| Transparent Lenticular Support |

[3]Manufactured by 3D Sign and Design, Inc..

TABLE 4

| Conventional Integral Lenticular Structure[4] |
|---|
| Overcoat |
| Integral Reflective Backlayer |
| ($TiO_2$/gelatin) |
| Gelatin Interlayer |
| Blue light sensitive layer |
| UV absorbing layer |
| Green light sensitive layer |
| UV absorbing layer |
| Red light sensitive layer |
| Transparent Lenticular Support |

[4]Manufactured by Eastman Kodak Co.

TABLE 5

| Conventional Integral Lenticular Structure[5] |
|---|
| Overcoat |
| Blue light sensitive layer |
| UV absorbing layer |
| Green light sensitive layer |
| UV absorbing layer |
| Red light sensitive layer |
| Gelatin Layer |
| Transparent Lenticular Support |

[5]Manufactured by Eastman Kodak Co.

TABLE 6

| Conventional Integral Lenticular Structure[6] |
|---|
| Overcoat |
| Integral Reflective Backlayer |
| ($TiO_2$/gelatin) |
| Gelatin Interlayer |
| Blue light sensitive layer |
| Gelatin Interlayer |
| Red light sensitive layer |
| Gelatin Interlayer |
| Green light sensitive layer |
| UV absorbing layer |
| Transparent Lenticular Support |

[6]Howe, et al, in U.S. Pat. No. 3,751,258

TABLE 7

| Conventional Integral Lenticular Structure[7] |
|---|
| Overcoat + |
| Antihalation Layer |
| Gelatin Interlayer |

TABLE 7-continued

| Conventional Integral Lenticular Structure[7] |
|---|
| Blue light sensitive layer |
| Gelatin Interlayer |
| Red light sensitive layer |
| UV absorbing layer |
| Green light sensitive layer |
| UV absorbing layer |
| Transparent Lenticular Support |

[7]Shiba in JP Pat. No. 4,097,345

TABLE 8

| Conventional Integral Lenticular Structure[8] |
|---|
| Red light sensitive layer |
| Green light sensitive layer |
| Blue light sensitive layer |
| Antihalation layer |
| Lenticular support |

[8]Taguchi et al, in U.S. Pat. No. 5,539,487

TABLE 9

| Inventive Integral Lenticular Structure |
|---|
| Overcoat |
| Red light sensitive layer + UV-light absorber dyes |
| Interlayer |
| Green light sensitive layer |
| Interlayer |
| Blue light sensitive layer |
| Antihalation layer + UV-light absorber dyes |
| Lenticular support |

Photographic Element Examples

COMPARATIVE EXAMPLE #1

Red, green and blue sensitized emulsions used for comparative examples were prepared as those described in U.S. Pat. No. 5,512,103, col. 57, as emulsions 28, 29 and 30 and will not be further described here.

Coupler dispersions were emulsified by methods well known to the art, and the following layers were coated on extruded lenticular PETG support (which was 23 mils thick and having a lenticular pitch of 73 lpi) using the layer arrangement depicted in Table 9. The gelatin layers were hardened with bis(vinylsulfonyl methyl) ether at 2.4% of the total gelatin weight or with bis(vinylsulfonyl methyl) at 2.18% of the total gelatin weight.

The emulsions and dispersions were coated using conventional multilayer coating techniques using the emulsion and coupler coverages given in Tables 1 or 2. The coverages in Table 1 were chosen for those materials destined to be used for making reflection print images, and those materials listed in Table 2 were used for direct, backlit display type viewing. Fundamentally, there is only a significant difference in emulsion and coupler coverage between the two different types of material. In either instance the materials were prepared in the layer order given in Table 9.

INVENTIVE EXAMPLE # 2

Silver chloride emulsions were chemically and spectrally sensitized as is described below.

Blue Sensitive Emulsion (Blue EM-1, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation. At 90% of the grain volume, precipitation was halted and a quantity of potassium iodide was added, equivalent to 0.2M % of the total amount of silver. After addition, the precipitation was completed with the addition of additional silver nitrate and sodium chloride and subsequently followed by a shelling without dopant. The resultant emulsion contained cubic shaped grains of 0.60 $\mu$m in edge length. This emulsion was optimally sensitized by the addition of a colloidal suspension of aurous sulfide and heat ramped up to 60° C. during which time blue sensitizing dye BSD-4, 1-(3-acetamidophenyl)-5-mercaptotetrazole and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant and $K_2IrCl_5$(5-methylthiazole ) dopant was added during the silver halide grain formation for most of the precipitation, followed by a shelling without dopant. The resultant emulsion contained cubic shaped grains of 0.30 $\mu$m in edge length. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1 and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length. In addition, ruthenium hexacyanide dopant and $K_2IrCl_5$(5-methylthiazole) dopant was added during the precipitation process. This emulsion was optimally sensitized by the addition of a colloidal suspension of aurous sulfide followed by a heat ramp, and further additions of i-(3-acetamidophenyl)-5-mercaptotetrazole, iridium dopant, potassium bromide, and red sensitizing dye RSD-1.

Coupler dispersions were emulsified by methods well known to the art, and the following layers were coated on the non-lenticular side of an extruded lenticular PETG support (which was 23 mils thick and having a lenticular pitch of 73 lpi) using the layer arrangement depicted in Table 9. The gelatin layers were hardened with bis(vinylsulfonyl methyl) ether at 2.4% of the total gelatin weight or with bis (vinylsulfonyl methyl) at 2.18% of the total gelatin weight. The composition of the individual layers is given as follows:

TABLE 10

| Composition of the Photographic Element of Table 9 and Used to Prepare Reflective, Integral, Color Photographic Lenticular Prints | g/M$^2$ |
|---|---|
| RL-1: Red Sensitive Layer | |
| Gelatin | 1.46 |
| Red Sensitive Silver (Red EM-1) | 0.317 |
| C-1 | 0.423 |
| Dibutyl phthalate | 0.415 |
| UV-2 | 0.272 |
| 2-(2-butoxyethoxy)ethyl acetate | 0.0347 |
| Di-t-octyl hydroquinone | 0.0035 |
| DYE-3 | 0.0665 |
| GL-1: Green Sensitive Layer | |
| Gelatin | 1.64 |
| Green Sensitive Silver | 0.129 |
| M-2 | 0.317 |
| Dibutyl phthalate | 0.113 |
| DUP | 0.0483 |
| ST-8 | 0.242 |
| ST-21 | 0.0854 |
| ST-22 | 0.806 |
| 1-Phenyl-5-mercaptotetrazole | 0.0001 |
| DYE-2 | 0.0602 |
| BL-1: Blue Sensitive Layer | |
| Gelatin | 1.65 |
| Blue Sensitive Silver (Blue EM-1) | 0.280 |
| Y-5 | 0.482 |
| P-1 | 0.482 |
| Dibutyl phthalate | 0.218 |
| 1-Phenyl-5-mercaptotetrazole | 0.0001 |
| DYE-1 | 0.009 |
| IL: Interlayer | 0.75 |
| Gelatin | 0.108 |
| Di-t-octyl hydroquinone | 0.308 |
| Dibutyl phthalate | 0.0129 |

TABLE 10-continued

| Composition of the Photographic Element of Table 9 and Used to Prepare Reflective, Integral, Color Photographic Lenticular Prints | g/M$^2$ |
|---|---|
| Disodium 4,5 Dihydroxy-m-benzenedisulfonate | 0.0495 |
| SF-1 | 0.0323 |
| Irganox 1076 ™ | 0.462 |
| AHU: Antihalation Underlayer | |
| Gelatin | 1.29 |
| Silver | 0.151 |
| Versa TL-502 | 0.0311 |
| UV-1 | 0.366 |
| UV-2 | 0.0646 |
| Di-t-octyl hydroquinone | 0.118 |
| Dibutyl phthalate | 0.359 |
| 1,4-Cyclohexylenedimethylene bis(2-ethylhexanoate) | 0.0717 |
| S-1: Simultaneous Overcoat | |
| Gelatin | 0.645 |
| Dow Corning DC200 | 0.0202 |
| Ludox AM | 0.1614 |
| Di-t-octyl hydroquinone | 0.013 |
| Dibutyl phthalate | 0.039 |
| SF-1 | 0.009 |
| SF-2 | 0.004 |

TABLE 11

| Composition of the Photographic Element of TABLE 9 and Used to Prepare Backlit Display, Integral, Color Photographic Lenticular Prints | g/M$^2$ |
|---|---|
| RL-1: Red Sensitive Layer | |
| Gelatin | 3.58 |
| Red Sensitive Silver (Red EM-1) | 0.953 |
| C-1 | 0.861 |
| Dibutyl phthalate | 0.847 |
| UV-2 | 0.555 |
| 2-(2-butoxyethoxy)ethyl acetate | 0.0708 |
| Di-t-octyl hydroquinone | 0.0071 |
| DYE-3 | 0.0665 |
| GL-1: Green Sensitive Layer | |
| Gelatin | 3.47 |
| Green Sensitive Silver | 0.323 |
| M-2 | 0.532 |
| Dibutyl phthalate | 0.191 |
| DUP | 0.0816 |
| ST-8 | 0.409 |
| ST-21 | 0.144 |
| ST-22 | 1.362 |
| 1-Phenyl-5-mercaptotetrazole | 0.0002 |
| DYE-2 | 0.0602 |
| BL-1: Blue Sensitive Layer | |
| Gelatin | 3.60 |
| Blue Sensitive Silver (Blue EM-1) | 0.581 |

TABLE 11-continued

| Composition of the Photographic Element of TABLE 9 and Used to Prepare Backlit Display, Integral, Color Photographic Lenticular Prints | |
|---|---|
| Y-5 | 1.13 |
| P-1 | 1.13 |
| Dibutyl phthalate | 0.510 |
| 1-Phenyl-5-mercaptotetrazole | 0.0002 |
| DYE-1 | 0.009 |
| IL: Interlayer | 0.75 |
| Gelatin | 0.108 |
| Di-t-octyl hydroquinone | 0.308 |
| Dibutyl phthalate | 0.0129 |
| Disodium 4,5 Dihydroxy-m-benzenedisulfonate | 0.0495 |
| SF-1 | 0.0323 |
| Irganox 1076 ™ | 0.462 |
| AHU: Antihalation Underlayer | |
| Gelatin | 1.29 |
| Silver | 0.151 |
| Versa TL-502 | 0.0311 |
| UV-1 | 0.366 |
| UV-2 | 0.0646 |
| Di-t-octyl hydroquinone | 0.118 |
| Dibutyl phthalate | 0.359 |
| 1,4-Cyclohexylenedimethylene bis(2-ethylhexanoate) | 0.0717 |
| S-1: Simultaneous Overcoat | |
| Gelatin | 0.645 |
| Dow Corning DC200 | 0.0202 |
| Ludox AM | 0.1614 |
| Di-t-octyl hydroquinone | 0.013 |
| Dibutyl phthalate | 0.039 |
| SF-1 | 0.009 |
| SF-2 | 0.004 |

Structures

BSD-4

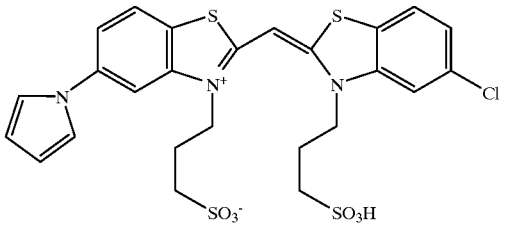

GSD-1

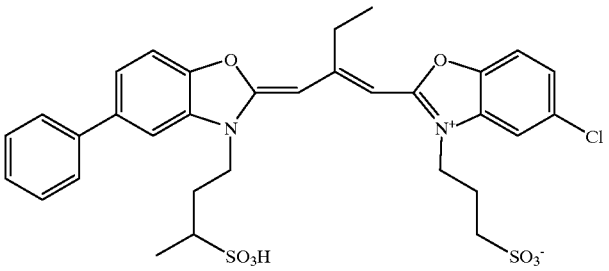

RSD-1

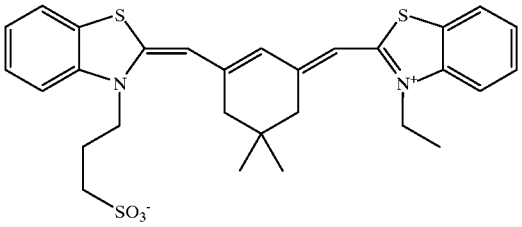

TABLE 11-continued
Composition of the Photographic Element of TABLE 9 and Used to Prepare Backlit Display, Integral, Color Photographic Lenticular Prints
Y-1
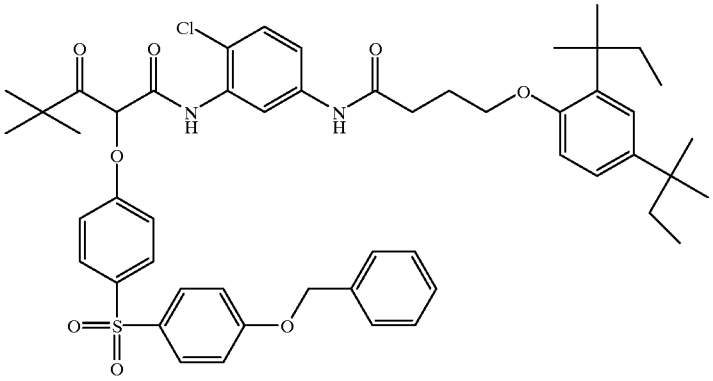
M-2
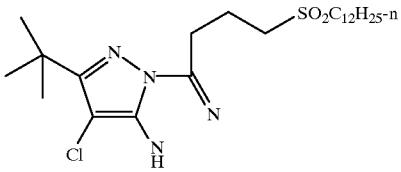
C-1
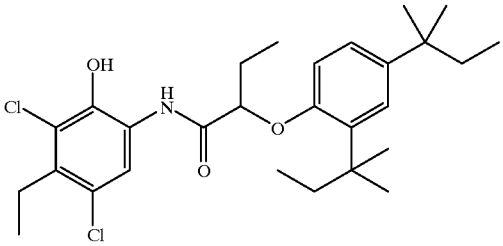
ST-6
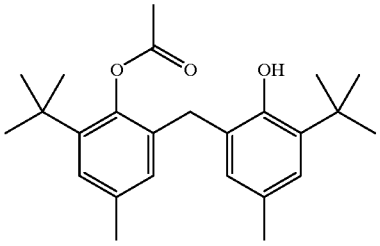
ST-8
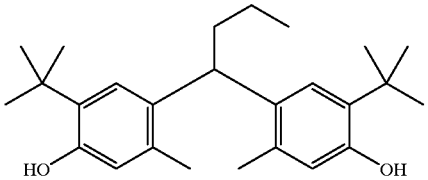
ST-16
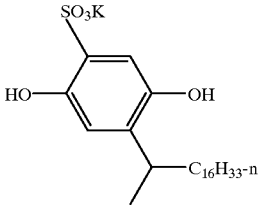

TABLE 11-continued
Composition of the Photographic Element of TABLE 9 and Used to Prepare Backlit Display, Integral, Color Photographic Lenticular Prints
ST-21
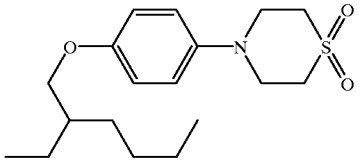
ST-22
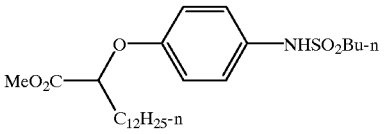
DYE-1
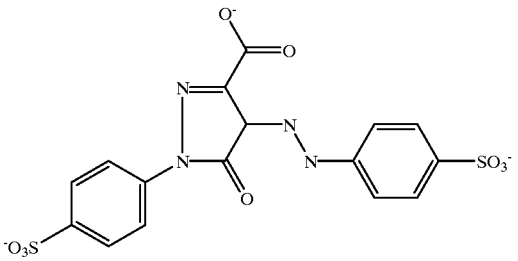
DYE-2
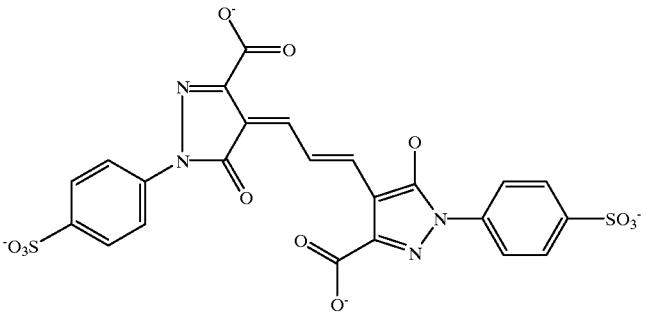
DYE-3
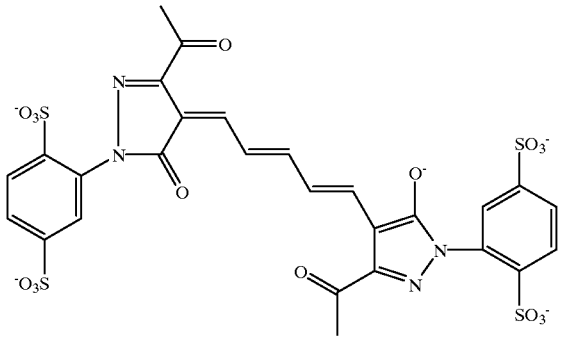
UV-1
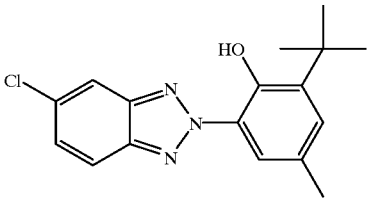

TABLE 11-continued

Composition of the Photographic Element of TABLE 9 and Used to Prepare Backlit Display, Integral, Color Photographic Lenticular Prints

UV-2

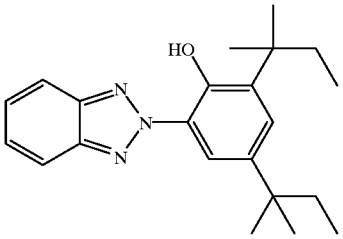

SF-1

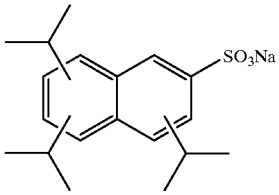

$CF_3(CF_2)_7SO_3Na$ SF-2

SF-12

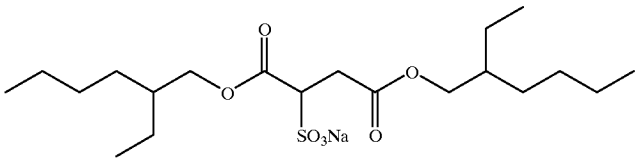

Once the materials had been prepared, they were evaluated as follows:

To make the optical exposures, the multilayer samples were placed in a Kodak Model 1B sensitometer and exposed to 3000° K. light filtered with a Kodak Wratten™ filter 2C, plus Wratten™ filter 98 to obtain the characteristic response of the blue record, or a Wratten™ filter 99 to obtain the characteristic response of the green record, or a WrattenT filter 70 to obtain the characteristic response of the red record. Exposure time was adjusted to 10 seconds and where required, neutral density filters were added to compensate for the amount of exposure. The exposures were performed by contacting the emulsion side of integral lenticular image material to a step wedge exposure tablet having a neutral density step exposure range of 0 to 3 log E in incremental steps of 0.15 log E.

The design and application of digital scanning film writers employing lasers or LED's have been described elsewhere (i.e., Taguchi et al in U.S. Pat. No. 5,539,487).

To make the scanning exposures, the samples were placed in a Kodak built digital film writer, using individually multiplexed lasers having the following spectral output characteristics: red laser output at 685 nm; green laser output at 532 nm; blue laser output at 473 nm. The exposure time of this device was designed to be $1\times10_{-6}$ sec. Since the power levels of each of the laser exposing units is different, they must first be calibrated and a lookup table (LUT) generated. These LUT's result in a 2 dimensional array whereby Status A output density from the sensitized media is plotted vs. an 8-bit code value (i.e., 0 to 255). The 8-bit code value is directly related to the output power of the laser and is obtained by additional calibration to relate the output power of the laser to the response of the media. To insure that the Dmax of each material was achieved, the laser exposing device was calibrated in way that the maximum power of the laser was achieved at the highest code value (i.e., 255). A red, green, and blue exposure tablet was generated electronically in a computer so to produce individual color exposures onto the sensitized media, effectively resulting in a 0 to 3 log E exposure so that comparisons with the optical exposures might be made directly.

A second, scanning exposing device was also constructed so that the exposing time might be reduced to $4.4\times10^{-8}$ sec. This device is based upon a set of lasers using slightly different output wavelengths of: red Laser output at 685 tm; green Laser output at 532 nm; blue Laser output at 458 mn. Beam spot size was 10$\mu$ in the slow scan direction and 110$\mu$ in the fast scan direction. This machine was also individually calibrated to obtain LUT's suitable for generating 0 to 3 log E exposures in the same manner as the previous device.

After the samples were exposed, they were processed in the *Kodak Ektacolor RA T™ Color Development Process*. Samples of material such as that described by the compositions given in Table 11, which are designed to be made into reflection print materials, were processed using the conventional developer cycle times used for color paper prints, i.e., 45 seconds of development. Samples of material such as that described by the compositions given in Table 11, which are designed to be made into direct viewing, backlit, display print materials, were processed using the conventional developer cycle times used for color display prints, i.e., 110 seconds of development. The longer development cycle time is required to develop the higher silver coverages required to produce the higher dye densities required for direct transmission viewing.

After processing, the characteristic curves of each sample was determined, by measuring the individual Status A densities at each exposure step using a commercially available densitometer such as that manufactured by the X-rite Co. To simplify the comparative analysis, the Dmax (maximum density) of each sample was also determined and used for fuirther comparison.

The Dmax values for these samples of materials destined for use as color reflection prints may seem low. This is not the case, however, as they are destined to have a reflective, back laminate applied to the non-lenticular emulsion surface after processing. Examples of such processes are described elsewhere (cf. Morton, in U.S. Pat. No. 5,639,580, and Kistner, in U.S. Pat. No. 5,013,621). The effect of adding the reflective backlayer is to roughly double the density of the transmissive element through what is known as the transmission to reflection transform. This phenomena are well known to those skilled in the art and have been studied by Williams and Clapper whose work is summarized in "The Theory of the Photographic Process", $4^{th}$ Edition, edited by T. H. James, page 527.

Table 12 below illustrates the response of the comparative material if only the emulsion coverage is increased in an attempt to increase the Dmax of the element to make it suitable for both optical and scan printing. With a substantial increase in emulsion coverage in each color record of +45%, the change in the Dmax of the element is clearly noted for both the optical and the scanning exposures. However, the Dmax difference between the optical and scanning exposures remains large, especially the Dmax's of the red and green sensitized emulsions. Additionally, increasing the emulsion coverage by +45% is impractical from a variety of considerations, including additional manufacturing cost, impact upon the color development process including development time, bleach-fix time, wash time, etc. and upon the environmental ecology of the photographic system.

The data given in Table 13 illustrate the same problem when the comparative element is intended for use as a transmissive, backlit display print material. Increasing silver coverage does increase Dmax, but does not compensate for the shortened exposure time required by the scanning printing system. Also note that the Dmax values given in Table 13 were obtained from the second scanning exposing device which has an even shorter exposure time. Further shortening the exposing time further aggravates the problem, especially in the red and green sensitive records.

TABLE 12

Effect of Increasing Emulsion Coverage to Compensate for Reciprocity Failure in a Reflection Print Format

| Material/ | Dmax Resulting from a $1 \times 10^{-6}$ sec Exposure | | | Dmax Resulting from a 10 sec Exposure | | | Difference in Dmax ($1 \times 10^{-6}$ sec - 10 sec Exposure) | | |
|---|---|---|---|---|---|---|---|---|---|
| Color | Red | Grn | Blue | Red | Grn | Blue | Red | Grn | Blue |
| Emulsions from Example #1 | 0.74 | 0.83 | 0.95 | 1.30 | 1.48 | 1.20 | −0.56 | −0.65 | −0.25 |
| Increase emulsion coverage +45% | 1.04 | 1.20 | 1.21 | 1.72 | 2.04 | 1.31 | −0.27 | −0.84 | −0.10 |
| Increase in Dmax | +0.30 | +0.37 | +0.26 | +0.42 | +0.56 | +0.11 | | | |

TABLE 13

Effect of Increasing Emulsion Coverage to Compensate for Reciprocity Failure in a Display Print Format

| Material/ | Dmax Resulting from a $4.4 \times 10^{-8}$ sec Exposure | | | Dmax Resulting from a 10 sec Exposure | | | Difference in Dmax ($4.4 \times 10^{-8}$ sec - 10 sec Exposure) | | |
|---|---|---|---|---|---|---|---|---|---|
| Color | Red | Grn | Blue | Red | Grn | Blue | Red | Grn | Blue |
| Emulsions from Example #1 | 2.82 | 1.78 | 2.40 | 3.44 | 2.86 | 2.77 | −0.62 | −1.08 | −0.37 |
| Increase emulsion coverage +45% | 3.22 | 2.10 | 2.69 | 3.71 | 3.15 | 2.90 | −0.49 | −1.05 | −0.21 |
| Increase in Dmax | +0.40 | +0.32 | +0.29 | +0.27 | +0.29 | +0.13 | | | |
| Dmax of Increased Emulsion Coverage Compared to Optical Exposure of Example #1 | −0.22 | −0.76 | −0.08 | | | | | | |

The data given in Table 14 show the effect of the combination of adding the reciprocity enhancing dopant in the inventive example and increase the emulsion coverage by only 15%. The dopant significantly reduces the difference in Dmax between the optical and scanning exposures and a modest increase in emulsion coverage meets the imaging system requirements by raising the Dmax of the inventive element in the scanning exposure mode to that of the comparative element using optical exposure.

TABLE 14

Effect of Adding a Reciprocity Enhancing Dopant and Also Increasing Emulsion Coverage in a Reflection Print Format

| Material/ | Dmax Resulting from from a $4.4 \times 10^{-8}$ sec Exposure | | | Dmax Resulting from a 10 sec Exposure | | | Difference in Dmax ($4.4 \times 10^{-8}$ sec - 10 sec Exposure) | | |
|---|---|---|---|---|---|---|---|---|---|
| Color | Red | Grn | Blue | Red | Grn | Blue | Red | Grn | Blue |
| Emulsions from Example #1 | 0.83 | 0.92 | 1.06 | 1.31 | 1.49 | 1.23 | −0.48 | −0.57 | −0.17 |
| Emulsions from Example #2 | 1.14 | 1.06 | 0.99 | 1.34 | 1.32 | 1.22 | −0.20 | −0.26 | −0.23 |
| Increase emulsion coverage +15% | 1.38 | 1.22 | 1.13 | 1.54 | 1.44 | 1.28 | −0.16 | −0.22 | −0.15 |
| Dmax of Example #2 Compared to Optical Exposure of Example #1 | +0.07 | −0.01 | −0.10 | | | | | | |

An important consideration when designing photographic elements for both scanning and optical exposing devices is the sharpness of the resultant image. Well known in the art is the use of grey silver in an antihalation layer to enhance sharpness. Enhancing the sharpness of an integral, lenticular color photographic element is especially desirable, since it is highly undesirable for the exposing light, whether it be from a scanning exposing device or an optical exposing device, to enter into the lenticular support, where by light-piping, the light may emerge at a distance far from the point of exposure creating halation. This phenomena is more true of sensitized lenticular media than planar supports because of the half-conical nature of the lenticular lens.

The use of scanning exposing devices in combination with integral lenticular sensitized media compounds the sharpness dilemma, since the scanning beam itself is quite small, being on the order of approximately 10$\mu$ in width in the slow scan direction and 110$\mu$ in length in the fast scan direction. Since the scanning beam is modulated to expose lines of image information and each line may represent different images, then the adjacent images must necessarily be resolved by the element, else they merge into a non-recognizable image due to poor system sharpness of the photographic element. It is often the instance where adjacent lines of images are radically different in composition and or density, i.e.: dark text on a light background. The physical dimension of the lenticule, in combination with the width of the scanning exposing beam and the sharpness of the element determine the possible number of different, recognizable images which can be written under a lenticule.

For example, if the lenticular pitch of the support is 200 lpi (7,874 lenticule per meter, 1 pm), then the width of the individual lenticule is 0.005 inches ($12.7 \times 10^{-5}$ meters). If the width of scanning exposing beam in the slow scan direction is 10$\mu$, or 0.0004 inches, then the lenticular element is capable of writing 12 images/lenticule. Analogously, if the pitch is reduced to 73, then up to 34 distinct images may be written and if the pitch is further reduced to 50 lpi (1.968 1 pm), then 50 images may be written under each lenticule.

Increasing the number of distinct views is a goal of the photographic system as the amount of information which can be stored is proportional to the number of images. While all the systems described above could accommodate images of a "stereo pair", the desire is to produce a system whereby images which contain motion and more specifically as much motion as possible, yet maintaining the uniqueness of each image is highly desirable. A lenticular image containing only 12 or fewer views may reproduce, for example, only 2 seconds of video or ½ second of motion picture film. Analogously, a lenticular element having a system resolution capable of recording 50 images, might reproduce 4 to 8 seconds of video or up to 2,seconds of motion picture film.

The measurement of sharpness of a photographic element is difficult, but the methods are well known and techniques for its determination are well characterized. A complete description of sharpness in a photographic element is given by M. Kriss in "The Theory of the Photographic Process", $4^{th}$ Edition, edited by T. H. James, Chapter 21, "Image Structure". In conventional photographic systems, the modulation transfer function, or MTF, of each of the imaging components is characterized, then cascaded together to estimate the overall system MTF. In the case of the optical printing systems such as that described by Slater (Slater et al in U.S. Pat. No. 5,822,038), described herein, we calculate the MTF for the film writer, the negative, the contact printer, the lenticular lens, and the photographic element coated upon the lenticular support. For scanning exposing systems, we delete the film writer, the negative, and the contact printer, substituting the MTF of the digital scanning writer in its place. As discussed earlier, the MTF of the lenticular lens is limited by spherical aberration and coma.

The sensitized material coated on the lenticular support is limited in MTF response by several factors dominated by light scatter phenomena. Light scatter degrades sharpness in the element in proportion to its overall thickness, the size, shape and halide content of the emulsion grains, the amount of inter-grain absorber dye used to absorb scattered light and the presence and design constructs of the antihalation layer. (This assumes that in a direct viewing print material, that image modifying chemistry to influence sharpness via inter-image effects are not employed.) Anti-halation layers in print materials are not unknown (Morton, in U.S. Pat. No. 5,689, 372 and Morton, in European Patent Application EP 0 780 728 A1, but also are not commonly included for a variety of reasons, including that they are difficult to remove either by direct washing such as when rem-jet material is used or by bleaching or bleach-fixing if grey silver or solid particle dye dispersions are employed.

Since the determination of the MTF of the photographic elements described herein are difficult at best, they are even more so, if they are combined onto a lenticular support. In these instances, it is best to characterize the MTF of the lenticular support and the MTF of the characteristics of the photographic element coated on a planar support separately and then combine them. For this reason, the elements described in examples 1 and 2 were coated on both lenticular and planar supports (7 mil Estar polyester). The MTF measurements reported below are from examples prepared on the planar support. The information given in Table 15 describes the results of changing the amount of grey silver contained in the antihalation layer for the element which is destined to become an integral, reflective lenticular print.

The measurement of the MTF of an element requires the determination of the response of the element at a variety of frequencies. In most photographic systems where some degree of magnification of the negative is involved, the range of frequencies measured is typically between I and 160 cycles per mm. For direct viewing photographic prints, the usual range of frequencies is much lower, i.e., 0.5 to 40 cycles/mm, as there is no magnification involved and the MTF of the human eye declines dramatically past 10 cycles/mm. For complex systems like lenticular imaging systems, if scanning exposing devices are used to expose the image and the image spot size is 10$\mu$, then the writing pitch is 0.01 mm and the corresponding frequency is 50 c/mm. We found it convenient to measure the response of these systems at 30 c/mm. The example in given in Table 15 clearly shows the dramatic impact of including the grey silver in the antihalation layer, as the MTF enhancement afforded by its presence ranged from +8% in the red record to +17% in the blue record.

The information in Table 16 shows the effect of a series of grey silver levels in the antihalation layer of the element designed to become a direct viewing display print. Because of the additional amounts of emulsion and dispersions in the element, the thickness is increased and, hence, the sharpness as manifested by the MTF response is correspondingly decreased. However, the effect of the grey silver level upon MTF is clearly evident and similar to the response of the elements response given in Table 15.

TABLE 15

Effect of Grey Gel Level in the Antihalation Layer of Inventive Example #2 on Sharpness for a Reflection Print Element

| | % MTF @ 30 c/mm Grey Silver Level | | |
|---|---|---|---|
| Color | 0.0 mg/M$^2$ | 0.151 mg/M$^2$ | Change in % MTF |
| Red | 67% | 75% | +8% |
| Green | 55% | 66% | +11% |
| Blue | 45% | 62% | +17% |

TABLE 16

Effect of Grey Gel Level in the Antihalation Layer of Inventive Example #2 on Sharpness for a Display Print Element

| | % MTF @ 30 c/mm | | | Δ% MTF @ 30 c/mm | | |
|---|---|---|---|---|---|---|
| mg Grey Silver/M$^2$ | Red | Green | Blue | Red | Green | Blue |
| 0.0 | 58% | 62% | 25% | — | — | — |
| 0.075 | 64% | 65% | 33% | +6% | +3% | +8% |
| 0.151 | 64% | 68% | 35% | +6% | +6% | +10% |
| 0.226 | 66% | 66% | 36% | +8% | +4% | +11% |

The invention has been described in detail with particular reference to certain preferred embodiments thereof, but it will be understood that variations and modifications can be effected within the spirit and scope of the invention.

What is claimed is:

1. A method of recording multiple images by providing a color photographic element comprising a transparent lenticular support;

a first applied subbing layer on the non-lenticular side of said support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support.

2. The method of claim 1 wherein said magenta dye forming coupler comprises Magenta-1

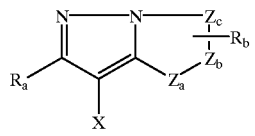

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

3. The method of claim 1 wherein the yellow dye forming coupler comprises Yellow-5

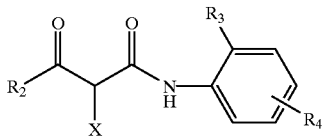

wherein $R_2$ represents a tertiary alkyl group, $R_3$ represents a halogen or an alkoxy substituent, $R_4$ represents a substituent, and X represents a N-heterocyclic coupling-off group.

4. The method of claim 1 wherein the cyan dye forming coupler comprises formula (IA)

(IA)

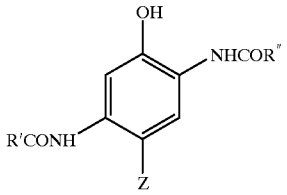

wherein

R' and R" are substituents selected such that the coupler forms image dyes having very sharp-cutting dye hues on the short wavelength side of the absorption curves with absorption maxima ($\lambda_{max}$) which are shifted hypsochromically and are in the range of 620–645 nm; and Z is a hydrogen atom or a group which can be split off by the reaction of the coupler with an oxidized color developing agent.

5. The method of claim 1 wherein the iridium dopant of the cyan or magenta emulsion is an organo-metallic complex.

6. The method of claim 1 wherein the cyan or magenta emulsion contains a ruthenium complex.

7. The method of claim 1 wherein at least one of the cyan, magenta, or yellow emulsions contains an osmium complex.

8. The method of claim 1 wherein the emulsions are sensitized with a gold complex.

9. The method of claim 1 wherein at least one of the cyan, magenta, or yellow emulsions contains less than 1.0 mole percent iodide.

10. The method of claim 1 wherein the antihalation layer is comprised of finely divided silver.

11. The method of claim 1 wherein the antihalation layer is comprised of a solid particle dye or mixture of solid particle dye dispersions.

12. The method of claim 1 wherein the color developer utilized in developing does not contain benzyl alcohol.

13. The method of claim 1 wherein the developed image is a lenticular image of a sequence of images which when viewed appear as a stereoscopic image.

14. The method of claim 1 wherein the image is a sequence of images spatially different by increments of time so as to produce the effect of motion when viewed.

15. The method of claim 1 further comprising applying a reflective backlayer to the non-lenticular side of the element.

16. The method of claim 15 wherein the exposing is with a scanning exposing device comprising a light emitting diode (LED) or a combination of LED's of differing wavelengths chosen so as to match the spectral sensitivities of the element.

17. The method of claim 15 wherein said reflective backlayer is affixed via a pressure sensitive adhesive.

18. The method of claim 1 wherein exposing is with a scanning exposing device comprising a laser or a combination of lasers of differing wavelengths chosen so as to match the spectral sensitivities of the element.

19. The method of claim 1 wherein the exposing is with a scanning exposing device comprising a scanning cathode ray tube (CRT) chosen so as to match the spectral sensitivities of the element.

20. The method of claim 1 wherein the exposing is with a scanning exposing device capable of steering the exposing beam in a longitudinal and a latitudinal direction.

21. The method of claim 1 wherein the lenticular support is an extruded polymer sheet.

22. The method of claim 1 wherein the lenticular support is comprised of polyethylene terephthalate-glycolate.

23. The method of claim 1 wherein the lenticular support further comprises an antistatic layer on the lenticular side.

24. The method of claim 1 wherein said exposing is optically.

25. The method of claim 1 wherein said exposing is with a scanning beam device.

26. A method of recording multiple images by providing a color photographic element comprising a transparent lenticular support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support and wherein the lenticular support further comprises an antistatic layer on the lenticular side.

27. The method of claim 26 wherein said magenta dye forming coupler comprises Magenta-1

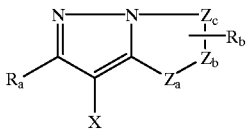

wherein $R_a$ and $R_b$ independently represent H or a substituent; X is hydrogen or a coupling-off group; and $Z_a$, $Z_b$, and $Z_c$ are independently a substituted methine group, ═N—, ═C—, or —NH—, provided that one of either the $Z_a$—$Z_b$ bond or the $Z_b$–$Z_c$ bond is a double bond and the other is a single bond, and when the $Z_b$–$Z_c$ bond is a carbon-carbon double bond, it may form part of an aromatic ring, and at least one of $Z_a$, $Z_b$ and $Z_4$ represents a methine group connected to the group $R_b$.

28. The method of claim 26 wherein the yellow dye forming coupler comprises Yellow-5

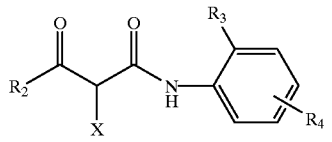

wherein $R_2$ represents a tertiary alkyl group, $R_3$ represents a halogen or an alkoxy substituent, $R_4$ represents a substituent, and X represents a N-heterocyclic coupling-off group.

29. The method of claim 26 wherein the cyan dye forming coupler comprises formula (1A)

(IA)

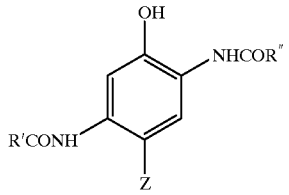

wherein

R' and R" are substituents selected such that the coupler forms image dyes having very sharp-cutting dye hues on the short wavelength side of the absorption curves with absorption maxima ($\lambda_{max}$) which are shifted hypsochromically and are in the range of 620–645 nm; and Z is a hydrogen atom or a group which can be split off by the reaction of the coupler with an oxidized color developing agent.

30. The method of claim 26 wherein the iridium dopant of the cyan or magenta emulsion is an organo-metallic complex.

31. The method of claim 26 wherein the color developer utilized in developing does not contain benzyl alcohol.

32. The method of claim 26 wherein the developed image is a lenticular image of a sequence of images which when viewed appear as a stereoscopic image.

33. The method of claim 26 wherein the image is a sequence of images spatially different by increments of time so as to produce the effect of motion when viewed.

34. The method of claim 26 further comprising applying a reflective backlayer to the non-lenticular side of the element.

35. The method of claim 26 wherein the image is exposed from the non-lenticular side of the support.

36. The method of claim 26 wherein exposing is with a scanning exposing device comprising a laser or a combination of lasers of differing wavelengths chosen so as to match the spectral sensitivities of the element.

37. The method of claim 34 wherein the exposing is with a scanning exposing device comprising a light emitting diode (LED) or a combination of LED's of differing wavelengths chosen so as to match the spectral sensitivities of the element.

38. The method of claim 26 wherein the lenticular support is comprised of polyethylene terephthalate-glycolate.

39. The method of claim 38 wherein the lenticular support has first applied a subbing layer to the non-lenticular side.

40. A method of recording multiple images by providing a color photographic element comprising a transparent lenticular support, wherein said support comprises polyethylene terephthalate-glycolate;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support.

41. The method of claim 40 wherein said magenta dye forming coupler comprises Magenta-1

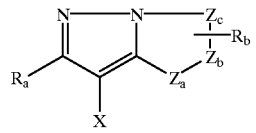

wherein $R_a$ and $R_b$ independently represent H or a substituent; X is hydrogen or a coupling-off group; and $Z_a$, $Z_b$, and $Z_c$ are independently a substituted methine group, ═N—, ═C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

42. The method of claim 41 wherein the yellow dye forming coupler comprises Yellow-5

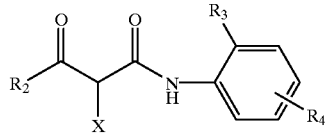

wherein $R_2$ represents a tertiary alkyl group, $R_3$ represents a halogen or an alkoxy substituent, $R_4$ represents a substituent, and X represents a N-heterocyclic coupling-off group.

43. The method of claim 42 wherein the cyan dye forming coupler comprises formula (IA)

(IA)

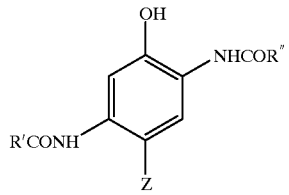

wherein

R' and R" are substituents selected such that the coupler forms image dyes having very sharp-cutting dye hues on the short wavelength side of the absorption curves with absorption maxima ($\lambda_{max}$) which are shifted hypsochromically and are in the range of 620–645 nm; and Z is a hydrogen atom or a group which can be split off by the reaction of the coupler with an oxidized color developing agent.

44. The method of claim 43 wherein the iridium dopant of the cyan or magenta emulsion is an organo-metallic complex.

45. The method of claim 43 wherein the color developer utilized in developing does not contain benzyl alcohol.

46. The method of claim 40 wherein the developed image is a lenticular image of a sequence of images which when viewed appear as a stereoscopic image.

47. The method of claim 40 wherein the image is a sequence of images spatially different by increments of time so as to produce the effect of motion when viewed.

48. The method of claim 47 wherein the lenticular support has first applied a subbing layer to the non-lenticular side.

49. The method of claim 48 wherein the lenticular support further comprises an antistatic layer on the lenticular side.

50. The method of claim 40 wherein exposing is with a scanning exposing device comprising a laser or a combination of lasers of differing wavelengths chosen so as to match the spectral sensitivities of the element.

51. The method of claim 40 further comprising applying a reflective backlayer to the non-lenticular side of the element.

52. The method of claim 51 wherein the exposing is with a scanning exposing device comprising a light emitting diode (LED) or a combination of LED's of differing wavelengths chosen so as to match the spectral sensitivities of the element.

53. A method of recording multiple images by providing a color photographic element comprising a transparent lenticular support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support wherein the image is a sequence of images spatially different by increments of time so as to produce the effect of motion when viewed.

54. The method of claim 53 wherein the iridium dopant of the cyan or magenta emulsion is an organo-metallic complex.

55. The method of claim 53 further comprising applying a reflective backlayer to the non-lenticular side of the element.

56. The method of claim 53 wherein the exposing is with a scanning exposing device capable of steering the exposing beam in a longitudinal and a latitudinal direction.

57. The method of claim 53 wherein exposing is with a scanning exposing device comprising a laser or a combination of lasers of differing wavelengths chosen so as to match the spectral sensitivities of the element.

58. The method of claim 53 wherein the exposing is with a scanning exposing device comprising a light emitting diode (LED) or a combination of LED's of differing wavelengths chosen so as to match the spectral sensitivities of the element.

59. The method of claim 53 wherein the lenticular support has first applied a subbing layer to the non-lenticular side.

60. The method of claim 59 wherein the lenticular support further comprises an antistatic layer on the lenticular side.

* * * * *

UNITED STATES PATENT AND TRADEMARK OFFICE

CERTIFICATE OF CORRECTION

PATENT NO. : 6,395,463 B1
APPLICATION NO. : 09/320615
DATED : May 28, 2002
INVENTOR(S) : Edwards It is certified that error appears in the above-identified patent and that said Letters Patent is hereby corrected as shown below:

Please Delete Title Page and Insert the Title Page as attached.

Please Delete *Columns 1 Line 1* Through *Columns 70 Line 32* and Insert *Columns 1 Line 1* Through *Columns 64 Line 61* as attached.

Signed and Sealed this

Tenth Day of March, 2009

JOHN DOLL
*Acting Director of the United States Patent and Trademark Office*

(12) United States Patent
Edwards

(10) Patent No.: US 6,395,463 B1
(45) Date of Patent: May 28, 2002

(54) MULTILAYER COLOR PHOTOGRAPHIC ELEMENT HAVING AN INTEGRAL LENTICULAR SUPPORT

(75) Inventor: James L. Edwards, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/320,615

(22) Filed: May 26, 1999

(51) Int. Cl.[7] ..... G03C 1/46

(52) U.S. Cl. ..... 430/512; 430/507; 430/510; 430/511

(58) Field of Search ..... 430/507, 510, 511, 430/512, 946

(56) References Cited

U.S. PATENT DOCUMENTS

| | | | | | |
|---|---|---|---|---|---|
| 3,751,258 | A | | 8/1973 | Howe et al. | |
| 4,863,836 | A | * | 9/1989 | Ishikawa et al. | 430/372 |
| 5,013,621 | A | | 5/1991 | Kistner | |
| 5,437,972 | A | * | 8/1995 | Ikegawa et al. | 430/574 |
| 5,464,733 | A | * | 11/1995 | Friday | 430/507 |
| 5,539,487 | A | * | 7/1996 | Taguchi et al. | 354/115 |
| 5,633,719 | A | | 5/1997 | Oehlbeck et al. | |
| 5,699,190 | A | | 12/1997 | Young et al. | |
| 5,724,758 | A | | 3/1998 | Gulick, Jr. | |
| 5,729,332 | A | | 3/1998 | Fogel et al. | |
| 5,822,038 | A | | 10/1998 | Slater et al. | |
| 5,850,580 | A | | 12/1998 | Taguchi et al. | |
| 5,962,210 | A | * | 10/1999 | Hahm et al. | 430/567 |
| 6,004,739 | A | * | 12/1999 | Ikesu et al. | 430/557 |

FOREIGN PATENT DOCUMENTS

| | | |
|---|---|---|
| JP | 4097345 | 3/1992 |

* cited by examiner

*Primary Examiner*—Janet Baxter
*Assistant Examiner*—Amanda C. Walke
(74) *Attorney, Agent, or Firm*—Paul A. Leipold

(57) ABSTRACT

The invention relates to a method of recording multiple images by providing an integral, lenticular, multilayer, color photographic element comprising a red light sensitive layer comprising a cyan dye forming coupler, a green light sensitive layer comprising a magenta dye forming coupler, a blue light sensitive layer comprising a yellow dye forming coupler, and an antihalation layer.

66 Claims, No Drawings

MULTILAYER COLOR PHOTOGRAPHIC ELEMENT HAVING AN INTEGRAL LENTICULAR SUPPORT

FIELD OF THE INVENTION

The invention relates to a method for improving the image quality of integral, lenticular, multilayer, color photographic elements and more particularly, for an improved method for reproducing three-dimensional (depth or stereoscopic) or images which contain motion or a combination thereof and methods for manufacturing such elements.

BACKGROUND OF THE INVENTION

Fogel et al, in U.S. Pat. No. 5,729,332, describes a method and apparatus for printing lenticular images which includes imposing lines of information in the form of segmented images of a scene onto a light sensitive material. However, he does not disclose the characteristics of the light sensitive material, or its composition or method of manufacture.

Young et al, in U.S. Pat. No. 5,699,190, describes a lenticular media having spatially encoded portions within the media used for precisely determining the location of the lenticules within the media.

Oehlbeck et al, in U.S. Pat. No. 5,633,719, describe a lenticular print having image bundles and an apparatus for aligning and centering the image bundles under the lenticules in a composite overlay assembly process by encoding angular alignment elements into the photographic material during exposure of the element.

Slater et al, in U.S. Pat. No. 5,822,038, describes a method and apparatus for stretching, aligning and printing a plurality of images onto lenticular media having spatially encoded portions to a silver halide negative material as an alignment process prior to exposure of the negative and the lenticular media in order to correct for pitch errors between the negative and the lenticular media, but does not describe the nature, composition, nor method of preparation of the integral lenticular imaging element.

Taguchi et al, in U.S. Pat. No. 5,539,487, and a divisional patent 5,850,580 describes a method and apparatus for recording stereoscopic images onto an integral lenticular media using a scanning exposing device, but does not describe the nature, composition, nor method of preparation of the integral lenticular imaging element.

Howe et al, in U.S. Pat. No. 3,751,258, describe an 'auto-stereographic' print in which the integral, multilayer color photographic lenticular image also contains an integral reflective backlayer. Since the reflective backlayer is applied on the side opposite the lenticular surface as part of the preparation of the element, the element must then be exposed through the lenticular support. Additionally, the element does not contain an anti-halation layer.

Telfer et al, in U.S. Pat. No. 5,279,912, describes an integral, thermal lenticular imaging media in which the image is developed after heating via exposure with an infra-red light emitting laser.

Morton, in U.S. Pat. No. 5,689,372, describes an integral lenticular imaging element having an anti-halation layer positioned on the surface of the lenticules of the media, but does not describe the composition nor method of application of the anti-halation layer.

Morton, in European Patent Application EP 0 780 728 A1, describes an integral lenticular imaging element having an anti-halation layer positioned on the surface of the media opposed to the lenticules of the media but does not describe the composition nor method of application of the anti-halation layer.

Morton, in U.S. Pat. No. 5,639,580, describes an integral lenticular imaging element having a non-specular reflective backlayer positioned behind the integral image which reflects more than 80% of the light reaching the reflective layer.

Kistner, in U.S. Pat. No. 5,013,621, describes a one part coating composition for providing a white reflective backlayer to lenticular images wherein the backlayer is applied after exposure, chemical development and drying.

Shiba in Japanese Pat. No. 4,097,345 describes a method for applying an anti-reflection overcoat to the lenticular surface of an integral color photographic element having a lenticular support.

Current color silver halide color print materials utilize three color forming layers comprised of a red light sensitive, cyan dye forming layer; a green light sensitive, magenta dye forming layer and a blue light sensitive, yellow dye forming layer. These color print or display materials -reproduce images which are 2-dimensional representations of the original 3-dimensional scene. Attempts to manufacture images in which the viewer perceives a sense of depth (or 3-dimensionality) or, images in which the viewer perceives a sense of motion have been demonstrated by several manufactures using different manufacturing processes.

Existing lenticular imaging methods and materials typically use non-integral or integral silver halide photographic elements. Other methods of lenticular imaging have also been commercialized which use various printing techniques such as lithography, ink-jet, thermal dye transfer or dye sublimation. The characteristics of these processes are such, however, that the quality of the final lenticular image is restrained by the methods and the resolution of the art which subsequently limit the number of images capable of being uniquely resolvable under each lenticule by the viewer.

Non-integral silver halide based elements are those in which the multiplexed depth or motion images or combination of images are first exposed onto a positive producing 2-dimensional print material such as Kodak Duraclear™, Kodak Duraflex™, Kodak Duratrans™ or Kodak Ektachrome™ Sheet Films. For those negative working materials, a negative must first be prepared using a film such as Kodak Vericolor Sheet Film™. The multiplicity of images are first segmented into the desired number of views (more than 2, but typically less than 50) and then interlaced (i.e.: view 1, view 2, . . . view n; view 1, view 2, . . . view n) in a computer to provide the desired sequence of images in the final lenticular image print. The digitized print information is then exposed (written) onto the negative using a drum writer, such as that manufactured by Dice America. Digital film writers such as this use light valve technology (LVT) or, more recently, light emitting diode (LED) technology to expose the digital image information onto the negative material or the 'chrome' (positive) material if a positive is desired.

Drum writers such as these create image pixels of red, green and blue exposure information by modulating the light output of the LED's in accordance with the position of the write head in concert with the composition of the original scene. The write head is positioned over the sensitized material which is clamped onto a spinning drum. As the drum spins, the digitized information from the original scene is converted to a series of pulses of red, green and blue light and tightly focused into a narrow beam which exposes the material in a series of lines. This direction of exposure is known as the 'fast scan' direction. After each rotation of the drum, the position of the write head is moved in a direction perpendicular to the direction of the spinning drum and the exposure process repeated. This is known as the 'slow scan' direction.

After the entire image has been exposed onto the material it is removed from the drum and processed to develop the latent image. If the material is a color negative type material, then the Kodak Flexicolor C41™ process would be used to develop the lines of image information. This master negative can now be used in a conventional 'contact printer' to expose the final negative print material, such as Kodak Duraclear™. After exposure of the master negative onto the print material, the print is processed. A preferred process for the Kodak Duraclear™ material is the Kodak Ektacolor RA4™ process. The image in this material can be unrecognizable as it is designed to be viewed using a lenticular lens screen.

To make the final lenticular image, the print is first coated with an adhesive material, then laminated to a lenticular screen having the same pitch as the images in the print. After lamination, the image must be aligned before the adhesive takes hold and prevents the print material from sliding easily across the lenticular screen. The process of aligning requires an operator to move the lenticular screen in such a way that the lines of image in the print are correlated to the pitch of the lenticular screen in the x-direction and that the lines of image information in the print remain correlated under the lenticules of the screen in the y-direction. This manual alignment process reduces the angular alignment error, and if the pitch of the images in the print matches the pitch of the lenticules in the lenticular screen, a lenticular image will result which is free of alignment error, resulting in a high quality image. However, as the complexity of the images increase, as in the case where more than 2 images are placed under each lenticule, the manual alignment process becomes increasingly difficult and tedious. Because of this difficult alignment process and the difficulty in manufacturing lenticular screens having perfect pitch and writing the lines of image information with drum writers in perfectly straight lines at the same pitch as the lenticular screen, the overall process yield is low and the quality of the image suffers as the size of the image and its complexity increase. This process can be used to manufacture images which are viewed by transmitted light (display conditions) or by reflected light (print viewing). An example of such a construction is shown in Table 1 (for display viewing) and in Table 2 for reflection print viewing. A modification of this process which is also available commercially is illustrated in Table 3 where 'double sided' adhesive tape is used to combine the lenticular screen to the print material.

Because of the large number of steps in these processes, precise matching of pitch between the lenticular screen and the final print material as well as control of the uniformity of thickness of the adhesive between the print and the screen, limit the final quality of the viewer perceived image since any variation in thickness of any of the components will cause the image to be moved away from the focal point of the lenticular lens. In addition, since the loss of sharpness of each of the steps of the process and the inherent sharpness of each of the photographic materials is critical in determining the number of images which can be uniquely resolved under each lenticule of the screen their combined effect is to limit the viewer perceived quality by making the final image appear 'fuzzy', or out-of-focus.

This alignment process is somewhat mitigated by using the method of Fogel et al, in U.S. Pat. No. 5,729,332 to pre-align the images with the lenticules, or by including reference grids or marks into the lenticular materials as disclosed by Young et al, in U.S. Pat. No. 5,699,190 and then using a printer such as that described by Slater et al, in U.S. Pat. No. 5,822,038 which detects the reference marks in both the lenticular screen and the print material, and then mechanically and automatically first stretches, then aligns the materials to compensate for pitch variations in the materials before making the exposure. This device can be used for integral lenticular imaging materials as well.

An integral silver halide element was disclosed by Howe et al, in U.S. Pat. No. 3,751,258. This element included a permeable reflective backlayer so that after exposure, the element could be processed. The color developers diffusing through the layer and the by-products of development washing out. Due to the orientation of the element, image-wise exposure necessarily was made through the lenticules. This approach limits the resolution of the final images under the lenticules due to the poor optical characteristics of the single lenticular lens due primarily to the spherical aberration and coma associated with single lens elements. As such, the preferred pitch of the element is between 100 and 300 lines per inch. Additionally, Howe did not provide an antihalation layer to prevent halation exposure from back reflection of the reflective back-layer, further limiting the resolution of the imaging system.

Other silver halide, integral, lenticular imaging systems have been manufactured by the Eastman Kodak Co., whose system design constructs, such as high lenticular pitch (approximately 200 lenticules per inch), have limited them to being exposed from the front (lenticular) side of the element. These materials are shown schematically in Tables 4 and 5. The element shown in Table 4 also contains an integral reflective backlayer, like that describe by Howe, while the element shown in Table 5 is a transparency and is designed for backlit display viewing. Since these materials are both designed to be exposed from the front (lenticular side), alignment of the images with the lenticules is difficult and compensation for changes in pitch is impossible, and there is no mechanism to compensate for angular alignment differences between the photographic element and the negative image. For images of this type to be of good quality, they must have be composed of a small number of individual images (typically 2 to 4) and the printing process must be precisely designed, manufactured and pre-aligned to maintain registration of the images with the pitch of the integral lenticular material as there is not an alignment process during the printing. In addition, the image resolution is also limited by the quality of the single element lenticular lens due to the spherical aberration and coma associated with single element lenses.

Taguchi et al, in U.S. Pat. No. 5,539,487 and a divisional patent 5,850,580, describes a method and apparatus for recording stereoscopic images onto an integral lenticular media using a scanning exposing device to expose the light sensitive element from the side away from the lenticules. With this design he recognizes the need for an antihalation layer to prevent light from entering into the lenticules during exposure; however, he does not describe the nature, composition, nor method of preparation of the integral lenticular imaging element. He does, however, deal with the difficult problem of keeping the scanning exposing beam on pitch, by using a beam alignment system to monitor and adjust for the angular alignment of the lenticules and the pitch of the lenticular sheet. Nor does he recognize the requirements of the integral photographic element to have good high intensity reciprocity characteristics to permit exposure of the element at extremely short exposure times such as those associated with scanning, exposing devices such as light emitting diodes (LED's), scanning cathode ray tubes (CRT's) or other devices such as a multi-wavelength laser exposing device.

Shiba, in Japanese Pat. No. 4,097,345, also discloses an integral, lenticular, silver halide based element of high pitch, preferably 180 to 500 lenticules per inch, but which contains an anti-halation layer on the surface furthest from the lenticular support. This design construct also limits the system to being exposed through the lenticular side of the support, which also inherently limits the final resolution of the photographic system due primarily to the spherical aberration and coma associated with single lens elements.

PROBLEM TO BE SOLVED BY THE INVENTION

There is a need for a motion imaging material that does not require alignment of a lenticular member with a developed image.

SUMMARY OF THE INVENTION

It is an object of this invention to provide improved images which contain motion in either a transmissive or reflection print or display mode of viewing.

It is an object of this invention to overcome the disadvantages of prior photographic elements when digitally exposed using lasers, CRT's or light emitting diodes (LED's) where the exposing times are exceptionally short.

It is another object of this invention to provide a novel, integral, lenticular, multilayer, color photographic element having more uniform response sensitivity to allow printing in both conventional, analog and digital exposing devices.

It is a further object to provide integral, lenticular, multilayer, color photographic element with has high density in the shoulder and Dmax regions when exposed using a digital exposing device such as a laser, light emitting diode (LED) or scanning cathode ray tube (CRT).

It is a further object to provide an integral, lenticular, multilayer, color photographic element with has improved sharpness, in the mid and upper scale density regions when exposed using a digital exposing device such as a laser or light emitting diode.

These and other objects of the invention are generally accomplished by a method of recording multiple images by providing a color photographic element comprising a transparent lenticular support; an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant and exposing said element from the non-lenticular side of the support using a scanning beam device, or an optical exposing device, and subsequently developing said image then applying a reflective backlayer to the non-lenticular side of the element to produce an integral, lenticular, multilayer color reflection print if desired.

ADVANTAGEOUS EFFECT OF THE INVENTION

The invention provides bright, clean images and does not require alignment of a lenticular member and developed images.

DETAILED DESCRIPTION OF EMBODIMENTS OF THE INVENTION

The invention provides numerous advantages over prior photographic elements and practices. The elements of the invention may be digitally exposed at time of between $1\times10^{-5}$ and $1\times10^{-9}$ seconds by digital exposing devices, or exposed in conventional optical printing systems whose exposure times are more typically $1\times10^{-2}$ to $1\times10^{3}$ seconds. When digitally or conventionally exposed they have well saturated colors in high density areas and exhibit minimal fringing at the borders of low density areas.

The use of pyrazoloazole magenta dye forming couplers allows silver coverage reduction in the green light sensitive magenta dye forming layer without any reduction in magenta gamma. This reduction in magenta silver coverage allows an increase in silver coverage in the blue light sensitive yellow dye forming layer without increasing total silver coverage, which increases yellow gamma and improves performance in a digital exposing device. In this way, total silver coverage is kept constant, while providing an advantage in yellow gamma. It is important to keep total silver coverage low, in order to keep cost low and maintain acceptable developability and bleachability.

The terms "above", "upper" and "top" as used herein mean the side or toward the side from which exposure of the photosensitive photographic material on a substrate takes place or has taken place. "Lower", "bottom" or "back" means the side or toward the side of the element away from which exposure of the silver halide material takes place or has taken place. Integral means not readily separated by mechanical means and comprising one unitary whole.

The invention provides in a preferred form a color photographic element comprising a red light sensitive layer comprising a cyan dye forming coupler, a green light sensitive layer comprising a magenta dye forming coupler, a blue light sensitive layer comprising a yellow dye forming coupler in combination with an anti-halation layer, wherein said magenta dye forming coupler preferably comprises Magenta-1

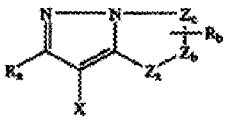

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$, and wherein said blue light sensitive layer is the light sensitive layer nearest the top of the photographic element and contains an emulsion comprising greater than 90 percent silver chloride.

In order to increase performance of color silver halide materials in digital printers, there is a desire to have higher gamma at sub-microsecond exposure times in all three color records. Due to the large grain size of the blue light sensitive emulsion, the location of conventionally designed blue light sensitive yellow dye forming layers, and the high intensity reciprocity performance of conventionally sensitized blue light sensitive emulsions, the gamma of the blue light sensitive color record can be a limiting factor. These effects are especially evident in areas of high dye density, that is in the shoulder and Dmax (area of maximum density) regions. For instance, in the case of the blue light sensitive layer, a low shoulder would lead to black areas turning blue and yellow colors becoming desaturated.

One common way to increase gamma is increase the silver coverage of the emulsion. However, increased silver causes a number of problems. In particular, higher silver coverage leads to reduction in developability. This results in a lowering of neutral gamma for a given silver coverage and for a given time of development, or increased process sensitivity. Increased silver coverage also increases the thickness of the element. This increase in thickness is a primary cause of reduced sharpness in the element and is frequently manifested as fringing around numbers or text or by the loss of resolution in motion images due to increased bandwidth of the image.

A further effect of using high coverage of emulsion is a deleterious loss of color purity. Typically, color photographic elements contain oxidized developer (Dox) scavenging interlayers (otherwise known as anti-color-mixing layers) to prevent interlayer color contamination. In the case of large grained emulsions, the scavenging layer may be increased in thickness or in concentration of the scavenging component in order to prevent formation of unwanted dye in adjacent layers. This also results in materials being wasted, since no dye is formed as a result of this process. In some instances, the very large grained emulsions produce a local concentration of Dox (oxidized developer) that is too high to be completely used by the appropriate coupler and/or scavenged by an anti-color mixing agent. For instance, in the case of large grained emulsions used in the blue layer, this can result in the formation of magenta colored spots in the photographic print from reaction of Dox formed in the blue layer with magenta coupler situated in the green layer.

When exposing conventional photographic materials by digital imaging there is a tendency for the images to have a defect commonly referred to as fringing which is a loss of image sharpness. This defect is most apparent at the edges of white areas of the prints bordering areas of higher density. Therefore there is a need to minimize fringing by silver halide materials exposed by digital means.

While increasing the silver coverage in the blue light sensitive layer increases yellow layer gamma, the yellow shoulder density is further improved by utilizing the yellow coupler Y-5. At the same time, yellow coupler Y-5 improves the color purity of the yellow dye.

A typical multicolor photographic element utilized in the invention comprises a support bearing a cyan dye image forming layer comprised of at least one red light sensitive silver halide emulsion having associated therewith at least one cyan dye-forming coupler, a magenta dye image forming layer comprising at least one green light sensitive silver halide emulsion having associated therewith at least one magenta dye-forming coupler, and a yellow dye image forming layer comprising at least one blue-sensitive silver halide emulsion having associated therewith at least one yellow dye-forming coupler. The element also contains an antihalation layer adjacent to the lenticular support. The element can contain additional layers, such as filter layers, interlayers, overcoat layers, subbing layers, and the like.

To prevent halation during exposure, an antihalation layer needs to be provided between the blue light sensitive layer and the lenticular support. The antihalation layer in the element of this invention also contains UV-light absorbers to protect the yellow image dye from dye fade due to exposure to light. The antihalation layer acts as a photon trap, absorbing photons of light which were not part of the latent image formation process after exposure. This layer prevents light from being scattered throughout the photographic element, where it could potentially expose silver halide grains not inline with the exposing beam of incident exposure light. Eliminating the light which is not part of the latent image forming process eliminates halation and increases image sharpness. This is especially important when a scanning exposing device is employed on integral lenticular materials, since the lines of image information are very narrow, typically 5μ to 10μ in diameter. If the consecutive adjacent lines of image information differ significantly in intensity and which subsequently result in significantly different amount of image density, if the element is un-sharp, the lines will broaden unnecessarily and merge in such a way that the distinct separate images will appear undistinguished from each other. Thus an image scene which is predominantly "dark" which is arranged adjacent to an image scene which is predominately "light" will visually blur together in the eyes of the observer and reduce the apparent quality of the image.

Antihalation layers are common in most color negative films such as Kodak Advantix™ film and also are found in some color print films such as Kodak Vision Color Print Film™ or Kodak Duraclear RA Display Material™. Antihalation materials are incorporated to absorb light not absorbed as part of the imaging process. This material is typically 'grey' in color and absorbs light of all color. A variety of materials have been suggested to fill this requirement. Finely dispersed carbon black is used in some products and is known in the trade as 'rem-jet'. It must be removed prior to the chemical development step via a pre-bath and as such must be coated on the side of the support opposite the imaging layers as it cannot be solubilized during the processing cycles. Finely divided elemental silver is also widely used in many color negative films. This material is known as 'grey gel' and is easily removed in the chemical development process during the bleaching and fixing steps. In some products, mixtures of water soluble cyan, magenta and yellow dyes are coated in a separate layer (usually on the side of the support opposite the emulsion layers). If these water soluble dyes are coated on the same side of the support as the emulsions, they diffuse into the emulsion layers after the coating operation and retard the photographic speed of the photographic element. Since these dye are aqueous soluble, they are conveniently removed during processing via diffusion or reaction with alkali or sulfite in the color developer.

To overcome this tendency, solid particle dispersions of these dyes have been developed. The dyes in these formulations are insoluble under all but alkaline conditions so that they remain in the layer in which they are coated, but can be removed by hydrolysis or ionization during the chemical development step of the photographic process.

The support utilized in the photographic element of the invention is unique in that it is not symmetrical, having a planar side and a lenticular side. The planar side is typically treated with a corona discharge and/or additional subbing materials such as gelatin or mixtures of polymers and gelatin in a thin layer in order to promote adhesion between the emulsion layers and the support. The lenticular side of the support is comprised of half-cylindrical lenses which are used to focus the image into the emulsion layers on the planar side of the support. For this reason, there is a specific relationship between the curvature of the lens, the thickness of the support and the refractive index of the support material. This relationship defines the focal length of the lens. The lenticular side of the support may also be treated with corona discharge in order to promote adhesion of additional layers of material to control static buildup during conveyance of the web through a coating machine at high speed, an anti-reflection layer to reduce light scatter while viewing the image, a protective overcoat to prevent scratching of the lenses, and other functional layers.

Suitable materials include transparent plastic materials which can be readily formed or extruded such as cellulose nitrate, cellulose acetate, cellulose acetate butyrate, polyacrylate, polystyrene, polyvinyl chloride, polyethylene terephthlate, polycarbonate, etc. A preferred material is transparent polyester sheets or webs, particularly extruded using polyethylene terephthalate-glycolate. The preferred material is between 4 and 50 mils in thickness and most preferably about 16 to 30 mils in thickness.

The lenticular pitch of the material is proportional to the thickness of the support and the refractive index of the support material. Generally, the thinner the support, the higher the pitch. However, as the pitch is increased, the number of images which can be written beneath the lens element diminishes with the diameter of the cylindrical lenticular lens. For this reason, the number of lines of unique image information to be written under each lens must be known as the limitations of the systems capability to resolve each line of image information determines the ultimate pitch of the system. For the preferred thickness of support, and the characteristics of the best line writing systems and photographic characteristics, the pitch of the material is preferred to be between 50 and 150 lenticules per inch and more preferably between 60 and 120 lenticules per inch and most preferably between 65 and 100 lenticules per inch.

The lenticular support may also include embedded, encoded portions such as those described by Young et al in U.S. Pat. No. 5,699,190 in order to provide precise alignment and registration of the lines of image information, such as required in the printing and alignment apparatus described by Slater et al in U.S. Pat. No. 5,822,038. Laser or LED printing devices such as the one described by Taguchi et al in U.S. Pat. No. 5,539,487 may also require embedded registration lines or lenticules in the support to maintain the alignment of the exposing beam with the lenticule during exposure of the image onto the element.

In the following discussion of suitable materials for use in the emulsions and elements that can be used in conjunction with this invention, reference will be made to *Research Disclosure*, September 1994, Item 36544, published by Kenneth Mason Publications, Ltd., Dudley House, 12 North Street, Emsworth, Hampshire PO10 7DQ, England, which will be identified hereafter by the term "*Research Disclosure.*" The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", Photographic Science and Engineering, Vol. 24, No. 6 Nov./Dec. 1980, pp. 265–267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, c1, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,828,962 (Ru+Ir, b1), Janusonis U.S. Pat. No. 4,835,093 (Re, a1); Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, c1, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. Nos. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EP 0 244 184 (Ir, Cd, Pb, Cu, Zn, Rh, Pd, Pt, Tl, Fe, d); Miyoshi et al EP 0 488 737 and 0 488 601 (Ir+VIII/Sc/Ti/V/Cr/Mn/Y/Zr/Nb/Mo/La/Ta/W/Re, a2, b, g); Ihama et al EPO 0 368 304 (Pd, a2, g); Tashiro EP 0 405 938 (Ir, a2, b); Murakami et al EP 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, ol); Yamasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EP 0 509 674, Ohya et al EP 0 513 738, Janusonis WO 91/10166, Beavers WO 92/16876, Pietsch et al German DD 298,320, and Olm et al U.S. Pat. No. 5,360,712.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EP 0 273 430 (Ir, Rh, Pt); Ohshima et al EP 0 312 999 (Ir, f); and Ogawa U.S. Statutory Invention Registration H760 (Ir, Au, Hg, Tl, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

In a specific, preferred form of the invention it is contemplated to employ a class (i) hexacoordination complex dopant satisfying the formula:

$$[ML_6]^n \qquad (I)$$

where n is zero, −1, −2, −3 or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)Cl_5]^{-4}$
(i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S.

Eachus and M. T. Olm *Annu. Rep. Prog. Chem. Sect. C. Phys. Chem.*, Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712, Olm et al U.S. Pat. No. 5,457,021 and Kuromoto et al U.S. Pat. No. 5,462,849.

In a preferred form it is contemplated to employ as a class (ii) dopant a hexacoordination complex satisfying the formula:

$$[IrL^1_6]^{n'} \qquad \text{(II)}$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(\text{thiazole})]^{-2}$
(ii-2) $[IrCl_4(\text{thiazole})_2]^{-1}$
(ii-3) $[IrBr_5(\text{thiazole})]^{-2}$
(ii-4) $[IrBr_4(\text{thiazole})_2]^{-1}$
(ii-5) $[IrCl_5(\text{5-methylthiazole})]^{-2}$
(ii-6) $[IrCl_4(\text{5-methylthiazole})_2]^{-1}$
(ii-7) $[IrBr_5(\text{5-methylthiazole})]^{-2}$
(ii-8) $[IrBr_4(\text{5-methylthiazole})_2]^{-1}$ In one preferred aspect of the invention in a layer using a magenta dye forming coupler, a class (ii) dopant in combination with an $OsCl_5(NO)$ dopant has been found to produce a preferred result.

Emulsions demonstrating the advantages of the invention can be realized by modifying the precipitation of conventional high chloride silver halide grains having predominantly (>50%) {100} crystal faces by employing a combination of class (i) and (ii) dopants as described above.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Behnmuller et al U.S. Pat. No. 5,045,444, Maeka et al U.S. Pat. No. 5,070,008, and Vandenabeele et al EP 0 392 092.

Further, it would be advantageous to practice elements of the invention in conjunction with the materials disclosed in an article entitled "Typical and Preferred Color Paper, Color Negative, and Color Reversal Photographic Elements and Processing" which was published in *Research Disclosure*, February 1995, Volume 370. In particular, Sections I–XIII, XV–XVIII, and XXIIIA are especially relevant, and are hereby incorporated by reference.

Any photographic coupler known to the art can be used in conjunction with elements of the invention. Suitable couplers are described in *Research Disclosure*, Item 36544, Section X. in addition, the structures of particularly preferred couplers can be found in an article entitled "Typical and Preferred Color Paper, Color Negative, and Color Reversal Photographic Elements and Processing" which was published in *Research Disclosure*, February 1995, Volume 370, Section II.

The magenta coupler utilized in the invention may be any magenta coupler of the following structure:

MAGENTA-1

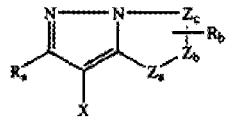

wherein $R_a$ and $R_b$ independently represent H or a substituent; X is hydrogen or a coupling-off group; and $Z_a$, $Z_b$, and $Z_c$ are independently a substituted methine group, ═N—, ═C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Preferred magenta couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

In particular, pyrazoloazole magenta couplers of general structures PZ-1 and PZ-2 are especially preferred:

PZ-1

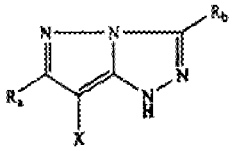

PZ-2

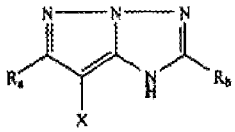

wherein $R_a$, $R_b$, and X are as defined for MAGENTA-1.

Particularly preferred are the two-equivalent versions of magenta couplers PZ-1 and PZ-2 wherein X is not equal to a hydrogen. This is the case because of the advantageous drop in silver required to reach the desired density in the print element.

Typical magenta couplers that may be used in the inventive photographic element are shown below.

M-1

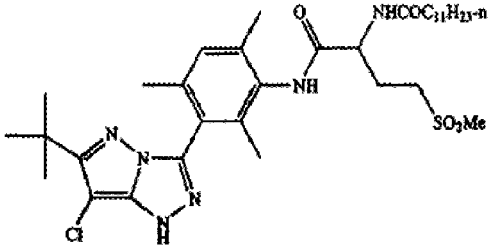

M-2

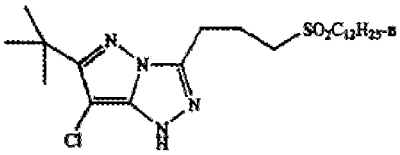

M-3

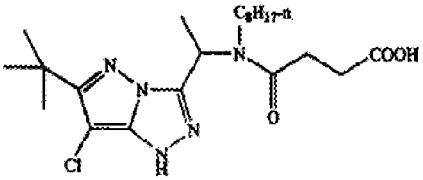

M-4

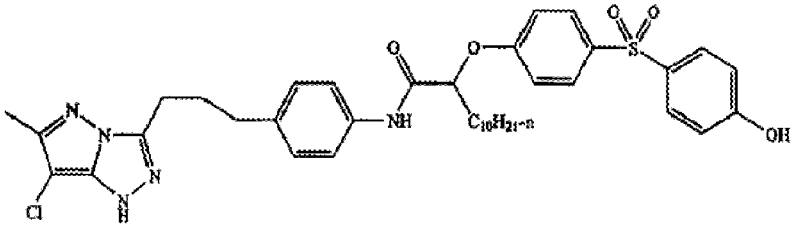

M-5

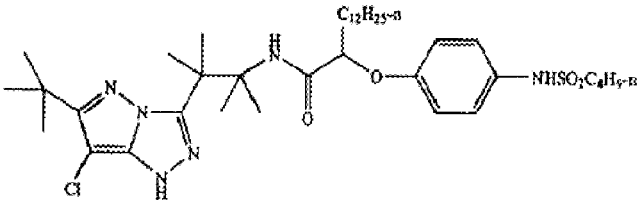

-continued

M-6

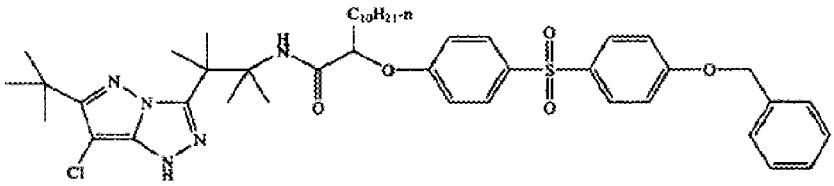

M-7

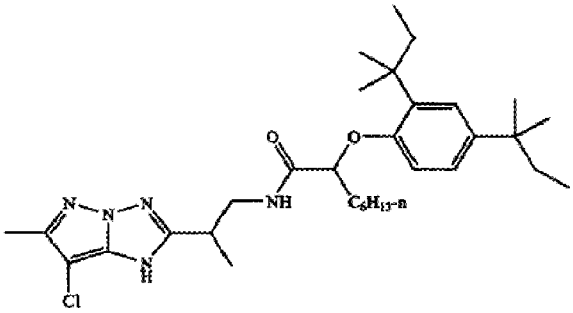

M-8

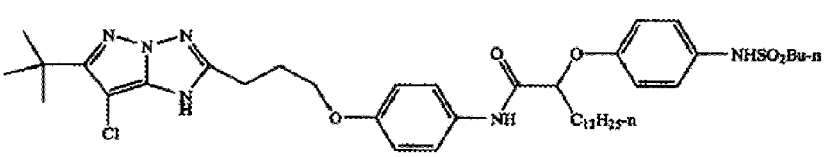

M-9

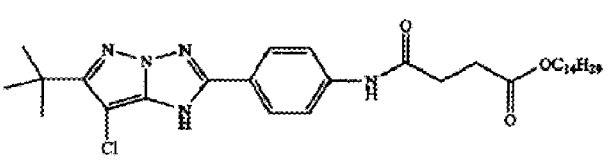

A preferred magenta coupler is

M-2

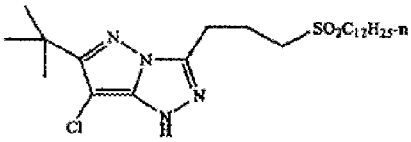

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

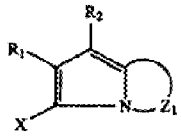

CYAN-2

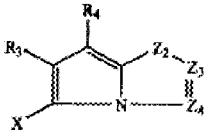

CYAN-3

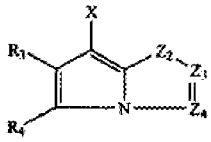

CYAN-4

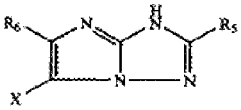

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)= and —N=; and $Z_3$ and $Z_4$ each represents —C($R_8$)= and —N=.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

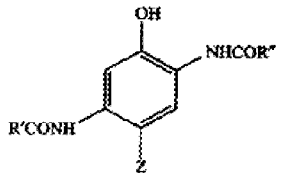

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

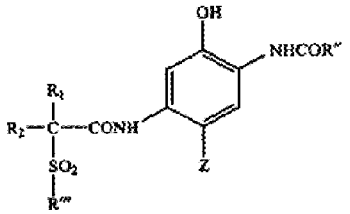

wherein

R" and R'" are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R'" is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5–10 membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-dichlorophenyl, 3,4-difluorophenyl, 4-cyanophenyl, 3-chloro-4-cyanophenyl, pentafluorophenyl, or a 3- or 4-sulfonamidophenyl group.

In formula (I), when R'" is alkyl it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxycarbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

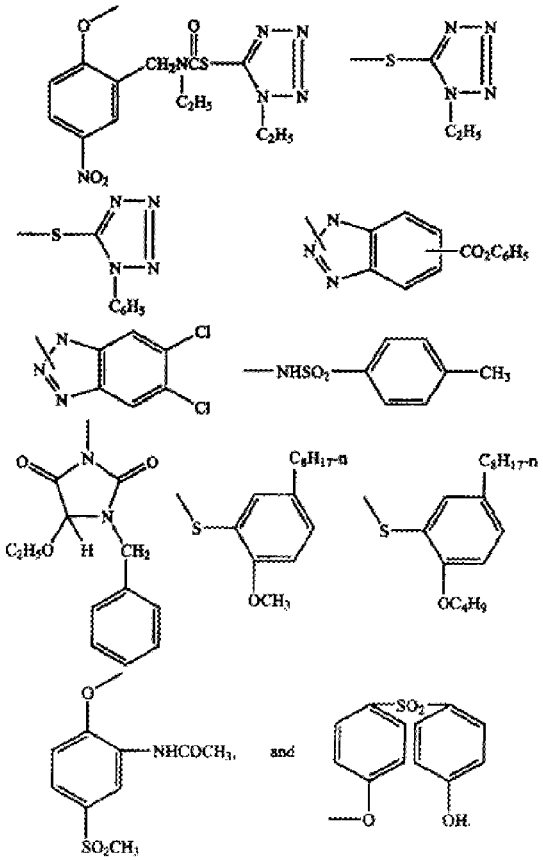

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling; thus, the ballast is most advantageously provided as part of groups other than Z.

The following examples further illustrate preferred coupler of the invention. It is not to be construed that the present invention is limited to these examples.

IC-1

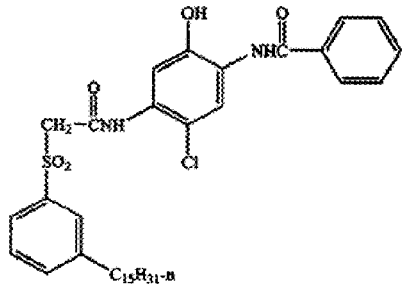

IC-2

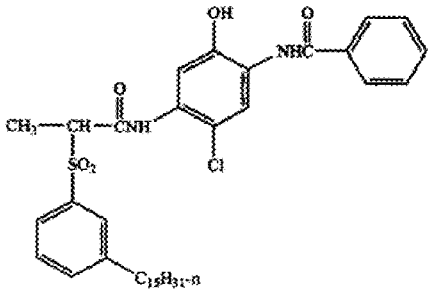

IC-3

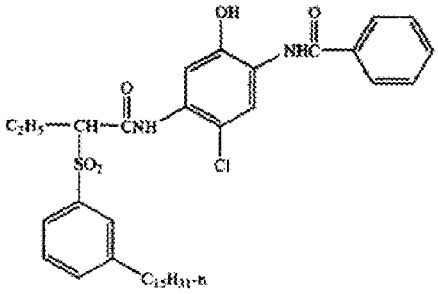

-continued

IC-4

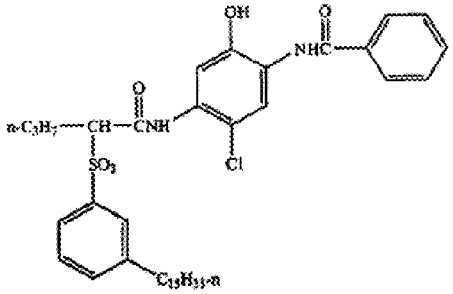

C-5

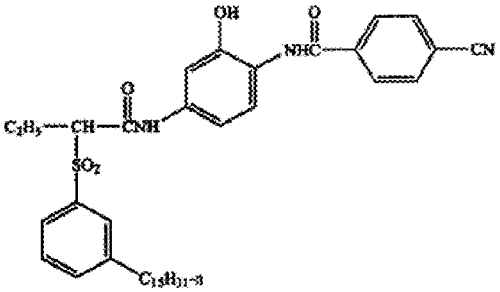

IC-6

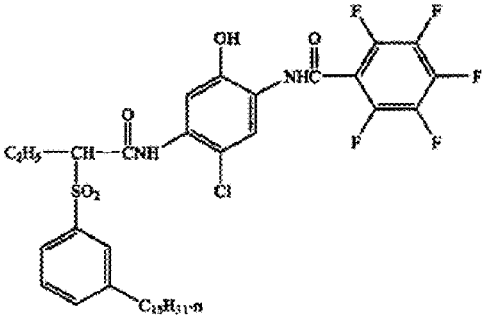

IC-7

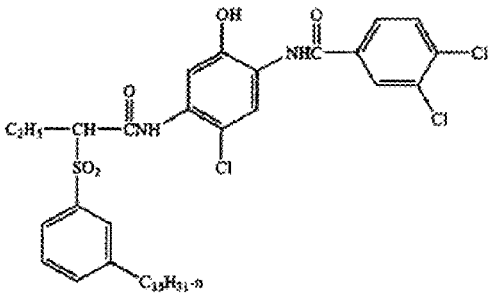

-continued
IC-8
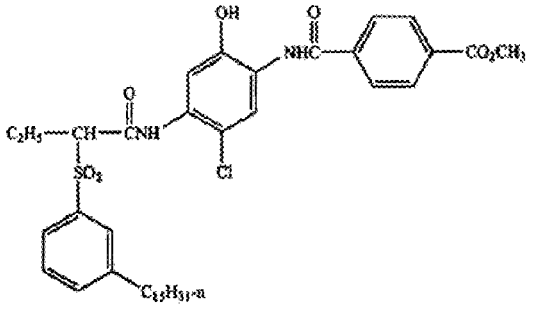
IC-9
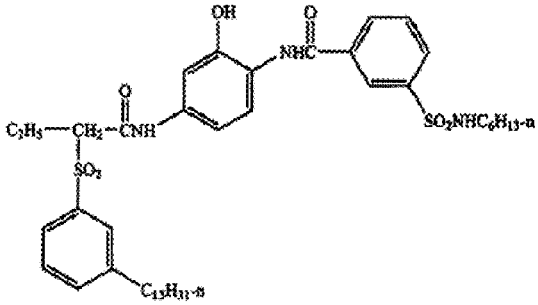
IC-10
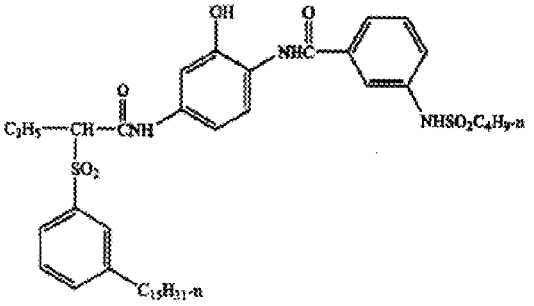
IC-11
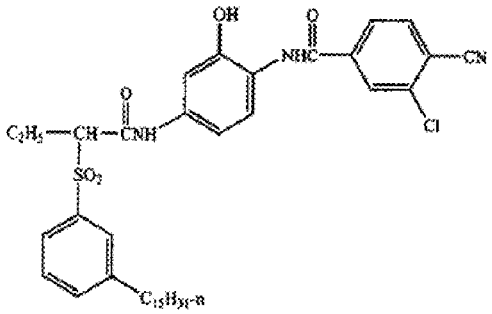
-continued
IC-12
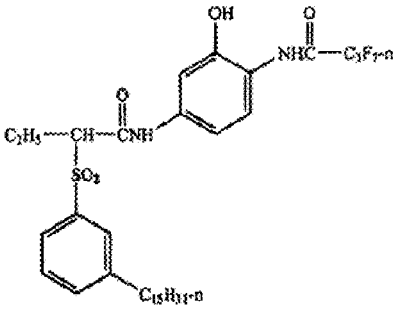
IC-13
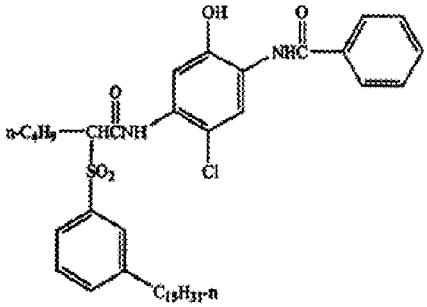
IC-14
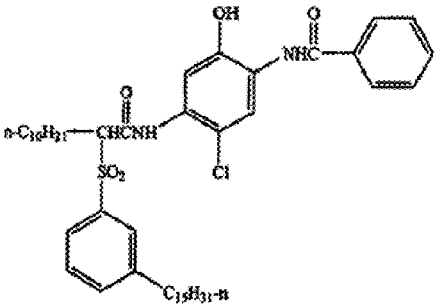
IC-15
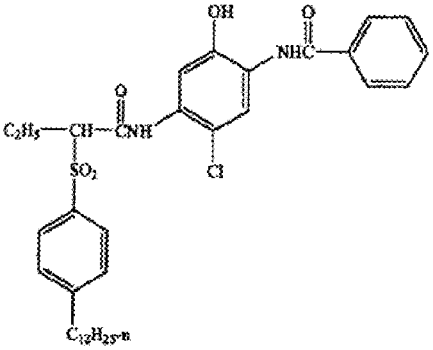

-continued
IC-16
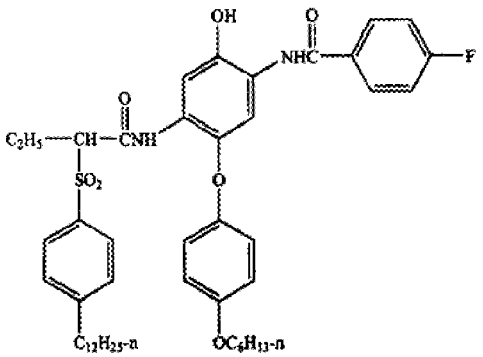
IC-17
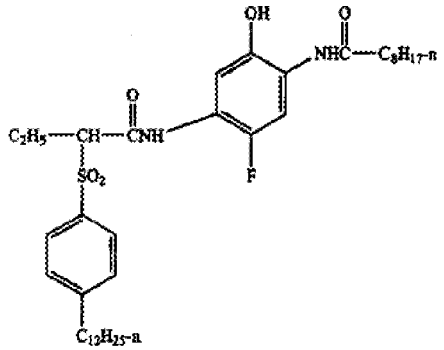
IC-18
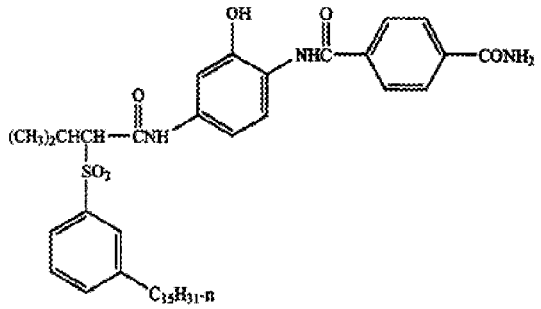
IC-19
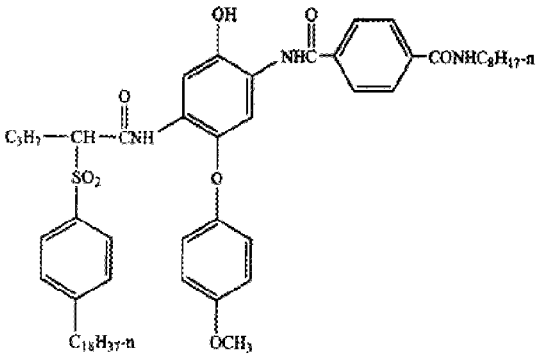
-continued
IC-20
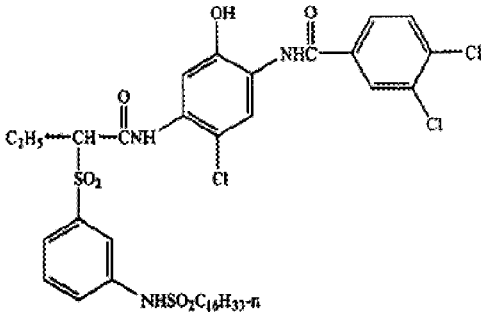
IC-21
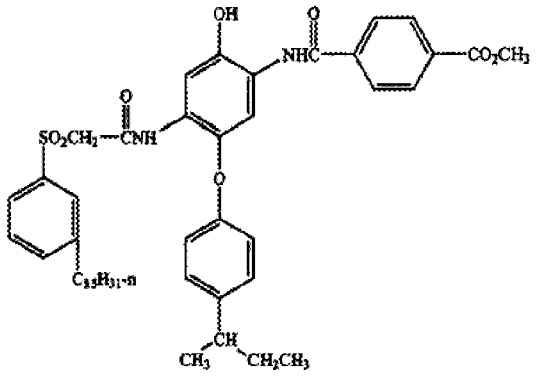
IC-22
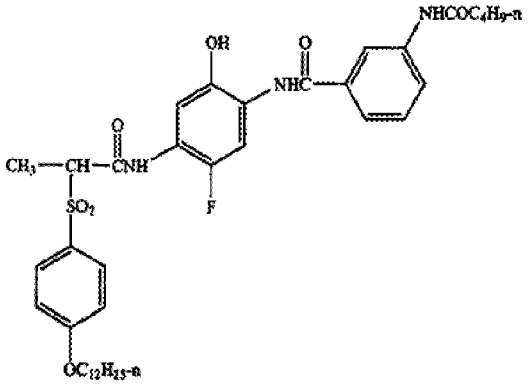
IC-23
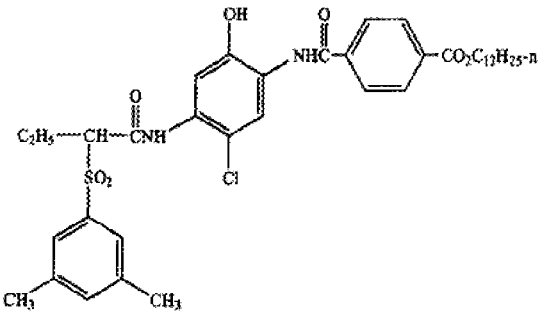

-continued
IC-24
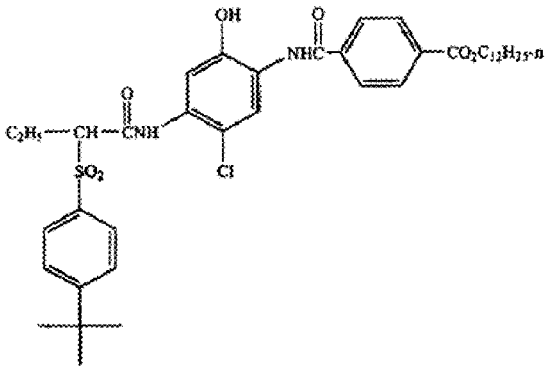
IC-25
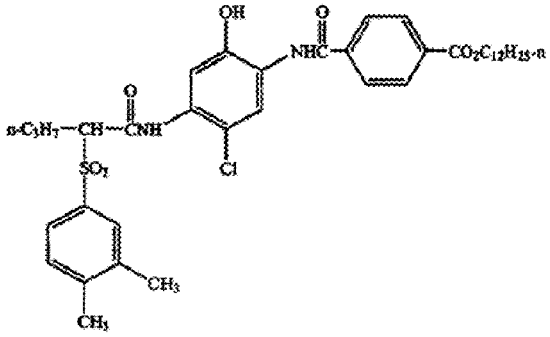
IC-26
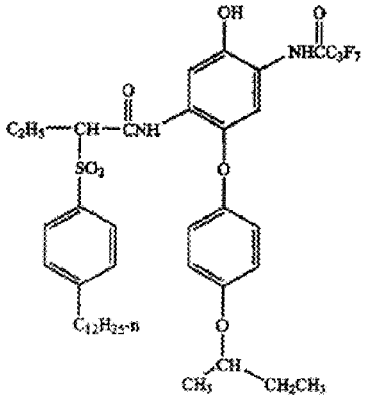
-continued
IC-27
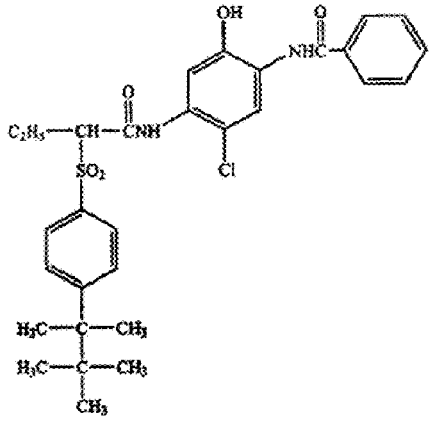
IC-28
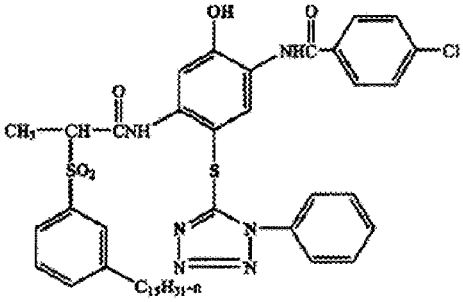
IC-29
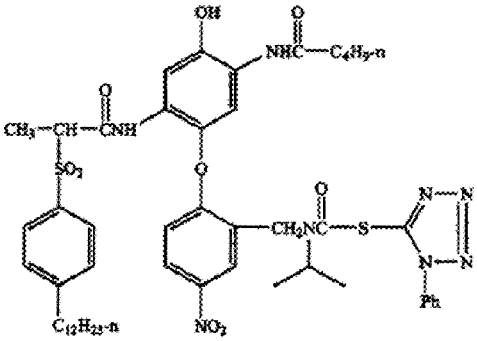
IC-30
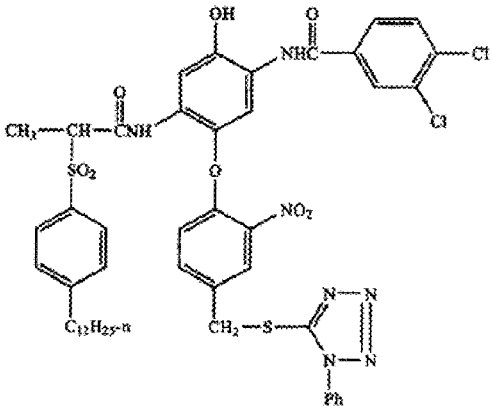

-continued
IC-31
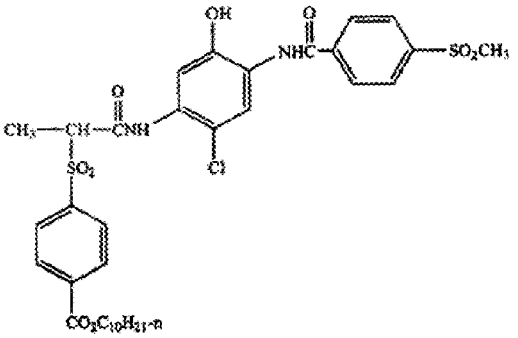
IC-32
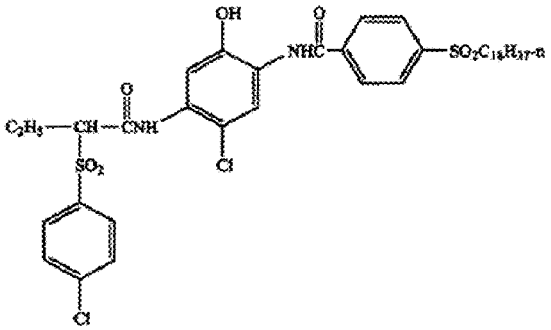
IC-33
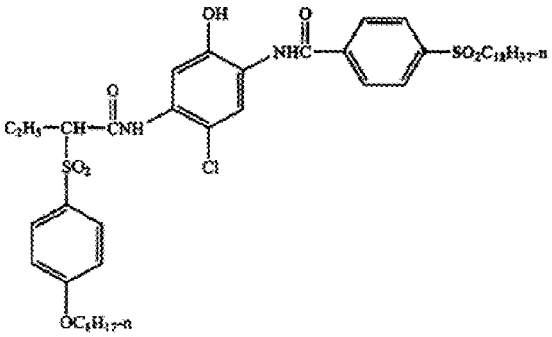
IC-34
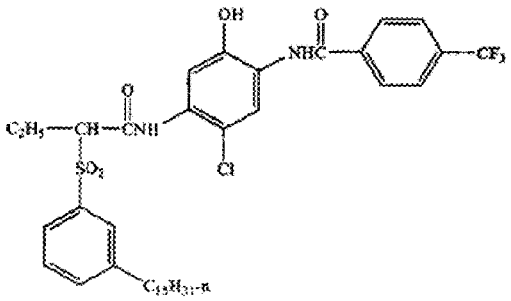
-continued
IC-35
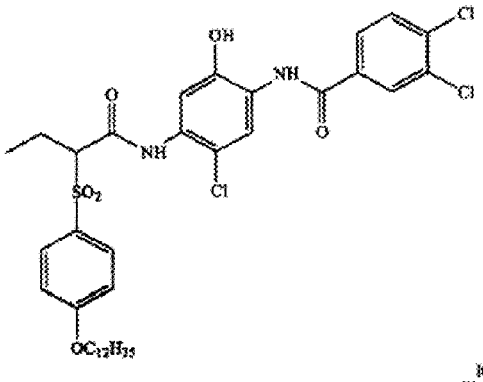
IC-36
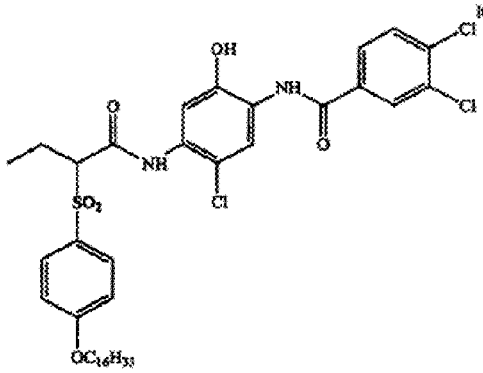
IC-37
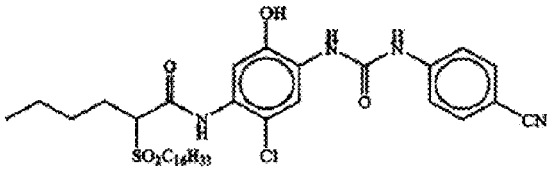
IC-38
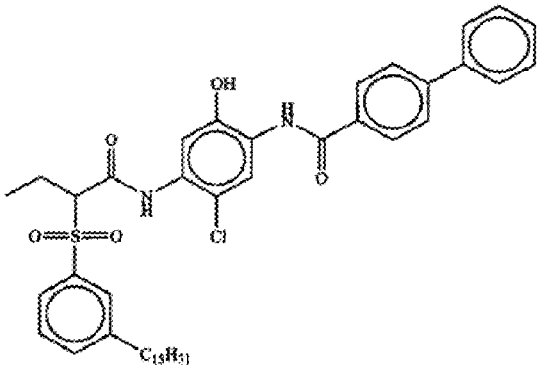

-continued

IC-39

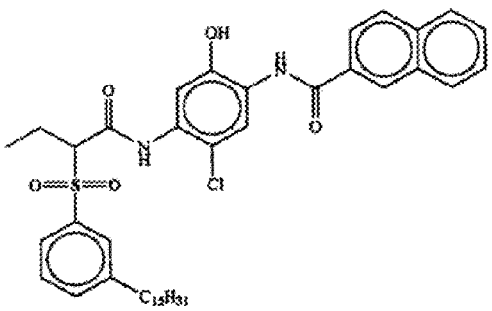

IC-40

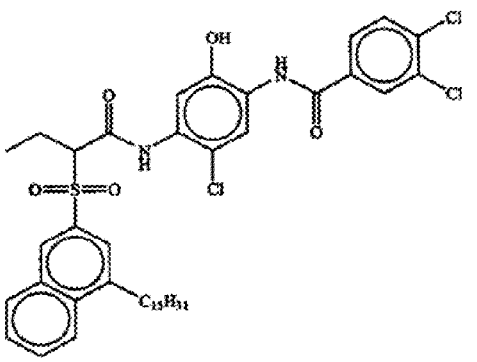

Preferred couplers are IC-3, IC-7, IC-35, and IC-36 because of their suitably narrow left bandwidths.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. Nos. 4,404,274 and 5,238,803.

Typical preferred yellow couplers are represented by the following formulas:

YELLOW-1

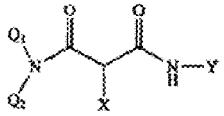

YELLOW-2

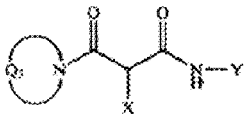

-continued

YELLOW-3

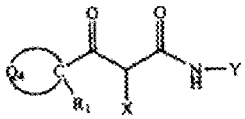

YELLOW-4

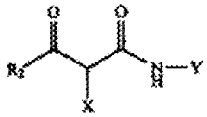

YELLOW-5

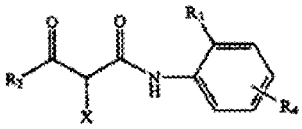

wherein $R_1$, $R_2$, $R_3$, $R_4$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

The most preferred yellow couplers are represented by YELLOW-5, wherein $R_2$ represents a tertiary alkyl group, $R_3$ represents a halogen or an alkoxy substituent, $R_4$ represents a substituent, and X represents a N-heterocyclic coupling-off group because of their good development and desirable color.

Even more preferred are yellow couplers are represented by YELLOW-5, wherein $R_2$, $R_3$ and $R_4$ are as defined above, and X is represented by the following formula:

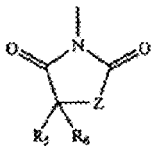

wherein Z is oxygen of nitrogen and $R_5$ and $R_6$ are substituents. Most preferred are yellow couplers wherein Z is oxygen and $R_5$ and $R_6$ are alkyl groups.

Typical yellow couplers that may be used in the inventive photographic element are shown below.

Y-1
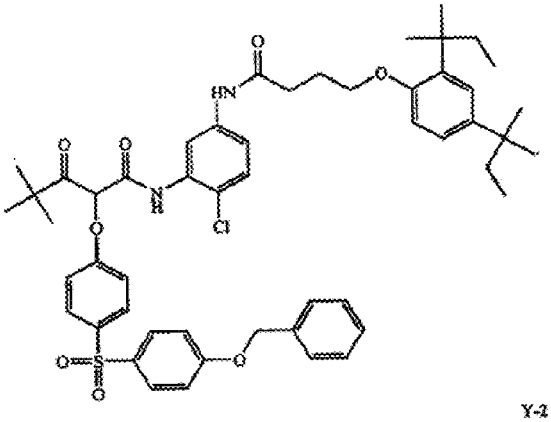
Y-2
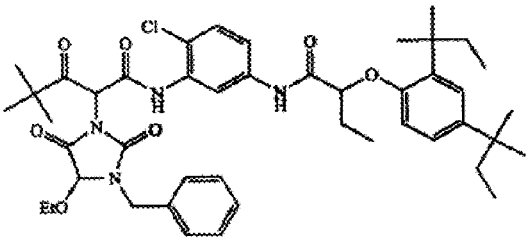
Y-3
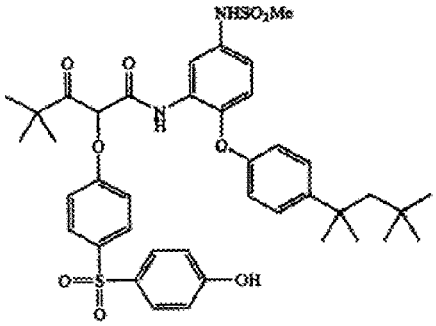
Y-4
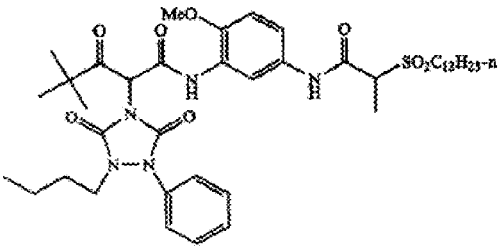
Y-5
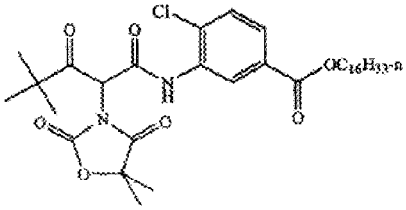
-continued
Y-6
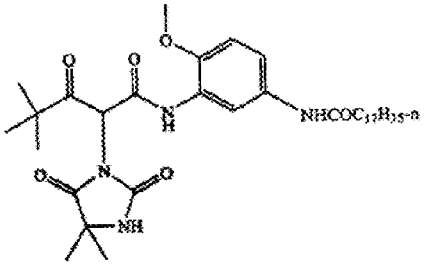
Y-7
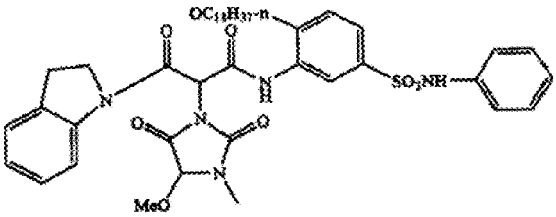
Y-8
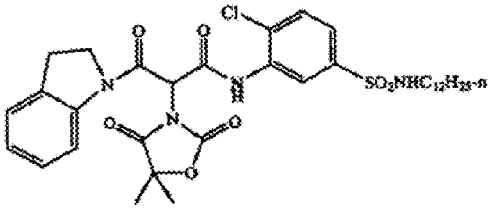
Y-9
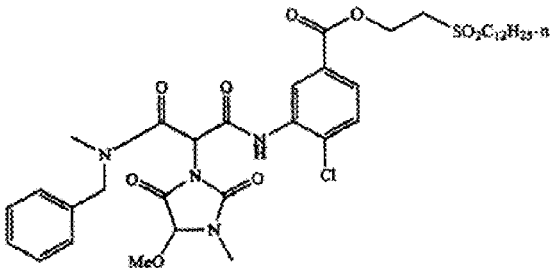
Y-10
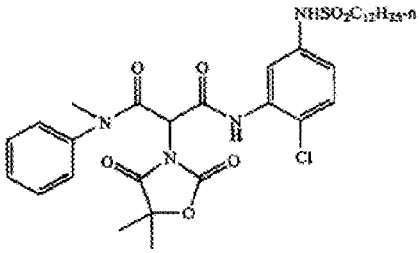

-continued

Y-11

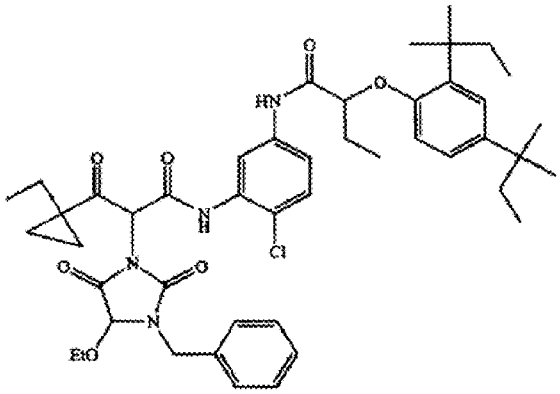

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Polymer containing dispersions of yellow photographic couplers have been employed in color print materials, as described in U.S. Pat. No. 4,857,449. Other methods for preparing polymer-containing dispersions of dye-forming couplers are described in U.S. Pat. Nos. 4,939,077; 4,203,716; and 4,840,885. Commonly, these dispersions are prepared from a solution of a coupler, an optional high-boiling solvent, an oil-soluble but water-insoluble polymer, and a volatile organic solvent, which solution is then emulsified and dispersed in an aqueous solution, often comprising water, a hydrophilic colloid such as gelatin, and a surfactant. Other methods describe the formation of loaded latex polymer dispersions using water-miscible or volatile organic solvent. It is also possible to prepare these materials by forming an loaded polymer latex dispersion, prepared either by high-shear mixing of a liquid oil phase with a latex-containing aqueous solution, or in some cases by combining a dispersion of a photographic coupler that is free of volatile organic solvent with a latex polymer, with sufficient surfactant and sufficient time to cause formation of a loaded latex dispersion. One of the main advantages of polymer-containing dispersions described in the prior art have included image preservation to heat and light, although other advantages in manufacturing processes, physical performance of the photographic element, and sensitometric performance have been reported.

Polymer containing dispersions used in the elements of the invention may be prepared by emulsifying a mixed oil solution comprising polymer and the photographically useful compounds desired in the dispersion, as described in U.S. Pat. Nos. 3,619,195 and 4,857,449.

Polymer-containing dispersions used in the elements of the invention may also be prepared as loaded latex dispersions. These may be prepared according to at least three types of process. The first process, described in, for example, U.S. Pat. No. 4,203,716, involves dissolving the hydrophobic photographically useful compounds to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with sufficient shear to cause loading as described in U.S. Pat. No. 5,594,047, the disclosure of which is hereby incorporated by reference. A third possible way to prepare some loaded latex formulations is to simply combine a polymer latex with a dispersed oil solution, such that the oil solution and latex are miscible, in the presence of surfactant, for a sufficient time before the dispersion is coated for loading to occur as described in U.S. Pat. No. 5,558,980.

Polymers used in the invention are preferably water-insoluble, and sufficiently hydrophobic to be incorporated as components of the hydrophobic dispersed phase of the dispersions used in the elements of the invention. The polymers may be prepared by bulk polymerization or solution polymerization processes. Especially preferred among possible polymerization processes is the free-radical polymerization of vinyl monomers in solution.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydrofurfuryl vinyl ether, etc.); vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzene, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy)styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2-aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl) methacrylamide hydrochloride, N-(3-dimethylaminopropyl) methacrylamide hydrochloride, N,N-dipropylacrylamide, N-(1,1-dimethyl-3-oxobutyl)acrylamide, N-(1,1,2-trimethylpropyl)acrylamide, N-(1,1,3,3-tetramethylbutyl) acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl) acrylamide, N-(2-carboxyethyl)acrylamide, 3-acrylamido-3-methylbutanoic acid, methylene bisacrylamide, etc.).

Specific examples of useful polymers and polymer latex materials are given below:

P-1 Poly(N-tert-butylacrylamide)
P-2 Poly(N-cyclohexylamide)
P-3 Poly(N-sec-butylacrylamide)
P-4 Poly(N-(1,1,3,3-tetramethylbutyl)acrylamide)
P-5 Poly(N-(1,1,2-trimethylpropyl)acrylamide)
P-6 Poly(N-(1,1-dimethyl-3-oxobutyl)acrylamide)
P-7 Poly(N-(1-phthalimidomethyl)acrylamide)
P-8 Poly(N,N-di-n-propylacrylamide)
P-9 N-tert-butylacrylamide/2-hydroxyethylmethacrylate copolymer (80/20) (by weight, hereinafter the same)
P-10 N-tert-butylacrylamide/methylene bisacrylamide copolymer (98/2)
P-11 N-cyclohexylacrylamide/methylene bisacrylamide copolymer (98/2)
P-12 1,1-dimethyl-3-oxobutyl)acrylamide/methylene bisacrylamide copolymer (98/2)
P-13 Methyl acrylate/2-acrylamido-2-methylpropane sulfonic acid copolymer (96/4)
P-14 Methyl acrylate/2-acrylamido-2-methylpropane sulfonic acid copolymer (98/2)
P-15 Methyl acrylate/2-acrylamido-2-methylpropane sulfonic acid/2-acetoacetoxyethyl methacrylate copolymer (91/5/4)
P-16 Methyl acrylate/2-acrylamido-2-methylpropane sulfonic acid/ethylene glycol dimethacrylate copolymer (96/2/2)
P-17 Butyl acrylate/2-acrylamido-2-methylpropane sulfonic acid sodium salt/2-acetoacetoxyethyl methacrylate copolymer (90/6/4)
P-18 Butyl acrylate/2-acrylamido-2-methylpropane sulfonic acid/ethylene glycol dimethacrylate copolymer (90/6/4)
P-19 Butyl acrylate/styrene/methacrylamide/2-acrylamido-2-methylpropane sulfonic acid sodium salt copolymer (55/29/11/5)
P-20 Butyl acrylate/styrene/2-acrylamido-2-methylpropane sulfonic acid sodium salt copolymer (85/10/5)
P-31 Poly(methylmethacrylate)
P-32 Glycidyl methacrylate/ethylene glycol dimethacrylate copolymer (95/5)
P-33 Poly(acrylonitrile)
P-34 Acrylonitrile/vinylidene chloride/acrylic acid copolymer (15/79/6)
P-35 Styrene/butyl methacrylate/2-sulfoethyl methacrylate sodium salt copolymer (30/60/10)
P-36 Polystyrene
P-37 Poly(4-acetoxystyrene)
P-38 Poly(4-vinylphenol)
P-39 Poly(4-t-butoxycarbonyloxystyrene)
P-40 2-(2'-Hydroxy-5'-methacrylyloxyethylphenyl)-2H-benzotriazole/ethyl acrylate/2-acrylamido-2-methylpropane sulfonic acid sodium salt copolymer (74/23/3)
P-41 N-tert-butylacrylamide/3-acrylamido-3-methylbutanoic acid copolymer (99.5/0.5)
P-42 N-tert-butylacrylamide/3-acrylamido-3-methylbutanoic acid copolymer (99.0/1.0)
P-43 N-tert-butylacrylamide/3-acrylamido-3-methylbutanoic acid copolymer (98/2)
P-44 N-tert-butylacrylamide/3-acrylamido-3-methylbutanoic acid copolymer (96/4)
P-45 N-tert-butylacrylamide/3-acrylamido-3-methylbutanoic acid copolymer (92/8)
P-46 N-tert-butylacrylamide/methyl acrylate copolymer (25/75)
P-47 N-tert-butylacrylamide/methyl acrylate copolymer (50/50)
P-48 N-tert-butylacrylamide/methyl acrylate copolymer (75/25)
P-49 Poly(methyl acrylate)
P-50 Methyl methacrylate/methyl acrylate copolymer (75/25)
P-51 Methyl methacrylate/methyl acrylate copolymer (50/50)
P-52 Methyl methacrylate/methyl acrylate copolymer (25/75)
P-53 N-tert-butylacrylamide/2-acrylamido-2-methylpropane sulfonic acid sodium salt copolymer (98/2)
P-54 N-tert-butylacrylamide/2-acrylamido-2-methylpropane sulfonic acid sodium salt copolymer (99/1)
P-55 Methyl methacrylate/2-acrylamido-2-methylpropane sulfonic acid sodium salt copolymer (98/2)
P-56 N-tert-butylacrylamide/n-butyl acrylate copolymer (50/50)

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis-(isobutyronitrile), 2,2'-azobis(2-amidinopropane) dihydrochloride, etc.

It is understood throughout this disclosure that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues.

In this invention, the presence of an interlayer containing an anticolor-mixing agent (antistain or oxidized developer scavenger) is preferred. Typically, these scavengers are ballasted to keep them in the layer in which they were coated. The scavengers work by reducing any excess oxidized developer back to the developer form. Anticolor-mixing agents include compounds such as derivatives of hydroquinones (e.g. see U.S. Pat. Nos. 2,336,327; 2,360,290; 2,403,721; 2,701,197; 2,728,659; and 3,700,453) aminophenols, amines, gallic acid, catechol, ascorbic acid, hydrazides (e.g. U.S. Pat. No. 4,923,787), sulfonamidophenols (e.g. U.S. Pat. No. 4,447,523), and non color-forming couplers.

It is also contemplated that the concepts of the discussion may be employed to obtain reflection color prints as described in *Research Disclosure*, November 1979, Item 18716. The photographic element may contain epoxy solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171, 5,096,805, and 5,126,234. If desired, false sensitization, as described in Hahm in U.S. Pat. No. 4,902,609, can be used to provide added detail in color embodiments.

Due to a desire for rapid development and reduced impact on the environment, preferred emulsions for color display or color print materials having a transparent or paper base of the invention are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum. It is specifically contemplated to use {100} tabular grain silver chloride emulsions, as disclosed in U.S. Pat. No. 5,320,938, in conjunction with elements of the current invention.

Color display elements typically contain less than 2.0 g/m$^2$ of total silver. Due to the need to decrease the environmental impact of color display processing, it is desired to decrease the amount of total silver used in the element as much as possible. Therefore, total silver levels of less than 1.3 g/m$^2$ are preferable, and levels of 1.1 g/m$^2$ are even more preferable. It is possible to reduce further the total silver used in the color photographic element to less than 0.20 g/m$^2$ by use of a so-called development amplification process whereby the incorporated silver is used only to form the latent image, while another oxidant, such as hydrogen peroxide, serves as the primary oxidant to react with the color developer. Such processes are well-known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. Elements of the invention can be processed by a method such as the RA-4 process of Eastman Kodak Company as is described in the *British Journal of Photography Annual* of 1988, pages 198–199.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. In fact, placing the blue light sensitive layer above the red and green light sensitive layers results in reduced blue light sensitivity in the red light and green light sensitive layers. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development and 2) de-silvering. The de-silvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;
2) color developing→bleaching→fixing→washing/stabilizing;
3) color developing→bleaching→bleach-fixing→washing/stabilizing;
4) color developing→stopping→washing→bleaching→washing→fixing→washing/stabilizing;
5) color developing→bleach-fixing→fixing→washing/stabilizing;
6) color developing→bleaching→bleach-fixing→fixing→washing/stabilizing.

Among the processing steps indicated above, the steps 1), 2) and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate,
4-amino-3-methyl-N-ethyl-N-(β-(methanesulfonamidoethyl)aniline sesquisulfate hydrate,
4-amino-N,N-diethylaniline hydrochloride,
4-amino-3-methyl-N,N-diethylaniline hydrochloride,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Among the above-mentioned color developing agents, 4-amino-3-methyl-N-ethyl-N-(β-(methanesulfonamidoethyl)anili sesquisulfate hydrate preferably is used. There may be some instances where the above mentioned color developing agents may be used in combination so that they meet the purposes of the application.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

Table 1 is a diagram of the concept of a conventional, non-integral multilayer color lenticular photographic display product such as Kodak Duraclear RA Display Film™ laminated to a lenticular screen.

Table 2 is a diagram of the concept of a conventional, non-integral multilayer color lenticular photographic print product such as Kodak Durflex RA Print Film™ laminated to a lenticular screen.

Table 3 is a diagram of an alternate concept of a manufacturing a conventional, non-integral multilayer color lenticular photographic display product such as Kodak Duraclear RA Display Film™ laminated to a lenticular screen using 'double-sided adhesive tape'.

Table 4 is a diagram of the concept of a conventional, integral multilayer color lenticular photographic print product such as that previously manufactured by the Eastman Kodak Co.

Table 5 is a diagram of the concept of a conventional, integral multilayer color lenticular photographic display product such as that previously manufactured by the Eastman Kodak Co.

Table 6 is a diagram of the concept of an integral, multilayer color lenticular photographic print product such as that proposed by Howe, in U.S. Pat. No. 3,751,258.

Table 7 is a diagram of the concept of an integral, multilayer color lenticular photographic print product such as that proposed by Shiba in Japanese No. 4,097,345.

Table 8 is a diagram of the concept of an integral, multilayer color lenticular photographic print product such as that proposed by Taguchi in U.S. Pat. Nos. 5,539,487 and 5,850,580.

Table 9 is a diagram of the concept of the inventive integral, multilayer color lenticular photographic print product of this invention.

Table 10 is a diagram of the concept of the inventive integral, multilayer color lenticular photographic display product of this invention.

TABLE 1

| Conventional Non-Integral Lenticular Structure[1] |
|---|
| Overcoat |
| UV absorbing layer |
| Red light sensitive layer |
| UV absorbing layer |
| Green light sensitive layer |
| Interlayer |
| Blue light sensitive layer |
| Clear Planar Support |
| UV absorbing layer |
| With Antihalation Dyes |
| Overcoat |
| Adhesive layer |
| Lenticular Support |

[1]Manufactured by Eastman Kodak Co.

TABLE 2

| Conventional Non-Integral Lenticular Structure[2] |
|---|
| Reflective Support |
| Blue light sensitive layer |
| Interlayer |
| Green light sensitive layer |
| UV absorbing layer |
| Red light sensitive layer |
| UV absorbing layer |
| Overcoat |
| Adhesive layer |
| Lenticular Support |

[2]Manufactured by Eastman Kodak Co.

TABLE 3

| Conventional Non-Integral Lenticular Structure[3] |
|---|
| Overcoat |
| Imaging layer support |
| Blue light sensitive layer |
| Interlayer |
| Green light sensitive layer |
| Interlayer |
| Red light sensitive layer |
| Overcoat |
| Adhesive layer |
| Adhesive layer support |
| Adhesive layer |
| Transparent Lenticular Support |

[3]Manufactured by 3D Sign and Design, Inc.

TABLE 4

| Conventional Integral Lenticular Structure[4] |
|---|
| Overcoat |
| Integral Reflective Backlayer |
| ($TiO_2$/gelatin) |
| Gelatin Interlayer |
| Blue light sensitive layer |
| UV absorbing layer |
| Green light sensitive layer |
| UV absorbing layer |
| Red light sensitive layer |
| Transparent Lenticular Support |

TABLE 5

| Conventional Integral Lenticular Structure[5] |
|---|
| Overcoat |
| Blue light sensitive layer |
| UV absorbing layer |
| Green light sensitive layer |
| UV absorbing layer |
| Red light sensitive layer |
| Gelatin Layer |
| Transparent Lenticular Support |

[4], [5]Manufactured by Eastman Kodak Co.

TABLE 6

| Conventional Integral Lenticular Structure[6] |
|---|
| Overcoat |
| Integral Reflective Backlayer |
| ($TiO_2$/gelatin) |
| Gelatin Interlayer |
| Blue light sensitive layer |
| Gelatin Interlayer |
| Red light sensitive layer |
| Gelatin Interlayer |
| Green light sensitive layer |
| UV absorbing layer |
| Transparent Lenticular Support |

[6]Howe, et al, in U.S. Pat. No. 3,751,258

TABLE 7

| Conventional Integral Lenticular Structure[7] |
|---|
| Overcoat + |
| Antihalation Layer |
| Gelatin Interlayer |
| Blue light sensitive layer |
| Gelatin Interlayer |
| Red light sensitive layer |
| UV absorbing layer |
| Green light sensitive layer |
| UV absorbing layer |
| Transparent Lenticular Support |

[7]Shiba in JP Pat. No. 4,097,345

TABLE 8

| Conventional Integral Lenticular Structure[8] |
|---|
| Red light sensitive layer |
| Green light sensitive layer |
| Blue light sensitive layer |
| Antihalation layer |
| Lenticular Support |

[8]Taguchi et al. in U.S. Pat. No. 5,539,487

TABLE 9

| Inventive Integral Lenticular Structure |
|---|
| Overcoat |
| Red light sensitive layer + |
| UV-light absorber dyes |
| Interlayer |
| Green light sensitive layer |
| Interlayer |

TABLE 9-continued

| Inventive Integral Lenticular Structure |
|---|
| Blue light sensitive layer<br>Antihalation layer +<br>UV-light absorber dyes<br>Lenticular Support |

Photographic Element Examples

COMPARATIVE EXAMPLE #1

Red, green and blue sensitized emulsions used for comparative examples were prepared as those described in U.S. Pat. No. 5,512,103, col. 57, as emulsions 28, 29 and 30 and will not be further described here.

Coupler dispersions were emulsified by methods well known to the art, and the following layers were coated on extruded lenticular PETG support (which was 23 mils thick and having a lenticular pitch of 73 lpi) using the layer arrangement depicted in Table 9. The gelatin layers were hardened with bis(vinylsulfonyl methyl) ether at 2.4% of the total gelatin weight or with bis(vinylsulfonyl methyl) at 2.18% of the total gelatin weight.

The emulsions and dispersions were coated using conventional multilayer coating techniques using the emulsion and coupler coverages given in Tables 1 or 2. The coverages in Table 1 were chosen for those materials destined to be used for making reflection print images, and those materials listed in Table 2 were used for direct, backlit display type viewing. Fundamentally, there is only a significant difference in emulsion and coupler coverage between the two different types of material. In either instance the materials were prepared in the layer order given in Table 9.

INVENTIVE EXAMPLE #2

Silver chloride emulsions were chemically and spectrally sensitized as is described below.

Blue Sensitive Emulsion (Blue EM-1, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation. At 90% of the grain volume, precipitation was halted and a quantity of potassium iodide was added, equivalent to 0.2M % of the total amount of silver. After addition, the precipitation was completed with the addition of additional silver nitrate and sodium chloride and subsequently followed by a shelling without dopant. The resultant emulsion contained cubic shaped grains of 0.60 μm in edge length. This emulsion was optimally sensitized by the addition of a colloidal suspension of aurous sulfide and heat ramped up to 60° C. during which time blue sensitizing dye BSD-4, 1-(3-acetamidophenyl)-5-mercaptotetrazole and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant and $K_2IrCl_5$(5-methylthiazole ) dopant was added during the silver halide grain formation for most of the precipitation, followed by a shelling without dopant. The resultant emulsion contained cubic shaped grains of 0.30 μm in edge length. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1 and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant and $K_2IrCl_5$(5-methylthiazole) dopant was added during the precipitation process. This emulsion was optimally sensitized by the addition of a colloidal suspension of aurous sulfide followed by a heat ramp, and further additions of 1-(3-acetamidophenyl)-5-mercaptotetrazole, iridium dopant, potassium bromide, and red sensitizing dye RSD-1.

Coupler dispersions were emulsified by methods well known to the art, and the following layers were coated on the non-lenticular side of an extruded lenticular PETG support (which was 23 mils thick and having a lenticular pitch of 73 lpi) using the layer arrangement depicted in Table 9. The gelatin layers were hardened with bis(vinylsulfonyl methyl) ether at 2.4% of the total gelatin weight or with bis (vinylsulfonyl methyl) at 2.18% of the total gelatin weight. The composition of the individual layers is given as follows:

TABLE 10

Composition of the Photographic Element of Table 9 and Used to Prepare Reflective, Integral, Color Photographic Lenticular Prints

| | g/M² |
|---|---|
| RL-1: Red Sensitive Layer | |
| Gelatin | 1.46 |
| Red Sensitive Silver (Red EM-1) | 0.317 |
| C-3 | 0.423 |
| Dibutyl phthalate | 0.415 |
| UV-2 | 0.272 |
| 2-(2-butoxyethoxy)ethyl acetate | 0.0347 |
| Di-t-octyl hydroquinone | 0.0035 |
| DYE-3 | 0.0665 |
| GL-1: Green Sensitive Layer | |
| Gelatin | 1.64 |
| Green Sensitive Silver | 0.129 |
| M-2 | 0.317 |
| Dibutyl phthalate | 0.113 |
| DUP | 0.0483 |
| ST-8 | 0.242 |
| ST-21 | 0.0854 |
| ST-22 | 0.806 |
| 1-Phenyl-5-mercaptotetrazole | 0.0001 |
| DYE-2 | 0.0602 |
| BL-1: Blue Sensitive Layer | |
| Gelatin | 1.65 |
| Blue Sensitive Silver (Blue EM-1) | 0.280 |
| Y-5 | 0.482 |
| P-1 | 0.482 |
| Dibutyl phthalate | 0.218 |
| 1-Phenyl-5-mercaptotetrazole | 0.0001 |
| DYE-1 | 0.009 |
| IL: Interlayer | 0.75 |
| Gelatin | 0.108 |
| Di-t-octyl hydroquinone | 0.308 |
| Dibutyl pthalate | 0.0129 |

TABLE 10-continued

Composition of the Photographic Element of Table 9 and Used to Prepare Reflective, Integral, Color Photographic Lenticular Prints

| | g/M² |
|---|---|
| Disodium 4,5 Dihydroxy-m-benzenedisulfonate | 0.0495 |
| SF-1 | 0.0323 |
| Irganox 1076 ™ | 0.462 |
| **AHU: Antihalation Underlayer** | |
| Gelatin | 1.29 |
| Silver | 0.151 |
| Versa TL-502 | 0.0311 |
| UV-1 | 0.366 |
| UV-2 | 0.0646 |
| Di-t-octyl hydroquinone | 0.118 |
| Dibutyl phthalate | 0.359 |
| 1,4-Cyclohexylenedimethylene bis(2-ethylhexanoate) | 0.0717 |
| **Simultaneous Overcoat** | |
| Gelatin | 0.645 |
| Dow Corning DC200 | 0.0202 |
| Ludox AM | 0.1614 |
| Di-t-octyl hydroquinone | 0.013 |
| Dibutyl phthalate | 0.039 |
| SF-1 | 0.009 |
| SF-2 | 0.004 |

TABLE 11

Composition of the Photographic Element of Table 9 and Used to Prepare Backlit Display, Integral, Color Photographic Lenticular Prints

| | g/M² |
|---|---|
| **RL-1: Red Sensitive Layer** | |
| Gelatin | 3.58 |
| Red Sensitive Silver (Red EM-1) | 0.953 |
| C-1 | 0.861 |
| Dibutyl phthalate | 0.847 |
| UV-2 | 0.555 |
| 2-(2-butoxyethoxy)ethyl acetate | 0.0708 |
| Di-t-octyl hydroquinone | 0.0071 |
| DYE-3 | 0.665 |
| **GL-1: Green Sensitive Layer** | |
| Gelatin | 3.47 |
| Green Sensitive Silver | 0.323 |
| M-2 | 0.532 |
| Dibutyl phthalate | 0.191 |
| DUP | 0.0816 |
| ST-8 | 0.409 |
| ST-21 | 0.144 |
| ST-22 | 1.362 |
| 1-Phenyl-5-mercaptotetrazole | 0.0002 |
| DYE-2 | 0.0602 |
| **BL-1: Blue Sensitive Layer** | |
| Gelatin | 3.60 |
| Blue Sensitive Silver (Blue EM-1) | 0.581 |
| Y-5 | 1.13 |
| P-1 | 1.13 |
| Dibutyl phthalate | 0.510 |
| 1-Phenyl-5-mercaptotetrazole | 0.0002 |
| DYE-1 | 0.009 |
| **IL: Interlayer** | 0.75 |
| Gelatin | 0.108 |
| Di-t-octyl hydroquinone | 0.308 |
| Dibutyl phthalate | 0.0129 |
| Disodium 4,5 Dihydroxy-m-benzenedisulfonate | 0.0495 |
| SF-1 | 0.323 |
| Irganox 1076 ™ | 0.462 |

TABLE 11-continued

| | |
|---|---|
| **AHU: Antihalation Underlayer** | |
| Gelatin | 1.29 |
| Silver | 0.151 |
| Versa TL-502 | 0.0311 |
| UV-1 | 0.366 |
| UV-2 | 0.0646 |
| Di-t-octyl hydroquinone | 0.118 |
| Dibutyl phthalate | 0.359 |
| 1,4-Cyclohexylenedimethylene bis(2-ethylhexanoate) | 0.0717 |
| **S-1: Simultaneous Overcoat** | |
| Gelatin | 0.645 |
| Dow Corning DC200 | 0.0202 |
| Ludox AM | 0.1614 |
| Di-t-octyl hydroquinone | 0.013 |
| Dibutyl phthalate | 0.039 |
| SF-1 | 0.009 |
| SF-2 | 0.004 |

Structures

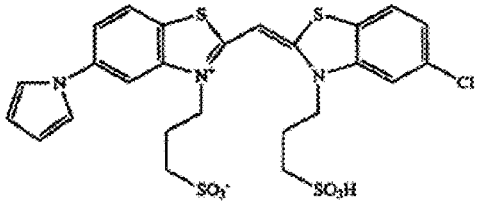

BSD-4

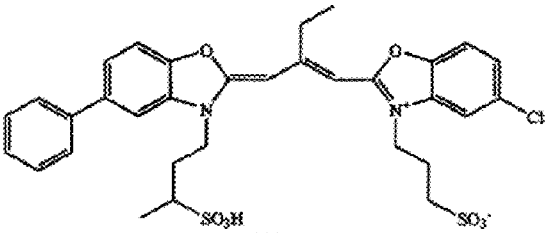

GSD-1

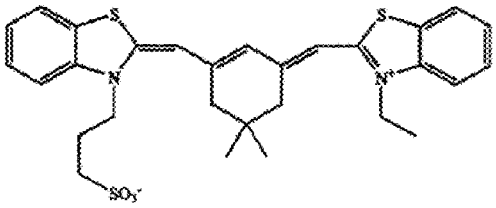

RSD-1

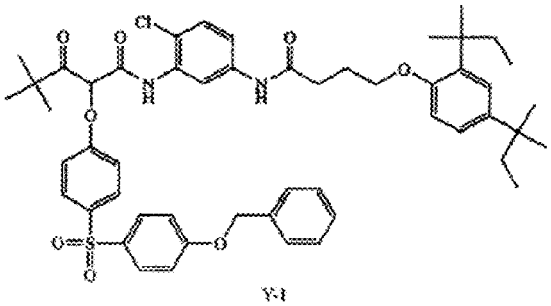

Y-1

TABLE 11-continued
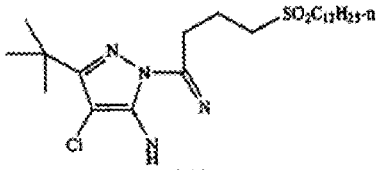
M-2
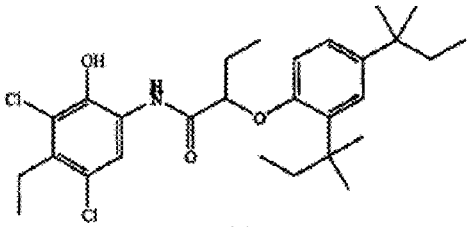
C-1
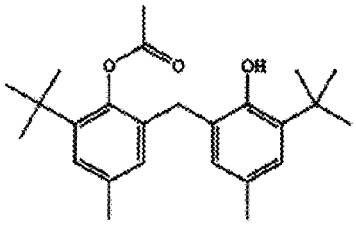
ST-6
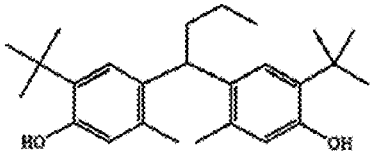
ST-8
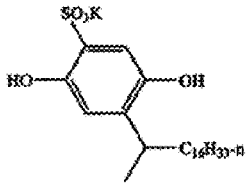
ST-16
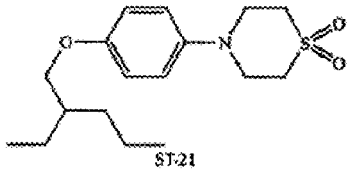
ST-21
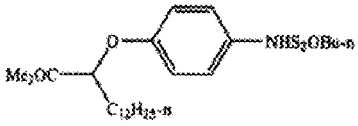
ST-22
TABLE 11-continued
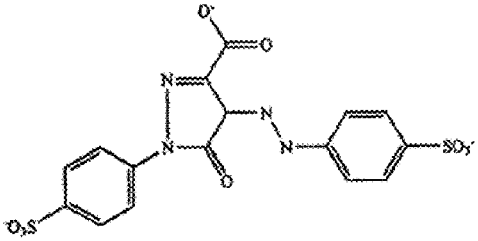
DYE-1
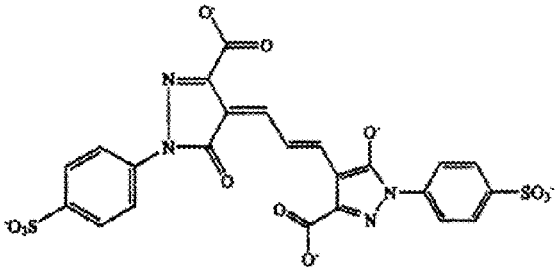
DYE-2
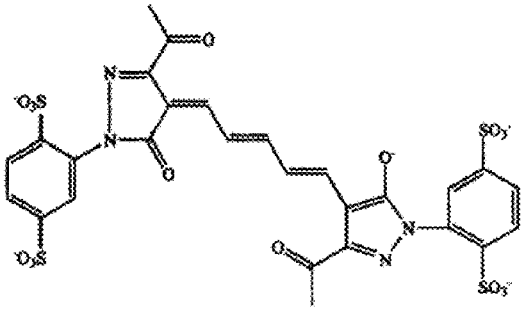
DYE-3
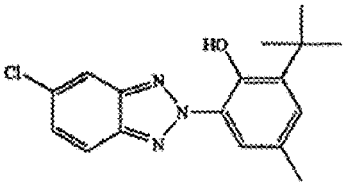
UV-1
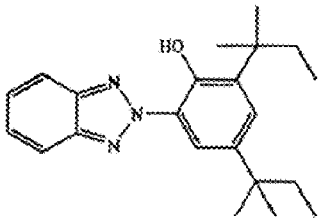
UV-2

TABLE 11-continued

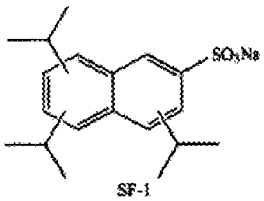

SF-1

$CFR_3(CF_2)_7SO_3Na$
SF-2

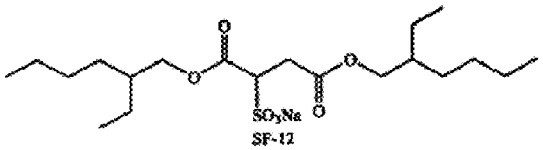

SF-12

Once the materials had been prepared, they were evaluated as follows:

To make the optical exposures, the multilayer samples were placed in a Kodak Model 1B sensitometer and exposed to 3000° K. light filtered with a Kodak Wratten™ filter 2C, plus Wratten™ filter 98 to obtain the characteristic response of the blue record, or a Wratten™ filter 99 to obtain the characteristic response of the green record, or a Wratten™ filter 70 to obtain the characteristic response of the red record. Exposure time was adjusted to 10 seconds and where required, neutral density filters were added to compensate for the amount of exposure. The exposures were performed by contacting the emulsion side of integral lenticular image material to a step wedge exposure tablet having a neutral density step exposure range of 0 to 3 log E in incremental steps of 0.15 log E.

The design and application of digital scanning film writers employing lasers or LED's have been described elsewhere (i.e., Taguchi et al in U.S. Pat. No. 5,539,487).

To make the scanning exposures, the samples were placed in a Kodak built digital film writer, using individually multiplexed lasers having the following spectral output characteristics: red laser output at 685 nm; green laser output at 532 nm; blue laser output at 473 nm. The exposure time of this device was designed to be $1\times10^{-6}$ sec. Since the power levels of each of the laser exposing units is different, they must first be calibrated and a lookup table (LUT) generated. These LUT's result in a 2 dimensional array whereby Status A output density from the sensitized media is plotted vs. an 8-bit code value (i.e., 0 to 255). The 8-bit code value is directly related to the output power of the laser and is obtained by additional calibration to relate the output power of the laser to the response of the media. To insure that the Dmax of each material was achieved, the laser exposing device was calibrated in way that the maximum power of the laser was achieved at the highest code value (i.e., 255). A red, green, and blue exposure tablet was generated electronically in a computer so to produce individual color exposures onto the sensitized media, effectively resulting in a 0 to 3 log E exposure so that comparisons with the optical exposures might be made directly.

A second, scanning exposing device was also constructed so that the exposing time might be reduced to $4.4\times10^{-8}$ sec. This device is based upon a set of lasers using slightly different output wavelengths of: red Laser output at 685 nm; green Laser output at 532 nm; blue Laser output at 458 nm. Beam spot size was 10μ in the slow scan direction and 110μ in the fast scan direction. This machine was also individually calibrated to obtain LUT's suitable for generating 0 to 3 log E exposures in the same manner as the previous device.

After the samples were exposed, they were processed in the Kodak Ektacolor RA™ Color Development Process. Samples of material such as that described by the compositions given in Table 11, which are designed to be made into reflection print materials, were processed using the conventional developer cycle times used for color paper prints, i.e., 45 seconds of development. Samples of material such as that described by the compositions given in Table 11, which are designed to be made into direct viewing, backlit, display print materials, were processed using the conventional developer cycle times used for color display prints, i.e., 110 seconds of development. The longer development cycle time is required to develop the higher silver coverages required to produce the higher dye densities required for direct transmission viewing.

After processing, the characteristic curves of each sample was determined, by measuring the individual Status A densities at each exposure step using a commercially available densitometer such as that manufactured by the X-rite Co. To simplify the comparative analysis, the Dmax (maximum density) of each sample was also determined and used for further comparison.

The Dmax values for these samples of materials destined for use as color reflection prints may seem low. This is not the case, however, as they are destined to have a reflective, back laminate applied to the non-lenticular emulsion surface after processing. Examples of such processes are described elsewhere (cf. Morton, in U.S. Pat. No. 5,639,580, and Kistner, in U.S. Pat. No. 5,013,621). The effect of adding the reflective backlayer is to roughly double the density of the transmissive element through what is known as the transmission to reflection transform. This phenomena are well known to those skilled in the art and have been studied by Williams and Clapper whose work is summarized in "The Theory of the Photographic Process", 4th Edition, edited by T. H. James, page 527.

Table 12 below illustrates the response of the comparative material if only the emulsion coverage is increased in an attempt to increase the Dmax of the element to make it suitable for both optical and scan printing. With a substantial increase in emulsion coverage in each color record of +45%, the change in the Dmax of the element is clearly noted for both the optical and the scanning exposures. However, the Dmax difference between the optical and scanning exposures remains large, especially the Dmax's of the red and green sensitized emulsions. Additionally, increasing the emulsion coverage by +45% is impractical from a variety of considerations, including additional manufacturing cost, impact upon the color development process including development time, bleach-fix time, wash time, etc. and upon the environmental ecology of the photographic system.

The data given in Table 13 illustrate the same problem when the comparative element is intended for use as a transmissive, backlit display print material. Increasing silver coverage does increase Dmax, but does not compensate for the shortened exposure time required by the scanning printing system. Also note that the Dmax values given in Table 13 were obtained from the second scanning exposing device which has an even shorter exposure time. Further shortening the exposing time further aggravates the problem, especially in the red and green sensitive records.

TABLE 12

Effect of Increasing Emulsion Coverage to Compensate for Reciprocity Failure in a Reflection Print Format

| Material/ | Dmax Resulting from a $1 \times 10^{-6}$ sec Exposure | | | Dmax Resulting from a 10 sec Exposure | | | Difference in Dmax ($1 \times 10^{-6}$ sec − 10 sec Exposure) | | |
|---|---|---|---|---|---|---|---|---|---|
| Color | Red | Grn | Blue | Red | Grn | Blue | Red | Grn | Blue |
| Emulsions from Example #1 | 0.74 | 0.83 | 0.95 | 1.30 | 1.48 | 1.20 | −0.56 | −0.65 | −0.25 |
| Increase emulsion coverage +45% | 1.04 | 1.20 | 1.21 | 1.72 | 2.04 | 1.31 | −0.27 | −0.84 | −0.10 |
| Increase in Dmax | +0.30 | +0.37 | +0.26 | +0.42 | +0.56 | +0.11 | | | |

TABLE 13

Effect of Increasing Emulsion Coverage to Compensate for Reciprocity Failure in a Display Print Format

| Material/ | Dmax Resulting from a $4.4 \times 10^{-6}$ sec Exposure | | | Dmax Resulting from a 10 sec Exposure | | | Difference in Dmax ($4.4 \times 10^{-6}$ sec − 10 sec Exposure) | | |
|---|---|---|---|---|---|---|---|---|---|
| Color | Red | Grn | Blue | Red | Grn | Blue | Red | Grn | Blue |
| Emulsions from Example #1 | 2.82 | 1.78 | 2.40 | 3.44 | 2.86 | 2.77 | −0.62 | −1.08 | −0.37 |
| Increase emulsion coverage +45% | 3.22 | 2.10 | 2.69 | 3.71 | 3.15 | 2.90 | −0.49 | −1.05 | −0.21 |
| Increase in Dmax | +0.40 | +0.32 | +0.29 | +0.27 | +0.29 | +0.13 | | | |
| Dmax of Increased Emulsion Coverage Compared to Optical Exposure of Example #1 | −0.22 | −0.76 | −0.08 | | | | | | |

The data given in Table 14 show the effect of the combination of adding the reciprocity enhancing dopant in the inventive example and increase the emulsion coverage by only 15%. The dopant significantly reduces the difference in Dmax between the optical and scanning exposures and a modest increase in emulsion coverage meets the imaging system requirements by raising the Dmax of the inventive element in the scanning exposure mode to that of the comparative element using optical exposure.

TABLE 14

Effect of Adding a Reciprocity Enhancing Dopant and Also Increasing Emulsion Coverage in a Reflection Print Format

| Material/ | Dmax Resulting from a $4.4 \times 10^{-6}$ sec Exposure | | | Dmax Resulting from a 10 sec Exposure | | | Difference in Dmax ($4.4 \times 10^{-6}$ sec − 10 sec Exposure) | | |
|---|---|---|---|---|---|---|---|---|---|
| Color | Red | Grn | Blue | Red | Grn | Blue | Red | Grn | Blue |
| Emulsions from Example #1 | 0.83 | 0.92 | 1.06 | 1.31 | 1.49 | 1.23 | −0.48 | −0.57 | −0.17 |
| Emulsions from Example #2 | 1.14 | 1.06 | 0.99 | 1.34 | 1.32 | 1.22 | −0.20 | −0.26 | −0.23 |
| Increase emulsion coverage +15% | 1.38 | 1.22 | 1.13 | 1.54 | 1.44 | 1.28 | −0.16 | −0.22 | −0.15 |
| Dmax of Example #2 Compared to Optical Exposure of Example #1 | +0.07 | −0.01 | −0.10 | | | | | | |

An important consideration when designing photographic elements for both scanning and optical exposing devices is the sharpness of the resultant image. Well known in the art is the use of grey silver in an antihalation layer to enhance sharpness. Enhancing the sharpness of an integral, lenticular color photographic element is especially desirable, since it is highly undesirable for the exposing light, whether it be from a scanning exposing device or an optical exposing device, to enter into the lenticular support, where by light-piping, the light may emerge at a distance far from the point of exposure creating halation. This phenomena is more true of sensitized lenticular media than planar supports because of the half-conical nature of the lenticular lens.

The use of scanning exposing devices in combination with integral lenticular sensitized media compounds the sharpness dilemma, since the scanning beam itself is quite small, being on the order of approximately 10μ in width in the slow scan direction and 110μ in length in the fast scan direction. Since the scanning beam is modulated to expose lines of image information and each line may represent different images, then the adjacent images must necessarily be resolved by the element, else they merge into a non-recognizable image due to poor system sharpness of the photographic element. It is often the instance where adjacent lines of images are radically different in composition and or density, i.e.: dark text on a light background. The physical dimension of the lenticule, in combination with the width of the scanning exposing beam and the sharpness of the element determine the possible number of different, recognizable images which can be written under a lenticule.

For example, if the lenticular pitch of the support is 200 lpi (7,874 lenticule per meter, 1 pm), then the width of the individual lenticule is 0.005 inches ($12.7 \times 10^{-5}$ meters). If the width of scanning exposing beam in the slow scan direction is 10μ, or 0.0004 inches, then the lenticular element is capable of writing 12 images/lenticule. Analogously, if the pitch is reduced to 73, then up to 34 distinct images may be written and if the pitch is further reduced to 50 lpi (1.968 1 pm), then 50 images may be written under each lenticule.

Increasing the number of distinct views is a goal of the photographic system as the amount of information which can be stored is proportional to the number of images. While all the systems described above could accommodate images of a "stereo pair", the desire is to produce a system whereby images which contain motion and more specifically as much motion as possible, yet maintaining the uniqueness of each image is highly desirable. A lenticular image containing only 12 or fewer views may reproduce, for example, only 2 seconds of video or ½ second of motion picture film. Analogously, a lenticular element having a system resolution capable of recording 50 images, might reproduce 4 to 8 seconds of video or up to 2 seconds of motion picture film.

The measurement of sharpness of a photographic element is difficult, but the methods are well known and techniques for its determination are well characterized. A complete description of sharpness in a photographic element is given by M. Kriss in "The Theory of the Photographic Process", 4th Edition, edited by T. H. James, Chapter 21, "Image Structure". In conventional photographic systems, the modulation transfer function, or MTF, of each of the imaging components is characterized, then cascaded together to estimate the overall system MTF. In the case of the optical printing systems such as that described by Slater (Slater et al in U.S. Pat. No. 5,822,038), described herein, we calculate the MTF for the film writer, the negative, the contact printer, the lenticular lens, and the photographic element coated upon the lenticular support. For scanning exposing systems, we delete the film writer, the negative, and the contact printer, substituting the MTF of the digital scanning writer in its place. As discussed earlier, the MTF of the lenticular lens is limited by spherical aberration and coma.

The sensitized material coated on the lenticular support is limited in MTF response by several factors dominated by light scatter phenomena. Light scatter degrades sharpness in the element in proportion to its overall thickness, the size, shape and halide content of the emulsion grains, the amount of inter-grain absorber dye used to absorb scattered light and the presence and design constructs of the antihalation layer. (This assumes that in a direct viewing print material, that image modifying chemistry to influence sharpness via inter-image effects are not employed.) Anti-halation layers in print materials are not unknown (Morton, in U.S. Pat. No. 5,689,372 and Morton, in European Patent Application EP 0 780 728 A1), but also are not commonly included for a variety of reasons, including that they are difficult to remove either by direct washing such as when rem-jet material is used or by bleaching or bleach-fixing if grey silver or solid particle dye dispersions are employed.

Since the determination of the MTF of the photographic elements described herein are difficult at best, they are even more so, if they are combined onto a lenticular support. In these instances, it is best to characterize the MTF of the lenticular support and the MTF of the characteristics of the photographic element coated on a planar support separately and then combine them. For this reason, the elements described in examples 1 and 2 were coated on both lenticular and planar supports (7 mil Estar polyester). The MTF measurements reported below are from examples prepared on the planar support. The information given in Table 15 describes the results of changing the amount of grey silver contained in the antihalation layer for the element which is destined to become an integral, reflective lenticular print.

The measurement of the MTF of an element requires the determination of the response of the element at a variety of frequencies. In most photographic systems where some degree of magnification of the negative is involved, the range of frequencies measured is typically between 1 and 160 cycles per mm. For direct viewing photographic prints, the usual range of frequencies is much lower, i.e., 0.5 to 40 cycles/mm, as there is no magnification involved and the MTF of the human eye declines dramatically past 10 cycles/mm. For complex systems like lenticular imaging systems, if scanning exposing devices are used to expose the image and the image spot size is 10μ, then the writing pitch is 0.01 mm and the corresponding frequency is 50 c/mm. We found it convenient to measure the response of these systems at 30 c/mm. The example in given in Table 15 clearly shows the dramatic impact of including the grey silver in the antihalation layer, as the MTF enhancement afforded by its presence ranged from +8% in the red record to +17% in the blue record.

The information in Table 16 shows the effect of a series of grey silver levels in the antihalation layer of the element designed to become a direct viewing display print. Because of the additional amounts of emulsion and dispersions in the element, the thickness is increased and, hence, the sharpness as manifested by the MTF response is correspondingly decreased. However, the effect of the grey silver level upon MTF is clearly evident and similar to the response of the elements response given in Table 15.

TABLE 15

Effect of Grey Gel Level in the Antihalation Layer of Inventive Example #2 on Sharpness for a Reflection Print Element

| | % MTF @ 30 c/mm Grey Silver Level | | |
|---|---|---|---|
| Color | 0.0 mg/M² | 0.151 mg/M² | Change in % MTF |
| Red | 67% | 75% | +8% |
| Green | 55% | 66% | +11% |
| Blue | 45% | 62% | +17% |

TABLE 16

Effect of Grey Gel Level in the Antihalation Layer of Inventive Example #2 on Sharpness for a Display Print Element

| | % MTF @ 30 c/mm | | | Δ% MTF @ 30 c/mm | | |
|---|---|---|---|---|---|---|
| mg Grey Silver/M² | Red | Green | Blue | Red | Green | Blue |
| 0.0 | 58% | 62% | 25% | — | — | — |
| 0.075 | 64% | 65% | 33% | +6% | +3% | +8% |
| 0.151 | 64% | 68% | 35% | +6% | +6% | +10% |
| 0.226 | 66% | 66% | 36% | +8% | +4% | +11% |

The invention has been described in detail with particular reference to certain preferred embodiments thereof, but it will be understood that variations and modifications can be effected within the spirit and scope of the invention.

What is claimed is:

1. A method of recording multiple images by providing a color photographic element comprising a transparent lenticular support;

a first applied subbing layer on the non-lenticular side of said support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support, wherein said color photographic element further comprising applying a reflective backlayer to the non-lenticular side of the element.

2. The method of claim 1, wherein said magenta dye forming coupler comprises

Magenta-1

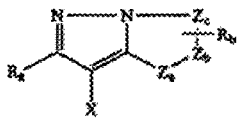

wherein Ra and Rb independently represent H or a substituent; X is hydrogen or a coupling-off group; and Za, Zb, and Zc are independently a substituted methine group, =N—, =C—, or —NH—, provided that one of either the Za—Zb bond or the Zb—Zc bond is a double bond and the other is a single bond, and when the Zb—Zc bond is a carbon-carbon double bond, it may form part of an aromatic ring, and at least one of Za, Zb, and Zc represents a methine group connected to the group Rb.

3. The method of claim 1 wherein the yellow dye forming coupler comprises

Yellow-5

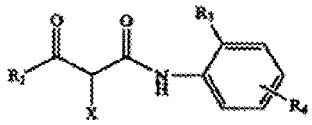

wherein R2 represents a tertiary alkyl group, R3 represents a halogen or an alkoxy substituent, R4 represents a substituent, and X represents a N-heterocyclic coupling-off group.

4. The method of claim 1 wherein the cyan dye forming coupler comprises formula (IA)

(IA)

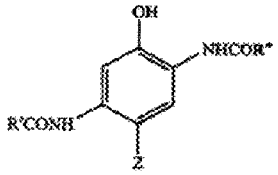

wherein

R' and R" are substituents selected such that the coupler forms image dyes having very sharp-cutting dye hues on the short wavelength side of the absorption curves with absorption maxima (λmax) which are shifted hypsochromically and are in the range of 620–645 nm; and Z is a hydrogen atom or a group which can be split off by the reaction of the coupler with an oxidized color developing agent.

5. The method of claim 1 wherein the iridium dopant of the cyan or magenta emulsion is an organo-metallic complex.

6. The method of claim 1 wherein the cyan or magenta emulsion contains a ruthenium complex.

7. The method of claim 1 wherein at least one of the cyan, magenta, or yellow emulsions contains an osmium complex.

8. The method of claim 1 wherein the emulsions are sensitized with a gold complex.

9. The method of claim 1 wherein at least one of the cyan, magenta, or yellow emulsions contains less than 1.0 M percent iodide.

10. The method of claim 1 wherein the antihalation layer is comprised of finely divided silver.

11. The method of claim 1 wherein the antihalation layer is comprised of a solid particle dye or mixture of solid particle dye dispersions.

12. The method of claim 1 wherein the color developer utilized in developing does not contain benzyl alcohol.

13. The method of claim 1 wherein the developed image is a lenticular image of a sequence of images which when viewed appear as a stereoscopic image.

14. The method of claim 1 wherein the image is a sequence of images spatially different by increments of time so as to produce the effect of motion when viewed.

15. The method of claim 1 wherein said reflective backlayer is affixed via a pressure sensitive adhesive.

16. The method of claim 1 wherein exposing is with a scanning exposing device comprising a laser or a combination of lasers of differing wavelengths chosen so as to match the spectral sensitivities of the element.

17. The method of claim 15 wherein the exposing is with a scanning exposing device comprising a light emitting diode (LED) or a combination of LED's of differing wavelengths chosen so as to match the spectral sensitivities of the element.

18. The method of claim 1 wherein the exposing is with a scanning exposing device comprising a scanning cathode ray tube (CRT) chosen so as to match the spectral sensitivities of the element.

19. The method of claim 1 wherein the exposing is with a scanning exposing device capable of steering the exposing beam in a longitudinal and a latitudinal direction.

20. The method of claim 1 wherein the lenticular support is an extruded polymer sheet.

21. The method of claim 1 wherein the lenticular support is comprised of polyethylene terephthalate-glycolate.

22. The method of claim 1 wherein the lenticular support further comprises an antistatic layer on the lenticular side.

23. The method of claim 1 wherein said exposing is optically.

24. The method of claim 1 wherein said exposing is with a scanning beam device.

25. A method of recording multiple images by providing a color photographic element comprising a transparent lenticular support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support and wherein the lenticular support further comprises an antistatic layer on the lenticular side.

26. The method of claim 25 wherein said magenta dye forming coupler comprises Magenta-1

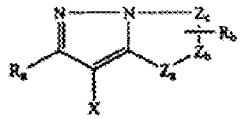

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

27. The method of claim 25 wherein the yellow dye forming coupler comprises Yellow-5

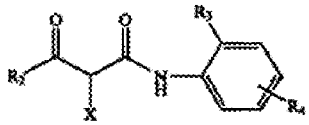

wherein $R_2$ represents a tertiary alkyl group, $R_3$ represents a halogen or an alkoxy substituent, $R_4$ represents a substituent, and X represents a N-heterocyclic coupling-off group.

28. The method of claim 25 wherein the cyan dye forming coupler comprises formula (IA)

(IA)

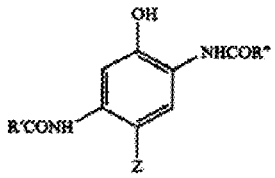

wherein

R' and R" are substituents selected such that the coupler forms image dyes having very sharp-cutting dye hues on the short wavelength side of the absorption curves with absorption maxima ($\lambda_{max}$) which are shifted hypsochromically and are in the range of 620–645 nm; and Z is a hydrogen atom or a group which can be split off by the reaction of the coupler with an oxidized color developing agent.

29. The method of claim 25 wherein the iridium dopant of the cyan or magenta emulsion is an organo-metallic complex.

30. The method of claim 25 wherein the color developer utilized in developing does not contain benzyl alcohol.

31. The method of claim 25 wherein the developed image is a lenticular image of a sequence of images which when viewed appear as a stereoscopic image.

32. The method of claim 25 wherein the image is a sequence of images spatially different by increments of time so as to produce the effect of motion when viewed.

33. The method of claim 25 further comprising applying a reflective backlayer to the non-lenticular side of the element.

34. The method of claim 25 wherein the image is exposed from the non-lenticular side of the support.

35. The method of claim 25 wherein exposing is with a scanning exposing device comprising a laser or a combination of lasers of differing wavelengths chosen so as to match the spectral sensitivities of the element.

36. The method of claim 33 wherein the exposing is with a scanning exposing device comprising a light emitting diode (LED) or a combination of LED's of differing wavelengths chosen so as to match the spectral sensitivities of the element.

37. The method of claim 25 wherein the lenticular support is comprised of polyethylene terephthalate-glycolate.

38. The method of claim 37 wherein the lenticular support has first applied a subbing layer to the non-lenticular side.

39. A method of recording multiple images by providing a color photographic element comprising a transparent lenticular support, wherein said support comprises polyethylene terephthalate-glycolate;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support.

40. The method of claim 39 wherein said magenta dye forming coupler comprises Magenta-1

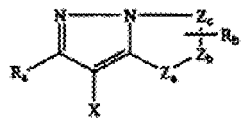

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

41. The method of claim 40 wherein the yellow dye forming coupler comprises Yellow-5

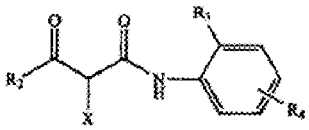

wherein $R_2$ represents a tertiary alkyl group, $R_3$ represents a halogen or an alkoxy substituent, $R_4$ represents a substituent, and X represents a N-heterocyclic coupling-off group.

42. The method of claim 41 wherein the cyan dye forming coupler comprises formula (IA)

(IA)

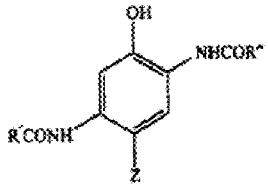

wherein

R' and R" are substituents selected such that the coupler forms image dyes having very sharp-cutting dye hues on the short wavelength side of the absorption curves with absorption maxima ($\lambda_{max}$) which are shifted hypsochromically and are in the range of 620–645 nm; and Z is a hydrogen atom or a group which can be split off by the reaction of the coupler with an oxidized color developing agent.

43. The method of claim 42 wherein the iridium dopant of the cyan or magenta emulsion is an organo-metallic complex.

44. The method of claim 42 wherein the color developer utilized in developing does not contain benzyl alcohol.

45. The method of claim 39 wherein the developed image is a lenticular image of a sequence of images which when viewed appear as a stereoscopic image.

46. The method of claim 39 wherein the image is a sequence of images spatially different by increments of time so as to produce the effect of motion when viewed.

47. The method of claim 46 wherein the lenticular support has first applied a subbing layer to the non-lenticular side.

48. The method of claim 47 wherein the lenticular support further comprises an antistatic layer on the lenticular side.

49. The method of claim 39 wherein exposing is with a scanning exposing device comprising a laser or a combination of lasers of differing wavelengths chosen so as to match the spectral sensitivities of the element.

50. The method of claim 39 further comprising applying a reflective backlayer to the non-lenticular side of the element.

51. The method of claim 50 wherein the exposing is with a scanning exposing device comprising a light emitting diode (LED) or a combination of LED's of differing wavelengths chosen so as to match the spectral sensitivities of the element.

52. A method of recording multiple images by providing a color photographic element comprising a transparent lenticular support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support wherein the image is a sequence of images spatially different by increments of time so as to produce the effect of motion when viewed.

53. The method of claim 52 wherein the iridium dopant of the cyan or magenta emulsion is an organo-metallic complex.

54. The method of claim 52 further comprising applying a reflective backlayer to the non-lenticular side of the element.

55. The method of claim 52 wherein the exposing is with a scanning exposing device capable of steering the exposing beam in a longitudinal and a latitudinal direction.

56. The method of claim 52 wherein exposing is with a scanning exposing device comprising a laser or a combination of lasers of differing wavelengths chosen so as to match the spectral sensitivities of the element.

57. The method of claim 52 wherein the exposing is with a scanning exposing device comprising a light emitting diode (LED) or a combination of LED's of differing wavelengths chosen so as to match the spectral sensitivities of the element.

58. The method of claim 52 wherein the lenticular support has first applied a subbing layer to the non-lenticular side.

59. The method of claim 58 wherein the lenticular support further comprises an antistatic layer on the lenticular side.

60. A method of recording multiple images by providing a color photographic element comprising a transparent lenticular support;

a first applied subbing layer on the non-lenticular side of said support;

an anti-halation layer coated on the non-lenticular side of the support, a red light sensitive layer comprising a cyan dye forming coupler, a green light sensitive layer comprising a magenta dye forming coupler, a blue light sensitive layer comprising a yellow dye forming coupler coated above the anti-halation layer, and wherein said element contains silver halide emulsions comprising greater than 90 percent silver chloride and at least the red and green light sensitive emulsions contain a high intensity exposure, reciprocity improving iridium dopant, exposing said element from the non-lenticular side of the support, and wherein the lenticular support is an extruded polymer sheet.

61. The method of claim 60 wherein the lenticular support is comprised of polyethylene terephthalate-glycolate.

62. The method of claim 60 wherein the image is a sequence of images spatially different by increments of time so as to produce the effect of the motion when viewed.

63. The method of claim 62 further comprising applying a reflective backlayer to the non-lenticular side of the element.

64. The method of claim 63 wherein said reflective backlayer is affixed via a pressure sensitive adhesive.

65. The method of claim 60 wherein the exposing is with a scanning exposing device capable of steering the exposing beam in a longitudinal and a latitudinal direction.

66. The method of claim 63 wherein the lenticular support further comprises an antistatic layer on the lenticular side.

* * * * *